US012806729B2

(12) United States Patent
Craft et al.

(10) Patent No.: US 12,806,729 B2
(45) Date of Patent: Nov. 24, 2026

(54) TROWEL-GRINDER-POLISHER MACHINES

(71) Applicants: Curtis Craft, Nampa, ID (US); Zoltan Kemeny, Chandler, AZ (US)

(72) Inventors: Curtis Craft, Nampa, ID (US); Zoltan Kemeny, Chandler, AZ (US)

(73) Assignee: POWER TROWEL GRINDING INDUSTRY, LLC, Meridian, ID (US)

( * ) Notice: Subject to any disclaimer, the term of this patent is extended or adjusted under 35 U.S.C. 154(b) by 964 days.

(21) Appl. No.: 15/998,372

(22) Filed: Aug. 11, 2018

(65) Prior Publication Data

US 2018/0369981 A1 Dec. 27, 2018

(51) Int. Cl.
*B24B 7/18* (2006.01)
*B24B 27/00* (2006.01)
(Continued)

(52) U.S. Cl.
CPC ..... *B24B 7/186* (2013.01); *B24B 27/0076* (2013.01); *B24B 47/12* (2013.01);
(Continued)

(58) Field of Classification Search
CPC ..... B24B 47/12; B24B 7/18; B24B 7/186; B24B 27/0076; B24B 55/02; B24B 55/04; B24B 57/02; A47L 11/4063; A47L 11/4066; A47L 11/4069; A47L 2201/04; G05D 2105/10
(Continued)

(56) References Cited

U.S. PATENT DOCUMENTS 5,735,959 A * 4/1998 Kubo ..... A47L 11/4011 118/712
5,991,951 A * 11/1999 Kubo ..... A47L 11/16 15/49.1
(Continued)

FOREIGN PATENT DOCUMENTS

WO WO-2009027140 A1 * 3/2009 ..... B24B 7/186

OTHER PUBLICATIONS

Hansemann, WO-2009027140-A1 machine translation, Mar. 5, 2009 (Year: 2009).*

*Primary Examiner* — Brian D Keller
*Assistant Examiner* — Marcel T Dion
(74) *Attorney, Agent, or Firm* — FisherBroyles, LLP; Jeremy P. Sanders

(57) ABSTRACT

Disclosed is a concrete floor trowel machine of multiple blades with added floor polishing jacket or attachment. It saves expense and time associated with the use of a separate trowel and a polisher in consecutive order, often a day apart. Furthermore, disclosed is a blade replacement polisher disk with metallic hook-and-loop attached steel wool polisher puck, which is the loop component of that means of attachment. Means of slurry feed and suction removal to said puck is also disclosed, whereas said puck may rotate free or by planetary. Said pucks may be attached to blades. Safety cage and slurry splash cover supplement the machine. Removable caster legs are added to ease moving the off-use machine. Disclosed as well are robotic polisher-grinder modules in tandem or in train with changeable trowel-polisher modular inserts with electrical motors and power cable and water hose reels to be serviced from a distance, remotely controlled.

21 Claims, 61 Drawing Sheets

(51) Int. Cl.

| | |
|---|---|
| ***B24B 47/12*** | (2006.01) |
| ***B24B 49/00*** | (2012.01) |
| ***B24B 49/12*** | (2006.01) |
| ***B24B 55/05*** | (2006.01) |
| ***B24B 57/02*** | (2006.01) |
| *B24D 7/06* | (2006.01) |
| *B24D 7/10* | (2006.01) |

(52) U.S. Cl.
CPC ..... *B24B 49/003* (2013.01); *B24B 49/12* (2013.01); *B24B 55/052* (2013.01); *B24B 57/02* (2013.01); *B24D 7/066* (2013.01); *B24D 7/10* (2013.01)

(58) Field of Classification Search
USPC ..... 451/65, 259, 350, 353, 446, 451, 453, 451/455, 456
See application file for complete search history.

(56) References Cited

U.S. PATENT DOCUMENTS 6,238,277 B1 * 5/2001 Duncan ..... A47L 11/16 451/271
6,571,415 B2 * 6/2003 Gerber ..... A47L 11/40 15/49.1
6,938,298 B2 * 9/2005 Aasen ..... A47L 5/00 15/340.1
8,684,796 B2 * 4/2014 McCutchen ..... B24B 7/186 451/353
10,307,880 B1 * 6/2019 Richards ..... B24B 7/186
10,779,695 B2 * 9/2020 Burbank ..... A47L 9/1472
2004/0031113 A1 * 2/2004 Wosewick ..... A47L 13/20 15/340.1
2005/0235453 A1 * 10/2005 Vankouwenberg ..... A47L 11/4077 15/340.4
2007/0016328 A1 * 1/2007 Ziegler ..... A47L 9/009 701/23
2007/0157417 A1 * 7/2007 O'Hara ..... B62D 51/04 15/320
2007/0184754 A1 * 8/2007 Guertler ..... B24B 7/186 451/8
2009/0190999 A1 * 7/2009 Copoulos ..... B24B 41/047 404/112
2010/0136890 A1 * 6/2010 Strickland ..... B24B 7/186 451/73
2011/0202175 A1 * 8/2011 Romanov ..... A47L 11/4036 700/250
2014/0154959 A1 * 6/2014 Van Der Veen ..... B24B 7/18 451/350
2015/0128996 A1 * 5/2015 Dooley ..... A47L 11/4008 15/98
2015/0142169 A1 * 5/2015 Kim ..... A47L 11/282 15/98
2015/0182089 A1 * 7/2015 Jeong ..... A47L 11/4036 15/98
2015/0182090 A1 * 7/2015 Park ..... A47L 11/283 15/98
2015/0257622 A1 * 9/2015 Qian ..... A47L 11/4066 15/363
2016/0007817 A1 * 1/2016 Schlischka ..... A47L 11/4061 280/5.514
2016/0235269 A1 * 8/2016 Chen ..... A47L 11/4066
2017/0049285 A1 * 2/2017 Studebaker ..... A47L 11/4044
2017/0071436 A1 * 3/2017 Hofner ..... A47L 11/24
2018/0206691 A1 * 7/2018 Jang ..... A47L 11/4083
2018/0235425 A1 * 8/2018 Ding ..... A47L 11/4083
2019/0038106 A1 * 2/2019 Jang ..... A47L 11/4088
2019/0191950 A1 * 6/2019 Luo ..... A47L 1/02
2019/0216285 A1 * 7/2019 Jang ..... B25J 9/126
2019/0262963 A1 * 8/2019 Bittorf ..... B24B 27/0084
2019/0290088 A1 * 9/2019 Goto ..... A47L 11/283
2019/0290089 A1 * 9/2019 Johnson ..... A47L 11/305
2021/0113048 A1 * 4/2021 Jung ..... A47L 11/4066

* cited by examiner

STATE-OF-ART

TROWEL-GRINDER-POLISHER MACHINES

CROSS-REFERENCE TO RELATED APPLICATION

This patent application claims priority to U.S. Provisional Patent Application No. 62/605,571 filed on Aug. 16, 2017, which is herein incorporated by reference in its entirety.

FIELD OF THE INVENTION

This invention relates to walk-behind or sit-on wet concrete floor trowel machines. Also, to walk-behind or sit-on or non-sitting autonomous dry or wet concrete floor grinding and polishing machines. More specifically, to trowel-to-polisher conversion machines of slurry polishing by soft means on hard backing.

BACKGROUND OF THE INVENTION

The invention aims to save on time and cost of machinery used for concrete floor troweling and consecutive polishing, for which tasks, in state-of-the-art and practice, at least two different machines are used.

Notably, a trowel machine, with rotary blades and a polisher, with polishing discs. For small jobs, these are configured as walk-behind machines, and for larger ones, as sit-on-machines. Some sit-on polishers are self-driving and some polisher heads comprise multiple disks of different grit or function, such as wiping, wetting, cleaning/vacuuming pinhole filling, densifying, "waxing" with plastic melt to seal, resin and more.

These two machines have similar or identical construction, power-need and rotational-speed and shortly follow each other (say within a day or so) on a new construction site. By themselves, each machine is expensive and requires secure storage space. Their combination is proposed here, using polishing head attachment over the trowel blades or blade replacement with polishing blades or arm replacement with grinding head/disc. Therefore, it is the object of this invention to resolve the conflicting functional means of troweling and polishing embodied in the same machine.

Furthermore, the invention is to provide for soft means polishing with slurry, including kieselguhr (DE) or such, especially for trowel-to-polisher conversion machines and processes, also not limited to such conversion machines. Also to polish with pucks, which are compressed or gel-set or sintered from diamond, ceramic, iron, copper, graphite and other suitable powders and extend the trowel machine's function to scrubbing, grinding, polishing, buffing, densifying/hardening and waxing, which require a variety of heads and fixtures, including the magnetic, twist-off (snail), bolted, doweled, pinned, clamped and hook-and-loop (Velcro) types, with grill size and other markers for identification and sequencing. In conjunction, further improvements are within the scope, which includes stationary or rotating lift-off and hang-on skirts, with venting slots, squeegee or brush vacuuming. Also, improvements in chemicals, which may include nano-silica or concrete softener, hardeners with acid softener, hardeners with or without acid softener, and hardener densifiers with lithium or potassium silicate magnesium Fluro silicate sodium silicate, and/or a combination of these.

Moreover, it is yet another object of the invention to further improve on the state-of-the-art by allowing for modular machine construction with individual electric motors turning individual polisher heads drum in clockwise, counterclockwise or mixed directions and mixed variable speeds and to reel a power cord and a water hose robotically or manned remote, without the need to carry water, slurry or chemical tanks and rechargeable batteries.

Finally, it is yet another object of the invention to further improve on the state-of-the-art by using semi-robotics or robotics. More specifically, an autonomous grinder or polisher with a magnetic ball or swivel wheel drive or hydroplaning drive or dual/triple wheel drive, with or without walk-behind worker assistance. Also, the serial coupling of such robots, either rigidly or in swivel chain, to form a robotic train or aggregate, preferably guided using LIDAR or sonar or laser.

SUMMARY OF THE INVENTION

The above problems and others are at least partially solved and the above objects and others realized in a process, uses a concrete floor trowel machine of at least two blades for polishing concrete floors, employing polishing jackets over the trowel blades or replacing said troweling blades or arms with polishing blades or grinder or polisher attachments. Additional problems are solved with trowel blade replacement with polisher disc, which preferably has steel cloth pucks, with or without slurry feed holes. Said cloth may hold dry polishing powder and may comprise the loop part of a hook-and-loop (Velcro) attachment, which however is made of stainless steel (external stainless steel plate feature) or other suitable metal. Trowel blade replacement with forced or free-turn or swivel or slowly rotating planetary polisher head is also proposed.

Additionally, it is proposed to build remote controlled robotic, walk-behind and sit-on trowel-polisher machines powered from and teetered to the electrical grid by power cord plugged in a wall or ceiling socket and reeled on said machine battery, which can also reel its water hose, supplying water with chemicals from as far as 100 feet. The locomotion of said machine could be wheel driven or hydroplaning gliding and it may be built modular, allowing for quick and easy trowel to polisher switch. Also for quick and easy polisher head switch, from dry to wet or from coarse to fine. The water and chemical feed with power chord tether incorporates control cables for programmed or manual machine guiding. The electrical powering however may be supplemented or substituted by gas or gasoline engine power. The machine guiding may be assisted by manual control or by laser, or LIDAR or sonar or ultra-sonic beams or pulses emitted and received and processed by onboard or remote computer or dedicated electronic processor.

Additionally, it is proposed that each rotating part touching the floor, including trowel head and polisher disc, central or planetary, may be driven individually, not belted or geared or chained to each other or to a central shaft, thus allowing for improved grinding or polishing due to adjustable and variable polisher disk rotation speeds, programmed or controlled manually, though belt, chain or gear or switch-gear drive coupling may be retained. Means are proposed to allow the use of engine driven trowel conversion machines to individually driven active or passive planetary polisher disks, including engine driven power generator powering electrical motors driving the disks of 3", 4", 5.5", 6", 9", 12" or 14"+ made of semimetal, resin-metal, plastic, ceramic and compressed steel-wool or rock fiber (volcanic spun wool) in random, woven or twisted orientation or 3-D printed, some of which pucks, by the push of a button, may be lifted off individually or in groups, while leaving the rest down to polish or grind.

Finally, it is also proposed to build remote controlled semi-robotic or robotic autonomous grinder or polisher with a magnetic ball or swivel wheel drive or other drive means or hydroplaning drive with or without walk-behind worker assistance, and ultimately, also proposed the serial coupling of such robots, either rigidly or in swivel chain, to form a robotic train, which may be controlled via Wi-Fi Bluetooth app, using mobile electronics, such as cellphones or be guided by GPS or laser or LIDAR or sonar or ultra-sonic beams or pulses.

DETAILED DESCRIPTION OF THE PREFERRED EMBODIMENTS

Figure 1:
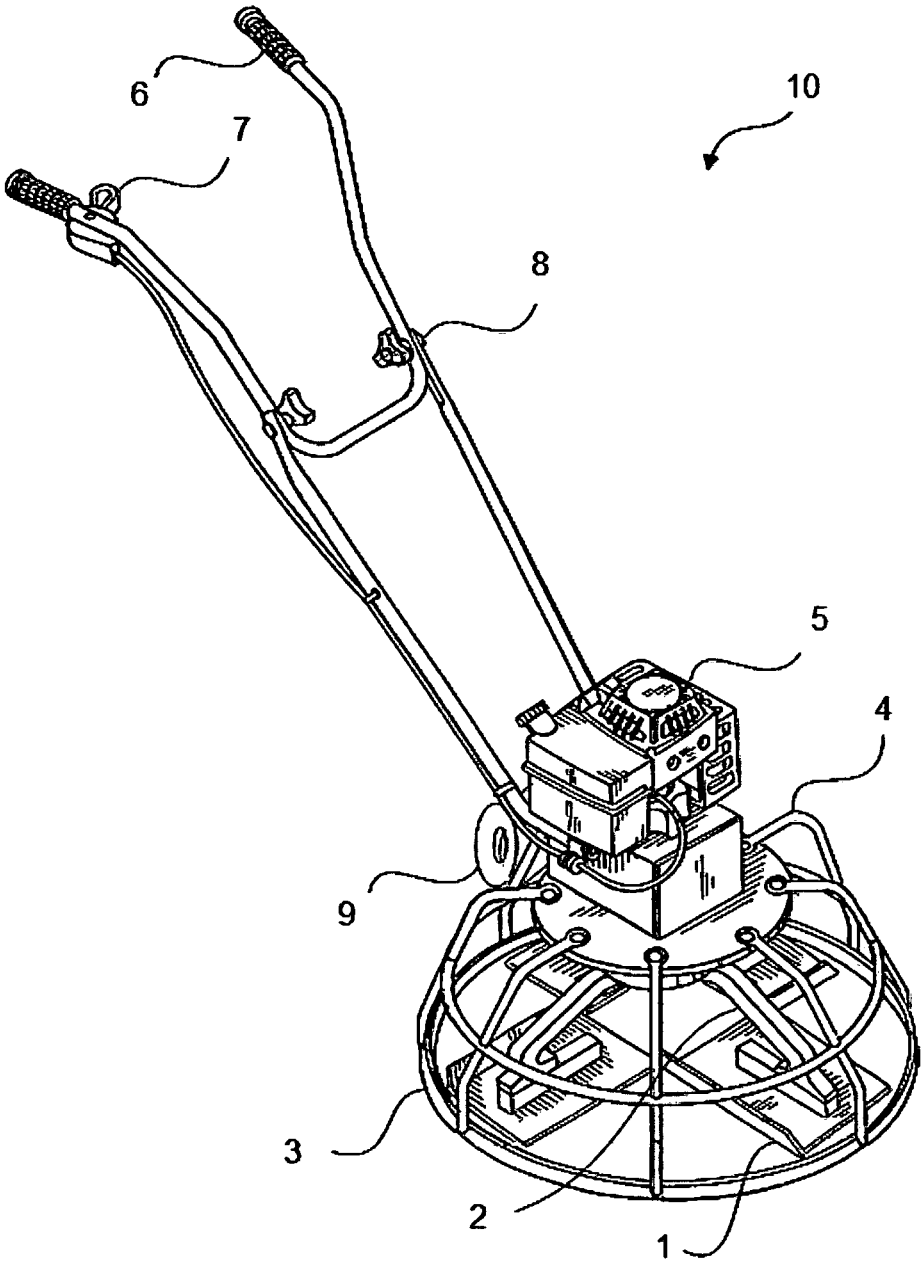
FIG. 1 is a STATE-OF-ART drawing, illustrating a walk-behind concrete polishing power-trowel machine with four trowel blades.

Attention is now turned to FIG. 1, which illustrates a STATE-OF-THE-ART, walk-behind, concrete polishing power-trowel machine, assembly 10, with four trowel blades, as a chosen example for its simplicity and commonality.

Machine 10 has four trowel blades 1, rigidly attached to four spider arms 2, a bumper rim 3, a safety cage 4, a powering engine 5, two handles 6, controls 7, optional stash-away hardware 8 and optional stash away roller 9. While blades 1 are shown to be short and wide, they can be long and narrow, as they are in most of the modern power trowels. Engine 5 is shown as a gasoline engine. However, other engines and hybrids, including electrical motors with onboard battery were also proposed before.

The worker walks behind such a machine with the expectation that his footprint will not show off. With proper timing and care, it does not. That is the state of the art of concrete floor troweling with much sophisticated machines. Some, for instance, have four rotary heads, each having four trowel blades and the operator sits on the so configured, self-propelling machine. Such machines are used for large concrete floor area troweling.

The state of the art of the concrete floor polishing is similar, using polisher machines, having rotary disks with polisher heads or pads. For simplicity, such polisher is not illustrated here.

To the skilled in the art, the similarity of these two kinds of machines is striking—even more so to the power-trowel operator, who may need to come back the next day with a similar size and speed power-polisher. Rather than bring a separate machine, this invention allows the operator to, for example, switch the power-trowel to polisher mode; say by pulling a polishing jacket over the trowel blades. Such jacket is disclosed next.

Figure 2:
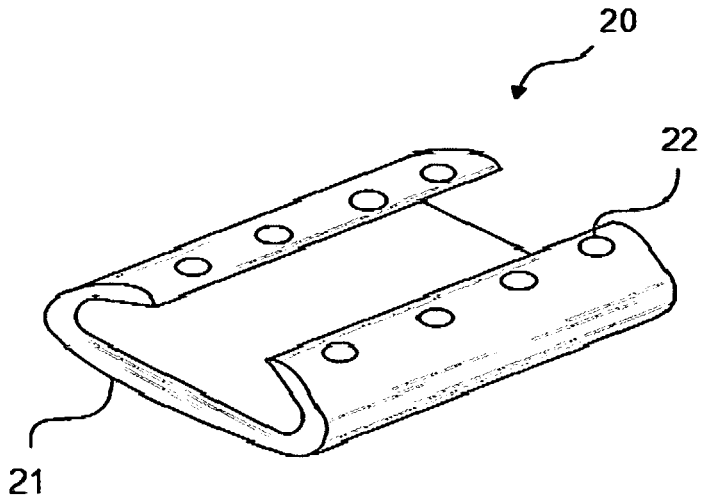
FIG. 2 illustrates a trowel-blade jacket in perspective view, as a preferred embodiment of this invention.

Attention is now turned to FIG. 2, which by assembly 20, illustrates a consumable throw-away polisher jacket, as a preferred embodiment of this invention. Likewise, parts labeled likewise further on.

Jacket 20 is cut from a consumable plastic mat of hard foam, cloth or sponge consistency, which may comprise of plastic insert balls melted with diamond powder at some distribution (not shown for clarity). Underside 21 of jacket 20 polishes the concrete floor, wet or dry. A mist system may keep floor wetting uniform, while at dry polishing, a vacuum may sweep up the dust. Such means are common in contemporary polishers. Their illustration is omitted here for simplicity.

The leading and trailing edges of jacket 20 are not distinguished, for these may be interchanged, even in between two polishing steps or passes. Reinforced holes 22 allow for trowel blade attachment, say bay rubber straps (not shown).

Note that jacket 20 is to be of sufficient, but not of excessive compressibility and flexibility. It shall be able to hold water, when soaked and its plastic inserts shall be able to melt by friction and seal the pores. The materials shall be the same as used in disc shape on common floor polishers. However, not all blades of a four-blade machine need to have the same composition. For instance, one may be the wetting jacket, the other one, the grit polisher; the next one is the melt sealer, and the last one, the wiper.

Trowel blades are made of thin plate or sheet metal, including stainless steel. They, themselves are flexible enough to attach rigid plastic polisher blocks to function as polisher disks. Such configuration, as another preferred embodiment of this invention, is illustrated next.

Figure 3:
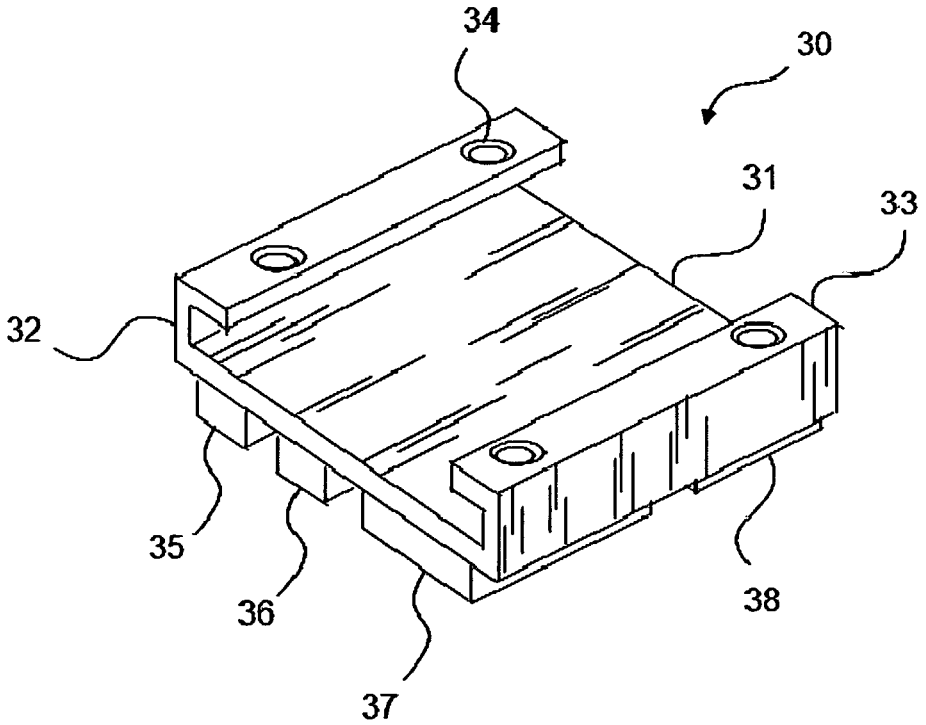
FIG. 3 illustrates, in perspective view, a trowel-blade polishing-head attachment, as another preferred embodiment.

Attention is now turned to FIG. 3, in which, a schematic 3-D view of another preferred embodiment of this invention is illustrated by trowel-head-attachment 30. Head 30 comprises of attachment plate 31, edge-stems 32 One at the leading and one at the trailing edges), hold-down lips 33 (one for each stem), holes for attachment 34 (may be threaded for screws), and a multiplicity of polisher blocks 35 through 38, integrated with or attached to plate 31.

Head 30 is shown as being short because it is only needed at the trowel tips, where blocks 35-38 attain the highest speed and where the trowel is the most flexible.

It shall be obvious to those skilled in the art that blocks 35-38 may be staggered in-plane and may have a different function, surface feature, and composition thereof.

Figure 61:
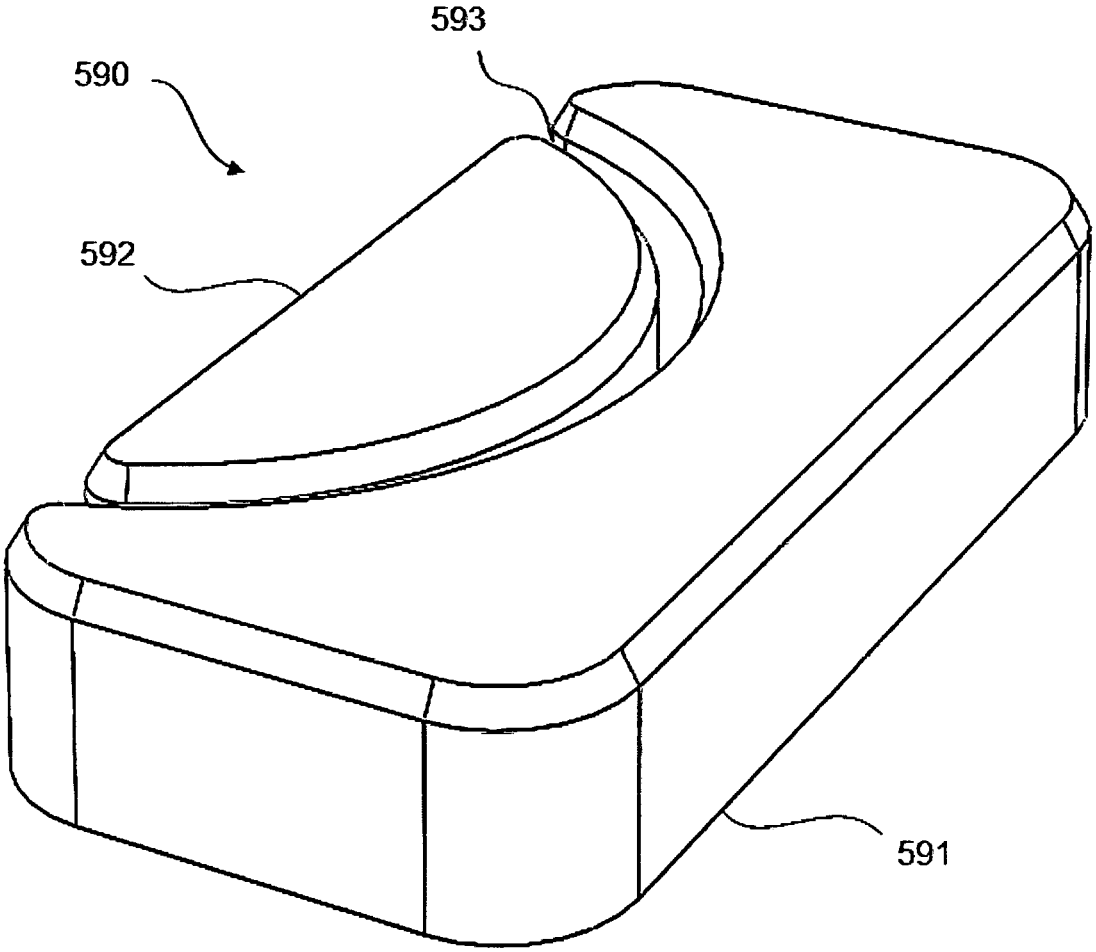
FIG. 61 is an isometric top view of another exemplary polisher pad in half nested assembly.
Figure 62:
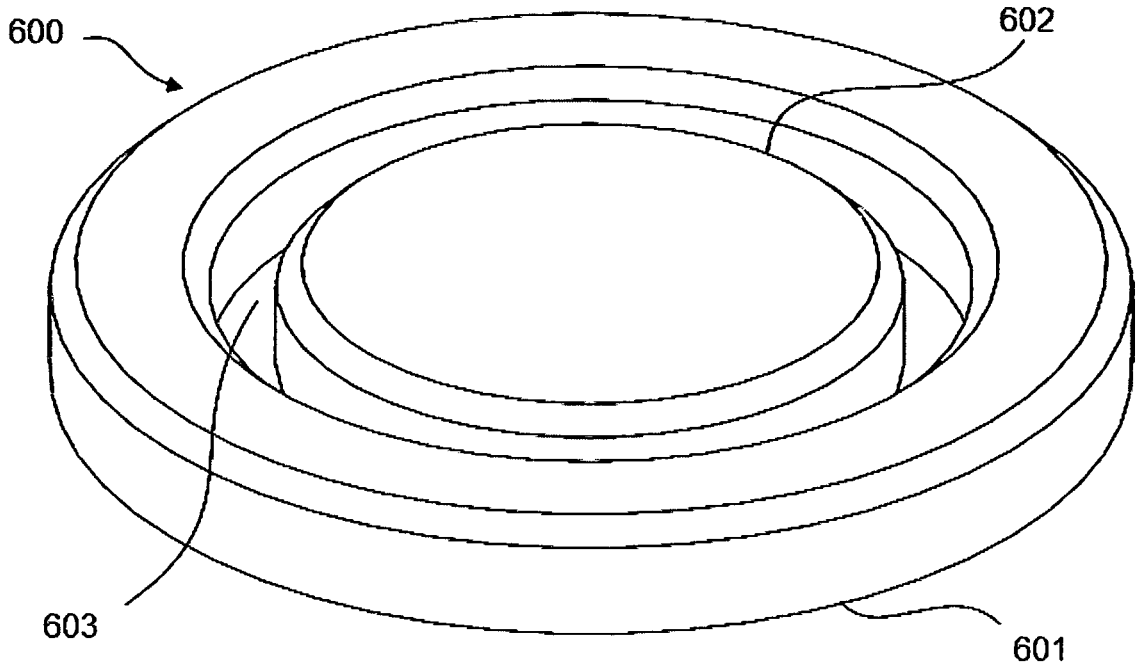
FIG. 62 is an isometric top view of another exemplary polisher pad in full nested circular assembly.
Figure 63:
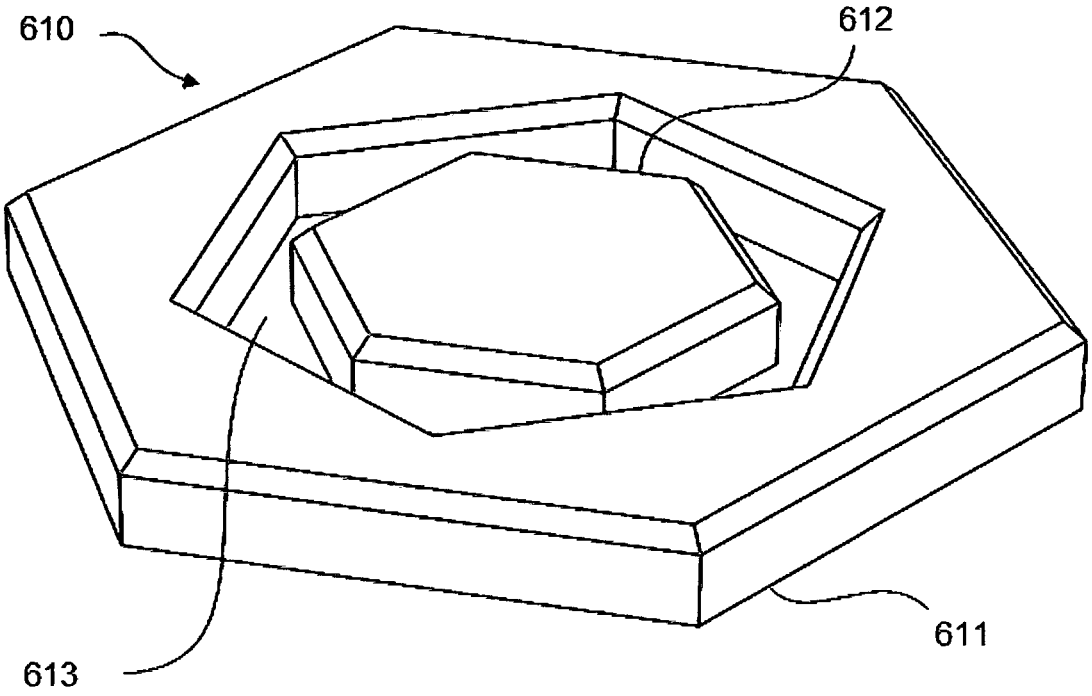
FIG. 63 is the same as FIG. 62 in non-circular assembly.

For instance, if blocks 35 are near to the leading edge, hitting first the floor, their job may be hard grit material removal. Behind these, block 36, may have the same function but with smaller grits for smoothing. Block 37 may be the melting resin type with fine diamond powder, while block 38 is magnetized powder or grit. Grit sizes vary between 80 and 6000. Blocks 35-37 may be selected for scrubbing, grinding, polishing, buffing and waxing made of semimetal, resin-metal, plastic with grits, ceramic and 3-D printed or compressed from rock-wool (volcanic spun wool) or metal-wool of random or twisted fibers, preferably with impregnated diamond. FIGS. 61-63 also show some suitable block geometry.

Just like a polisher head block has various surface features, materials and compositions, block 35-38 may have the same variety for the same reason. According to the needs, pads and jackets (say for buffing) may be secured to adjacent blades of the same trowel machine.

The preferred material of parts 31-34 is hard plastic, but aluminum and steel is also suitable.

In any case, it shall be obvious by now, that trowel jackets and attachments constructed according to the specifications of this invention, can save considerable expense and time in construction and maintenance jobs; at least as much as employing one machine, instead of two, can save.

Figure 4:
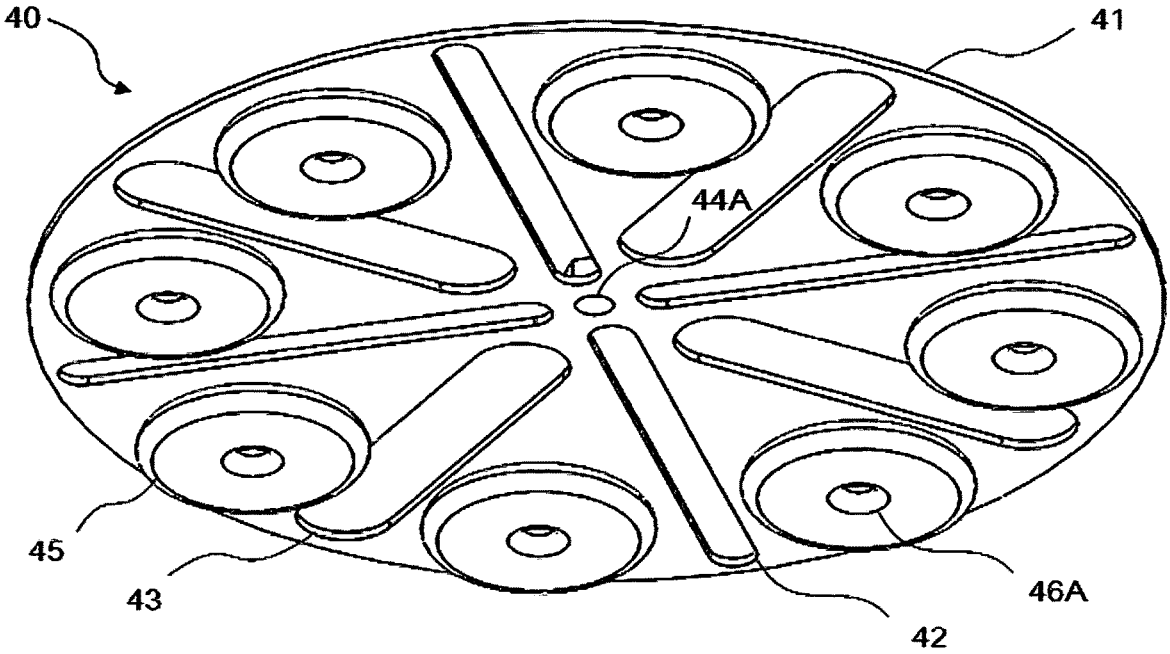
FIG. 4 illustrates, in isometric view from under, a trowel-to-polisher conversion disc with steel cloth pucks.
Figure 5:
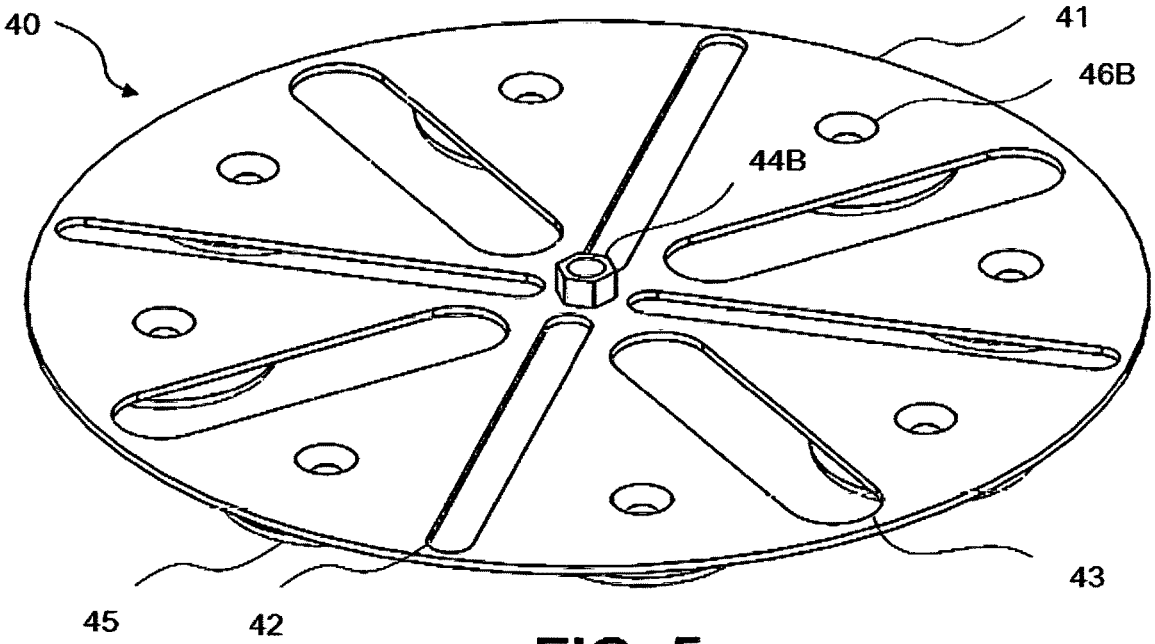
FIG. 5 illustrates the same as FIG. 4 viewed from above.

Attention is now turned to FIG. 4, which by assembly 40, in isometric view from under, trowel-to-polisher conversion disc 41 with four narrow slots 42, four wide slots 43, one hub attachment hole 44A and eight steel or rock cloth pucks 45, with eight slurry feed-hole 46A. FIG. 5 illustrates similarly, assembly 40 from above; with additional hub key 44B and slurry feed holes 48B. Pucks 45 are compacted steel wool of stainless fibers, which holds grinding grits, powder, and slurry dipped or sprayed into the corresponding powder or liquid. It may be attached to disk 41 by socket bolting or snap hardware, but most preferably by metallic hook-and-loop rapid attachment, in which the stainless hooks are stud welded onto disk 41, while the random and continuous filaments of puck 45 are the loop component. For wet polishing, chamfered holes 45 may feed the slurry or chemical water in a manner illustrated further on. Pucks 45 are consumable and may be attached fixed or swivel or freely rotating or one-way rotating ratcheted. Slots 42 and 43 add out-of-plane disc flexibility, to ensure long puck life. Holes 46A in pucks 45 is not required, since slurry may flow into the steel or rock wool without it. Nonetheless, it is preferable, for greatly facilitating ultra-fine polishing. Each second of holes 46A may be slurry feed holes, while each second other one, which are staggered, slurry suction holes for water feed to keep slurry build up on aggressive tools. It is also preferable that pucks 45 could rotate in planetary motion relative to hole 44A. Each second such planetary puck may rotate in an opposite direction. Puck 45 may also swivel or rotate freely or be one-way ratcheted. The use of assembly 40 is illustrated next.

Figure 6:
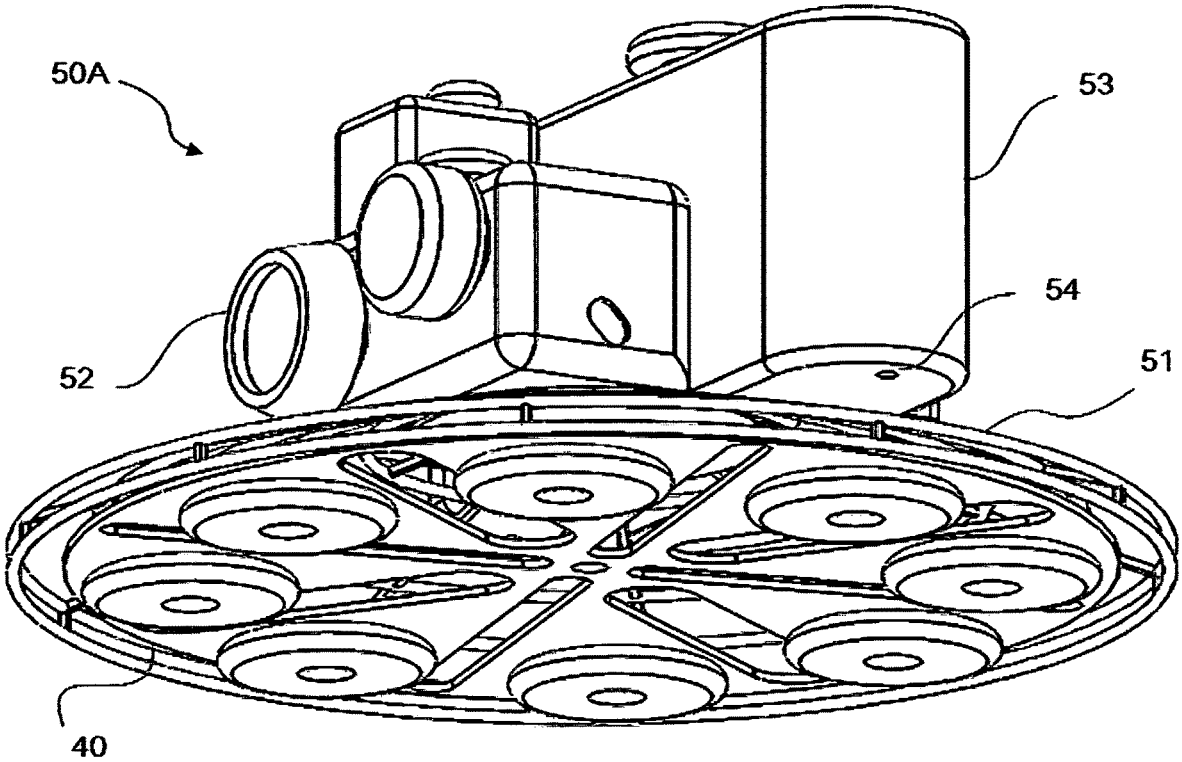
FIG. 6 illustrates, in isometric view, viewed from under, its application in a conversion machine, without slurry catcher skirt.
Figure 7:
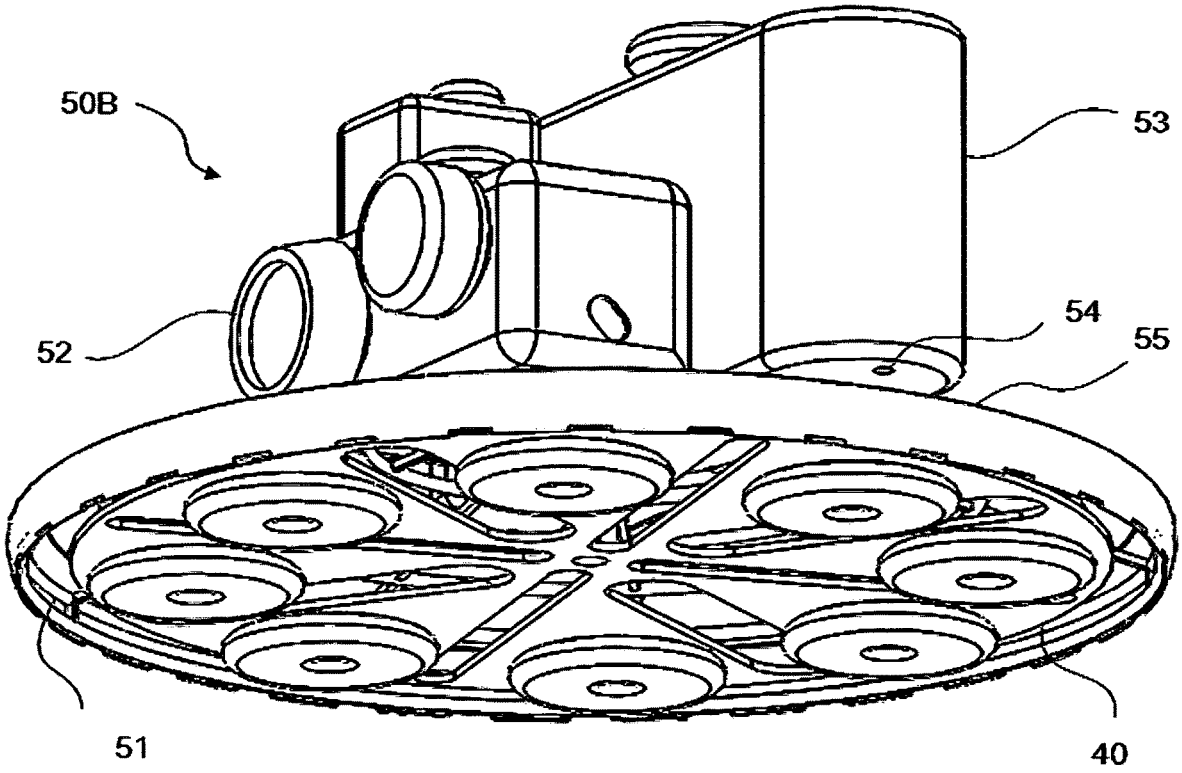
FIG. 7 illustrates the same as FIG. 6 with such skirt, viewed from under.
Figure 8:
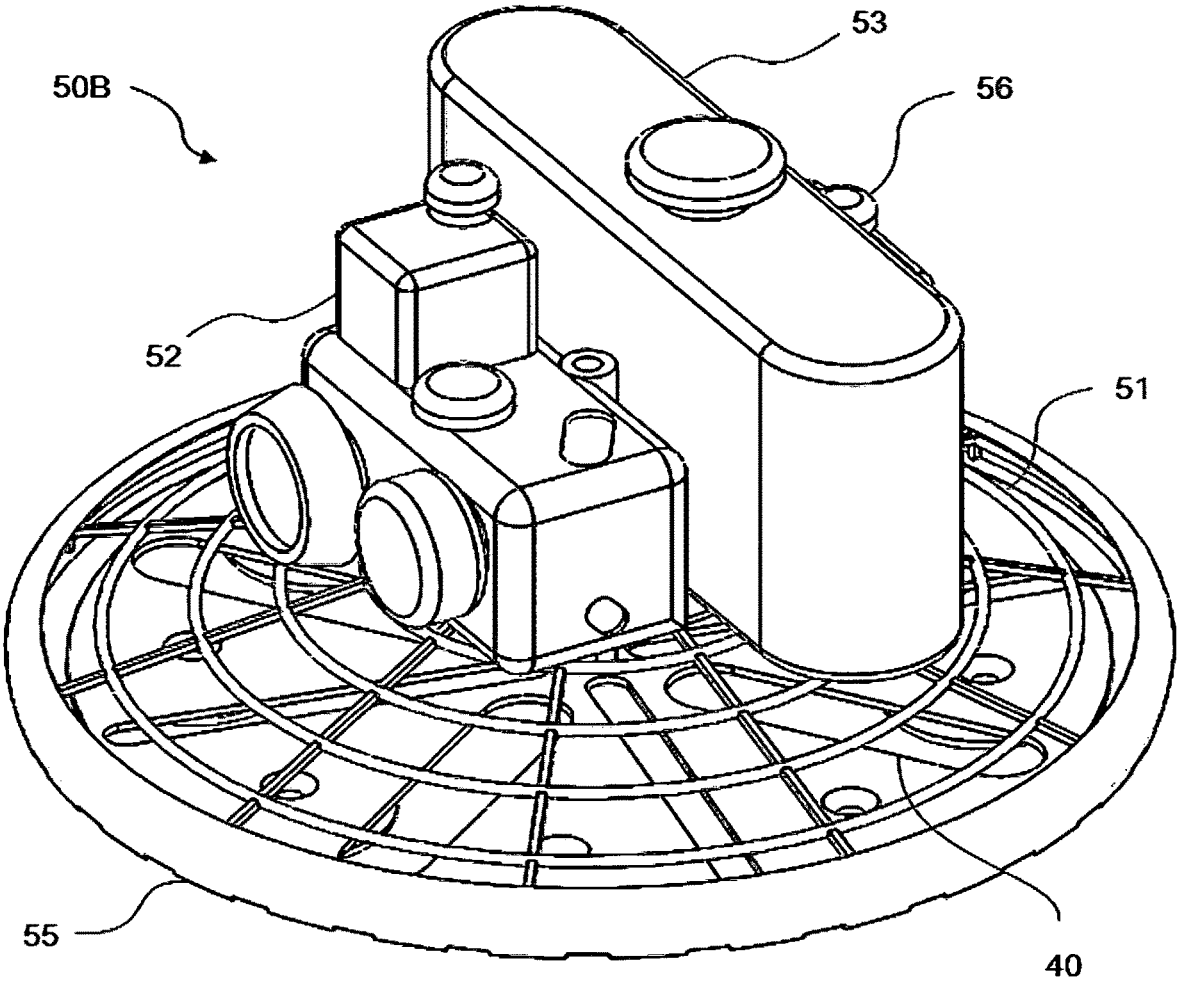
FIG. 8 illustrates the same as FIG. 7, viewed from above.

Attention is now turned to FIG. 6, which by assembly 50A, illustrates, in isometric view from under, assembly 40 attached to the hub of a power trowel to the polisher conversion machine, having engine 52, onboard water tank 53, with slurry nozzles 54 and blade catcher safety cage 51. To retain slurry, skirt 55 is added, as illustrated in FIG. 7, by assembly 50B. Notice that nozzle 54 passes right above holes 46B. To further clarify this preferred embodiment, assembly 50B is also shown from above in FIG. 8, where chemical tank 56, also built into the frame, became visible. Skirt 55 may hang-on by gravity and slide on frame 51 to rotate around, should the machine accidentally bump into obstacles, such as walls or columns. Over large enough machines as shown in FIGS. 6-8, the polishing worker may sit in a seat (not shown).

Figure 9:
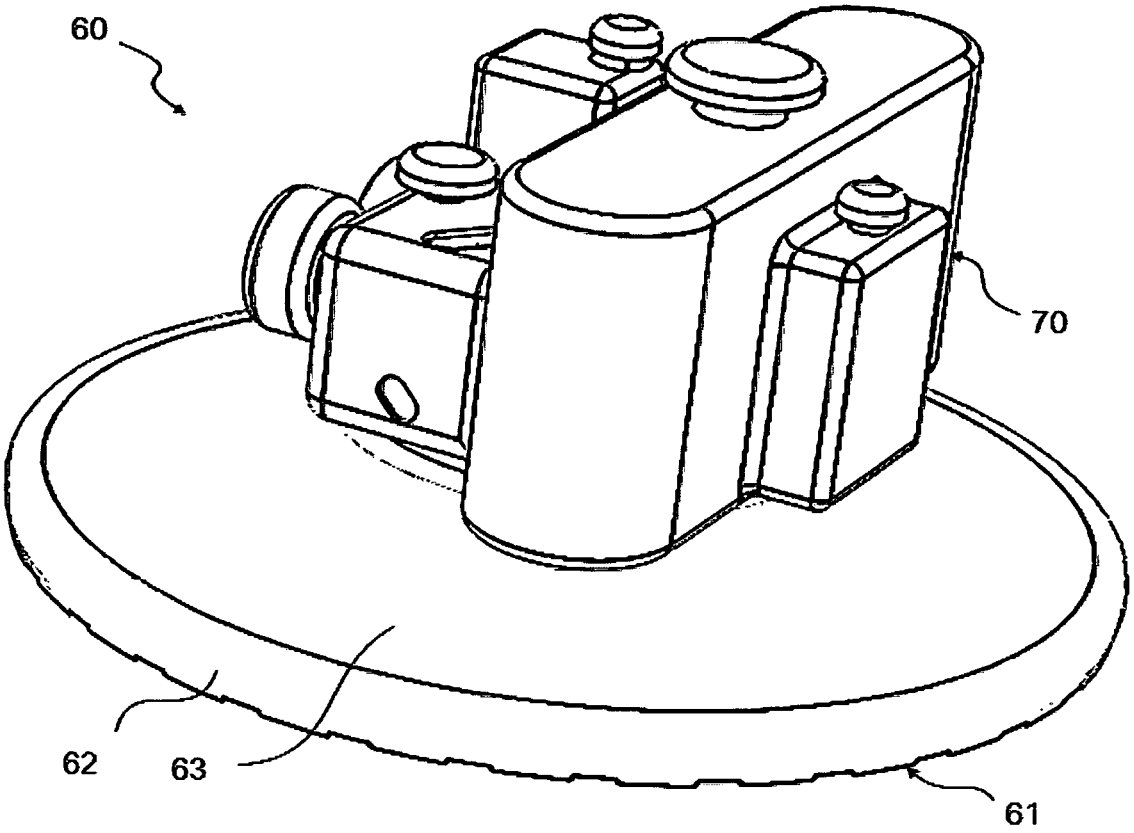
FIG. 9 illustrates the same as FIG. 8, viewed from above, with skirt integrated with splash dome.

Attention is now turned to FIG. 9, which by assembly 60, illustrates in perspective top view another preferred embodiment of the invention, trowel-polisher 60, machinery 70, and slurry retainer 61, consisting of two integrate parts, skirt 62 and splash cover 63 (also called top splash guard).

Figure 10:
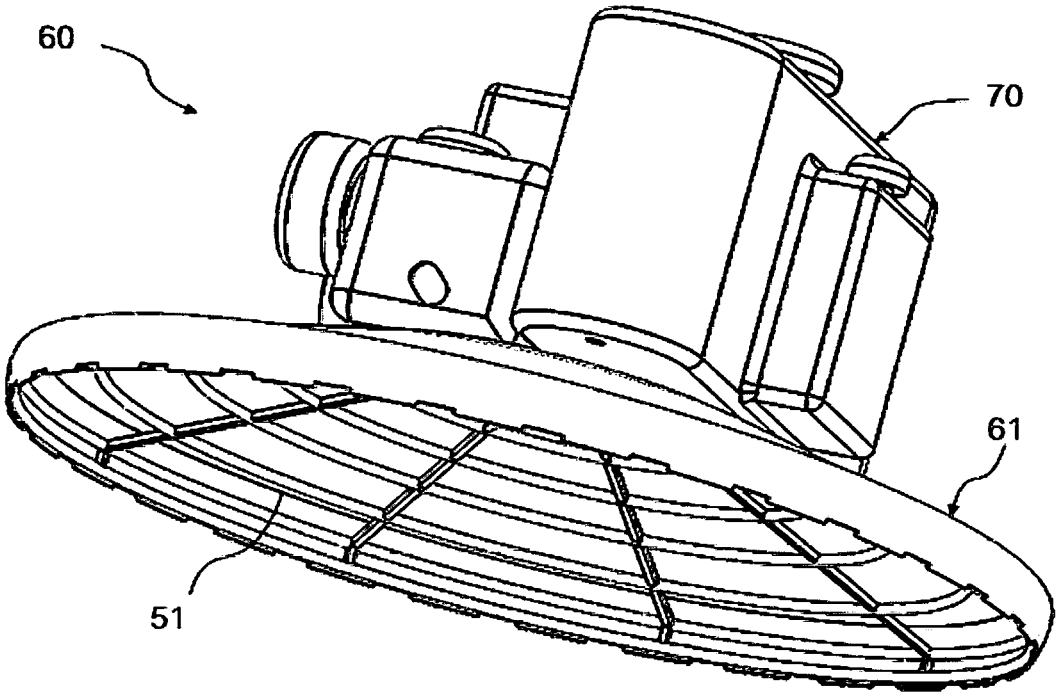
FIG. 10 illustrates the same as FIG. 9, viewed from under, with safety cage.
Figure 11:
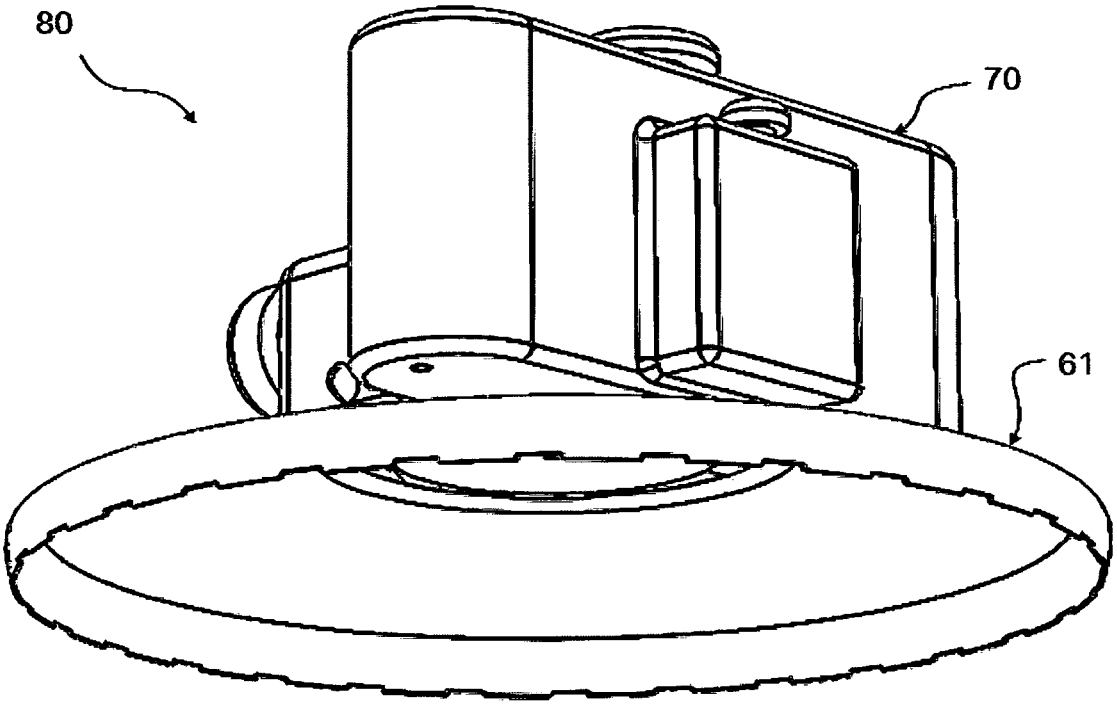
FIG. 11 illustrates the same as FIG. 10, without cage.

FIG. 10 illustrates the same as FIG. 9 from a lower (under) perspective, which allows a view of the safety cage 51. Since retainer 61 can be made metallic, it can also serve as safety "cage". That is illustrated in FIG. 11 by trowel-polisher machine 80.

Figure 12:
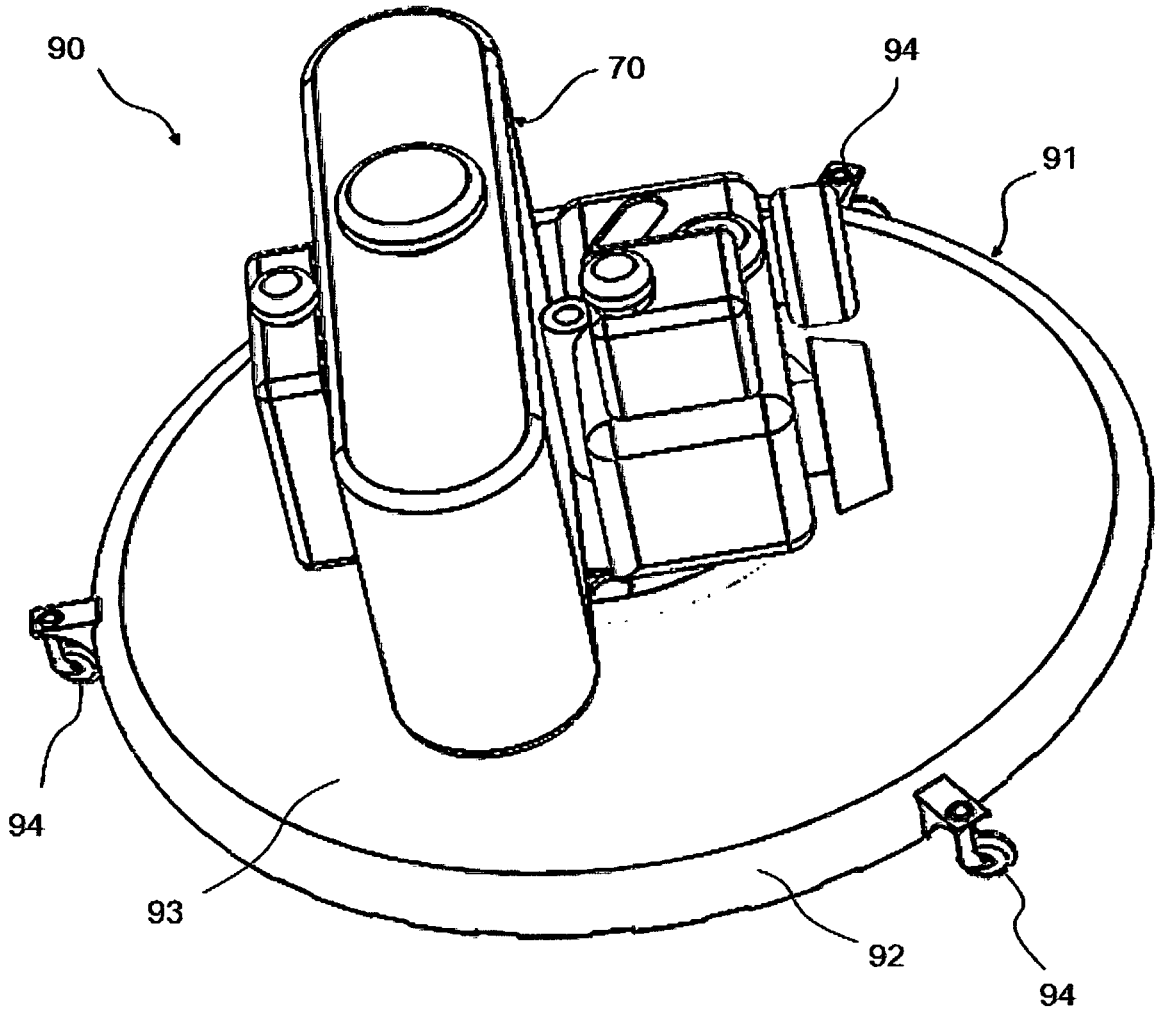
FIG. 12 illustrates the same as FIG. 11, with caster legs.

Attention is now turned to FIG. 12, which illustrates machine 90, which is the same as machine 80, however with added removable caster legs 94. Slurry retainer 91 here is made of spun metal. Retainer 91 has skirt 92 and cover 93. Cover 93 may have a see-through window (not shown) for monitoring slurry movement while polishing, which may be removed to fit in smaller doorways. Machine 90 may incorporate 94, which may be turned up, when not in use. Alternatively, it may be mechanically retracted by electromechanical ball screw or hydraulic or pneumatic cylinders (not shown). Skirt 55, 55, 61, 62 or 92 may be hang-on or lift-off type and may slowly spin around, powered or unpowered, and may have a squeegee or brush under edge (not shown).

Figure 13:
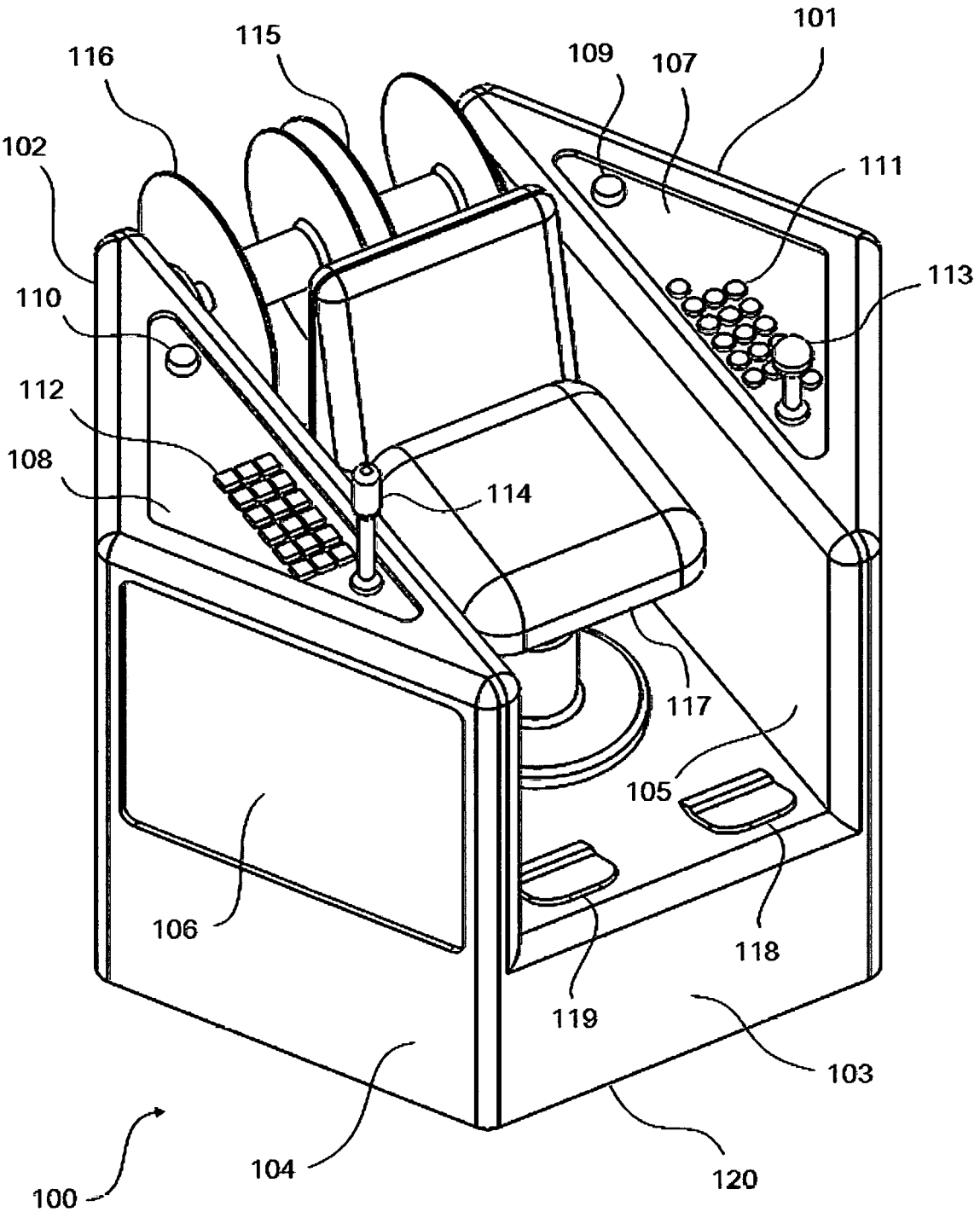
FIG. 13 illustrates another preferred embodiment, a teetered water-and-power supplied sit-on universal trowel-polisher machine, looking from above in isometric view.

Attention is now turned to FIG. 13, which illustrates another preferred embodiment of the invention, a teetered water-and-power supplied, sit-on, universal trowel-polisher machine 100, looking from above in isometric view.

Machine 100, has a framed hollow-inside sheet metal body 101 to house selectable trowel or polisher module inserts (shown further on separate), electronic and electrical controls, motors, sensors, drivers or actuators, battery and other incidental apparatuses, common in robotics.

Body 101 has corner frame 102, front panel 103, outside panels 104, inside panels 105, removable panels 106, left control panel 107, right control panel 108, water hose reel control 109, power cord reel control 110, motor controls 111, sensor-actuator controls 112, glide control arm 113, motion control arm 114, water hose reel 115, power cord reel 116, adjustable driver seat 117, left brake pedal 118 and right speed pedal 119.

Machine 100 may be controlled remotely as a robot or may be controlled by a driver sitting on it. The robotic control may be assisted by GPS, laser, LIDAR, sonar or ultrasonic beam or pulse guiding or preprogrammed guiding (auto scrubber buffer). The left and right compartments may house electric motors, battery, sensors and actuators. It may also house a petrol or diesel engine with power generator. When the power is generated onboard, reel 116 may be dedicated to slurry line or steam. Anything above the pedals level may be omitted when machine 100 is a battery operated robot with remote control. The reels however may be retained, in which case, the battery is unnecessary. Body 101 incorporates a shroud, but is not shown for clarity herewith. It may incorporate various trowel or polisher modules. That will be illustrated further on. Alternative to tethered electrical cord powering, rechargeable onboard battery may power machine 100, configured either as trowel or as grinder/polisher or combined. When machine 100 is configured to be autonomous, body 101 also incorporates liquid vessels for water and chemicals.

Figure 14:
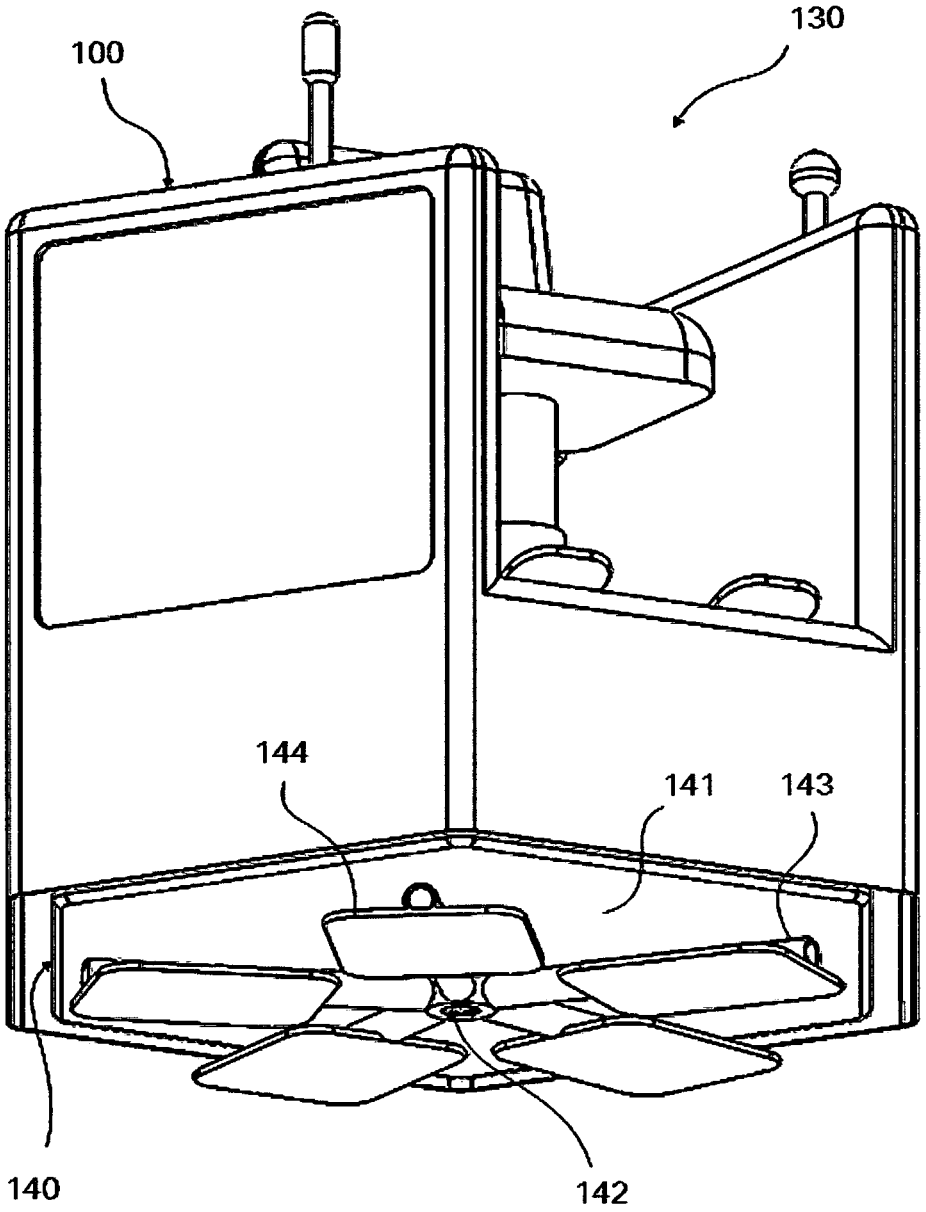
FIG. 14 is the same, looking from under in isometric view, with a power trowel module insert.

Attention is now turned to FIG. 14, which by assembly 130, illustrates machine 100, looking from under in isometric view, with power trowel module insert 140.

Figure 15:
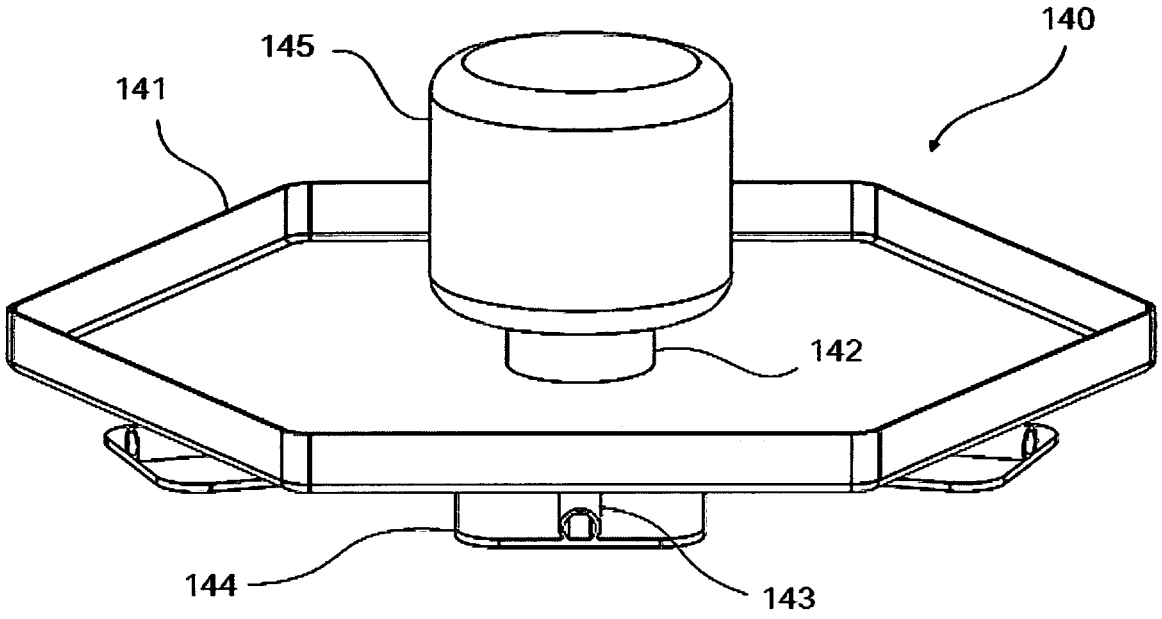
FIG. 15 illustrates that power trowel module in isometric view, looking from above.

Modular insert 140 comprises base socket 141, hub 142, arms 143 and blades 144. The space between socket 141 and machine 100, may contain the shroud and the sprinkler or mist heads. 3, 4, 5, or 6 or other number of arms and blades are proposed herewith. FIG. 15 illustrates insert 140 with drive motor 145. Likewise components labeled likewise. Socket 141 may be held by snap-in socketed balls (not shown) or by other means (for instance bolts) to body 101. Assembly 130 advances by hydroplaning action controlled gliding. The head drive may be powered using chain, belt, direct gear (spur or planetary, hydraulic, or electric drive.

Figure 16:
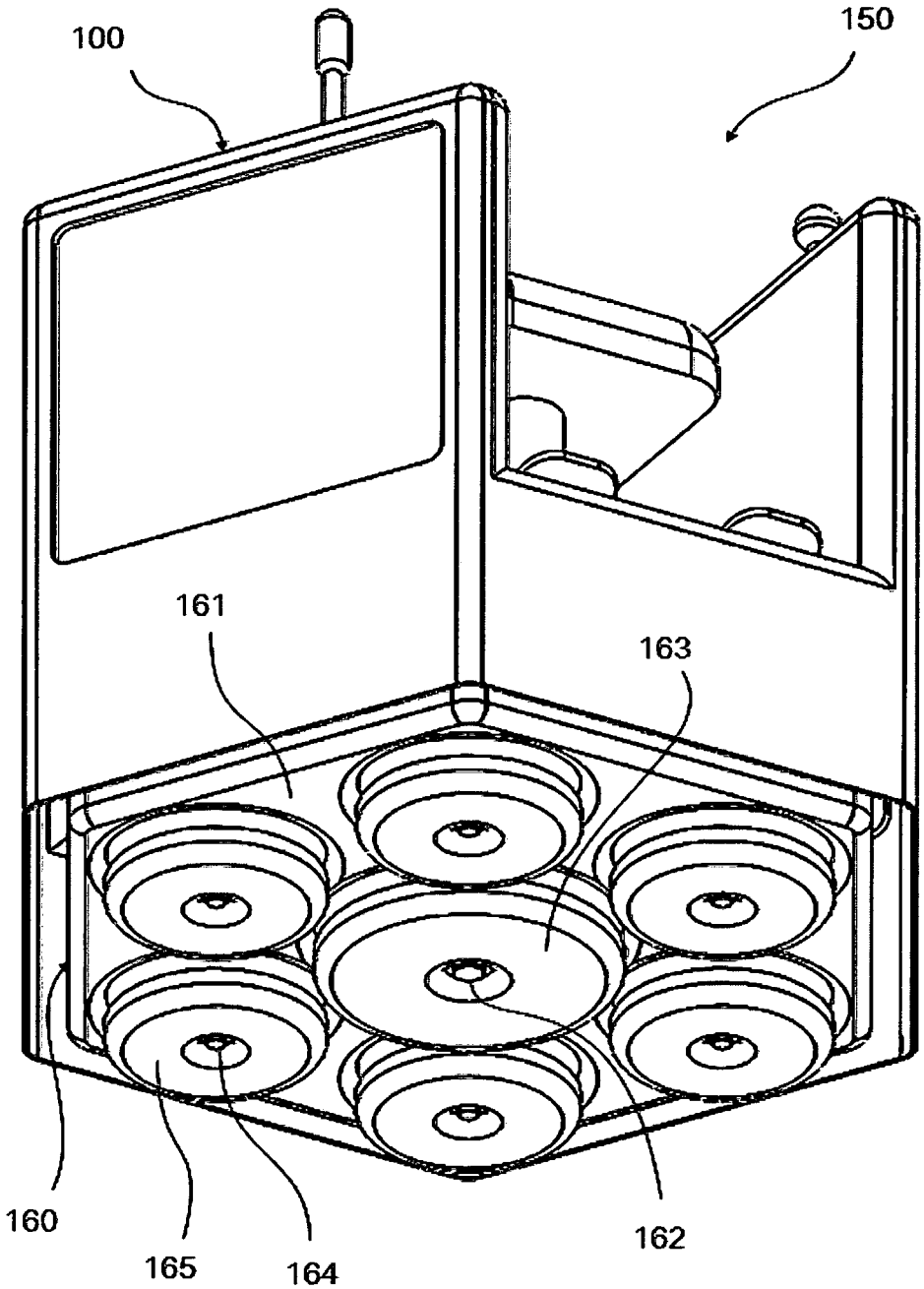
FIG. 16 is the same as FIG. 14, but with a planetary polisher module insert.

Attention is now turned to FIG. 16, which by assembly 150, illustrates machine 100, looking from under in isometric view, with planetary polisher module insert 160.

Figure 17:
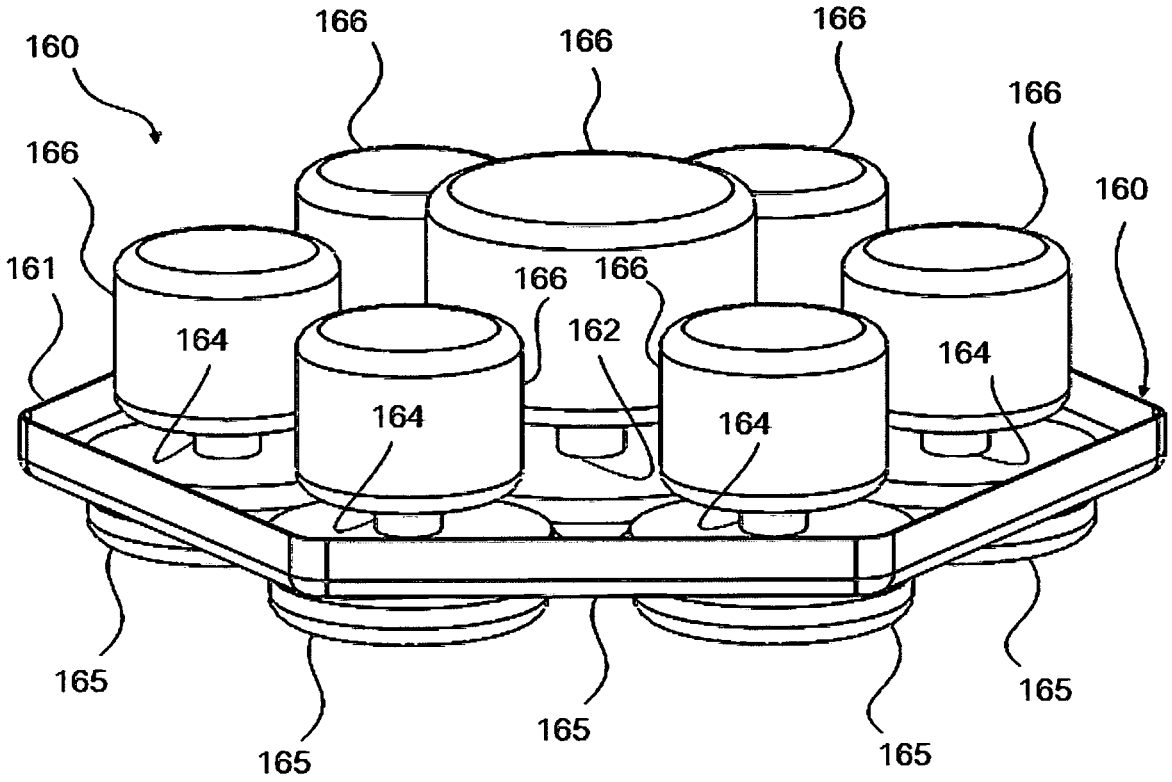
FIG. 17 illustrates that polisher module in FIG. 16, in isometric view, looking from above.

Modular insert 160 comprises base socket 141, central hub 162, central polisher disk 163, planetary hubs 164 and planetary polisher disks 163. Three (3), four (4), six (6), or other number of disks are proposed herewith with marker or label identification of grit size on the edge. FIG. 17 illustrates insert 160 with drive motors 166. Identical components labeled identically. Assembly 150 advances by hydroplaning action controlled gliding. Heads 165 may or may not rotate in the same direction. Motors 166 are independently controllable. Said gliding may be assisted by counter rotating sets of polisher heads 165. For instance, by rotating the left side disks clockwise and the right side ones counterclockwise. Slowing down one side and speeding up the opposite side, would turn the glide. The group of motors may be replaced with one central motor and gears or belts. The larger central disk 163, by a push of a button on panel 111, may be retractable to be raised above the floor by 0.5-1.5" to better control polishing quality. Said retraction may be achieved by an electromagnet and said lift-off pad may be spinning on a shaft with axial grooves (ribbed shaft).

Figure 18:
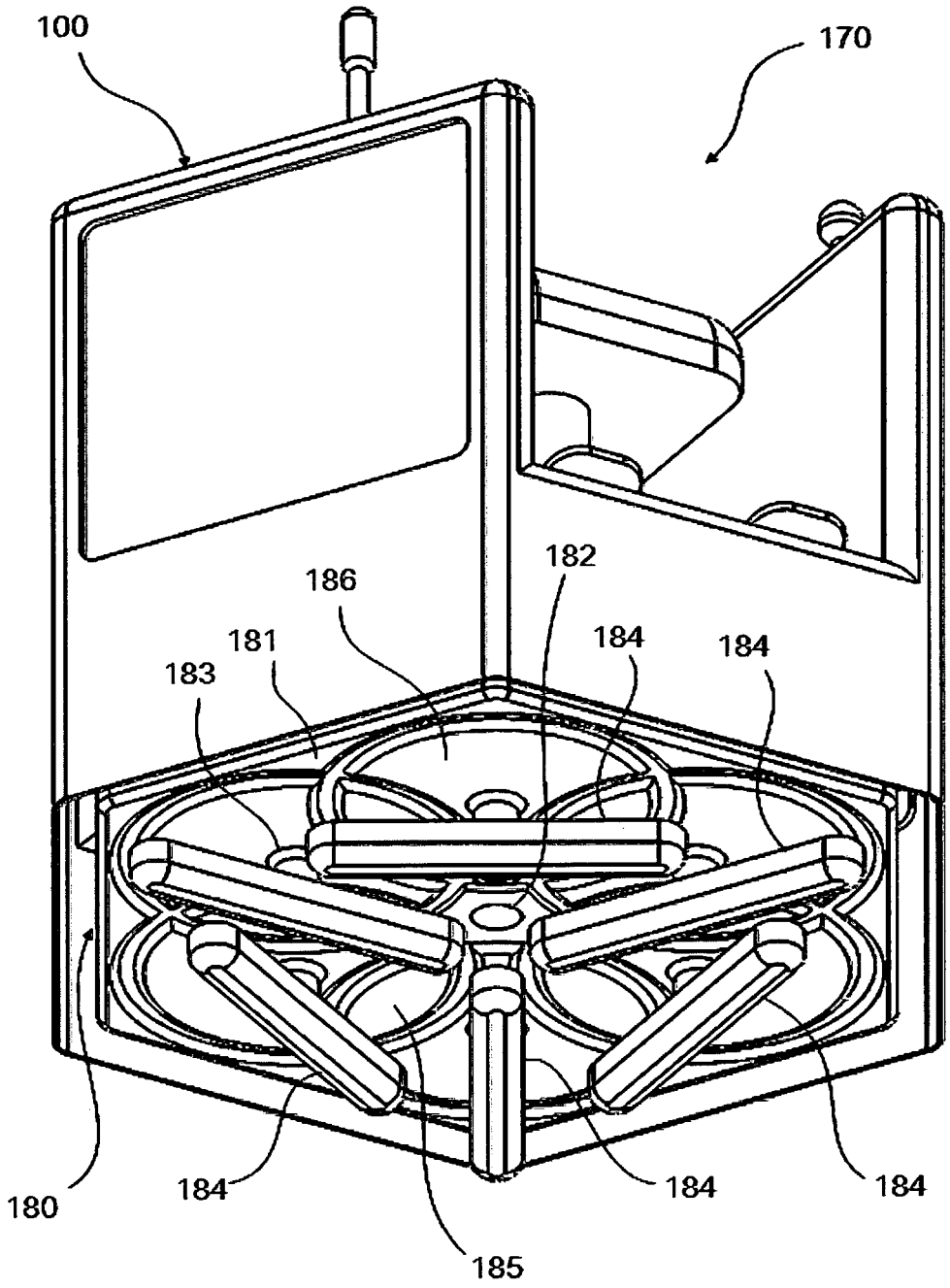
FIG. 18 is the same as FIG. 14, but with another planetary polisher module insert, which polishes with overlapping blades.

Attention is now turned to FIG. 18, which by assembly 170, illustrates machine 100, looking from under in isometric view, with intermeshing-blade planetary polisher module insert 180.

Figure 19:
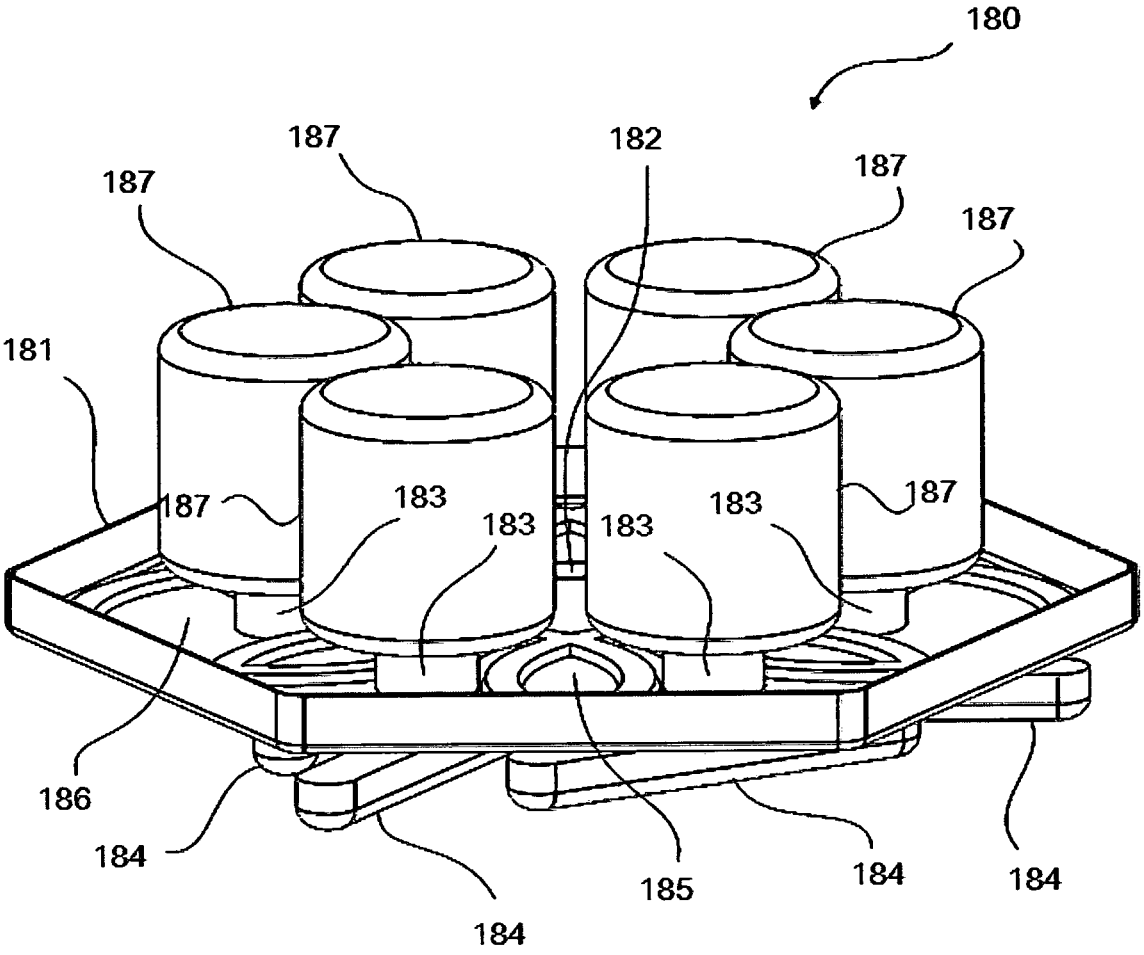
FIG. 19 illustrates that polisher module in FIG. 18, in isometric view, looking from above.

Modular insert 180 comprises base socket 181, central hub 182, planetary hubs 183 and planetary polisher blades 184. Three (3), four (4), six (6), or other number of blades are proposed herewith. FIG. 19 illustrates insert 180 with drive motors 187. Identical components labeled identically. Assembly 180 advances by hydroplaning action controlled gliding. Blades 184 may or may not rotate in the same direction. Motors 187 are independently controllable. Said gliding may be assisted by counter rotating sets of polisher blades 184. For instance, by rotating the left side disks clockwise and the right side ones counterclockwise. Slowing down one side and speeding up the opposite side, would turn the glide. Blades 184 rotate in direction and phase to avoid blade collision and polish in overlapping area 185 and non-overlapping area 186. Socket 181 or hub 182 may incorporate means of slurry suction or vacuuming. The sucked up slurry may be processed and recycled in part within machine or by an external machine 170.

To those skilled in the art, it shall be obvious that machine 100 may not necessarily take the illustrated hexagonal base prismatic shape. Triangular, square, round and other shapes are equally suitable. Also, that some combination of the prosed polishing heads are viable and may be advantageous. Finally, that body 101 is so light that two or a few individuals can easily lift it off from any of the presented modular inserts.

Figure 20:
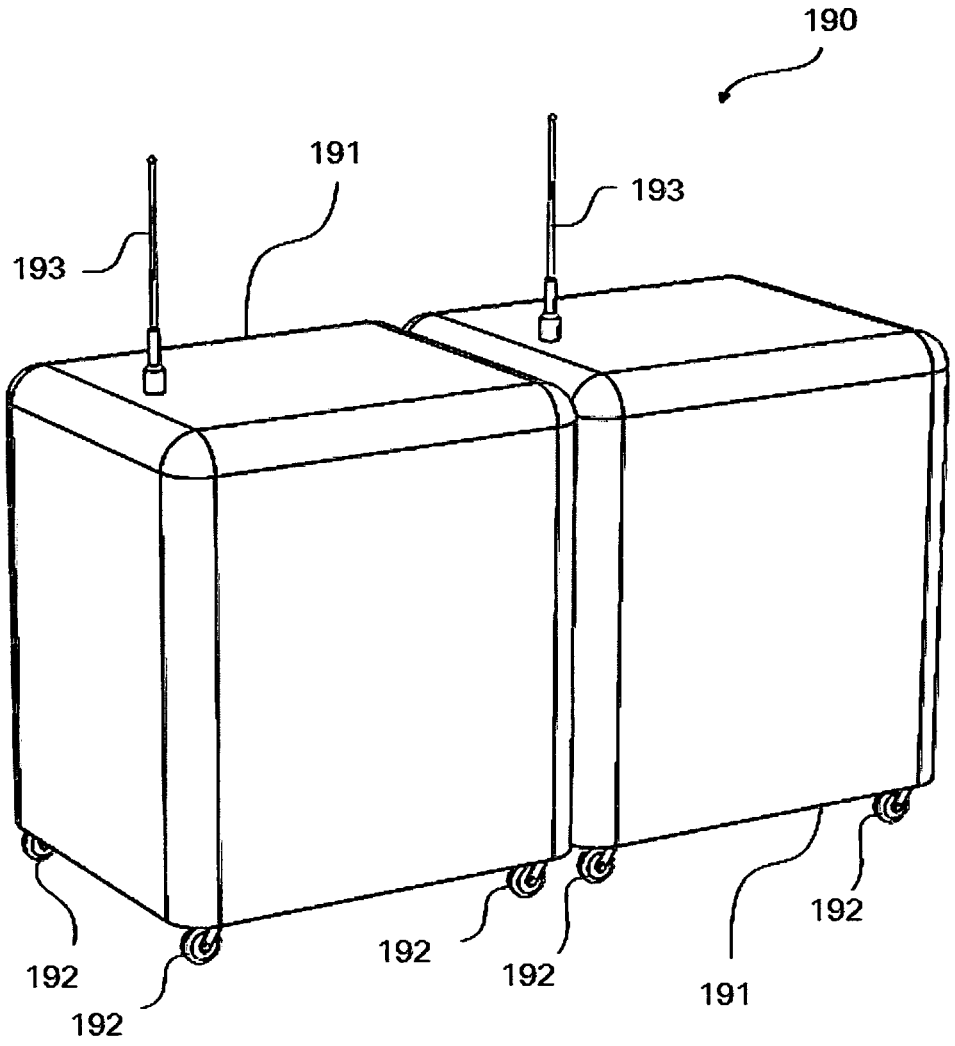
FIG. 20 illustrates coupled autonomous polisher modules in a perspective view.

Attention is now turned to FIG. 20, which by assembly 190, illustrates coupled autonomous grinder-polisher modules 191 in a perspective view rolling on skateboard caster legs 192 and remote controlled via radio signals received by antenna 193.

Figure 29:
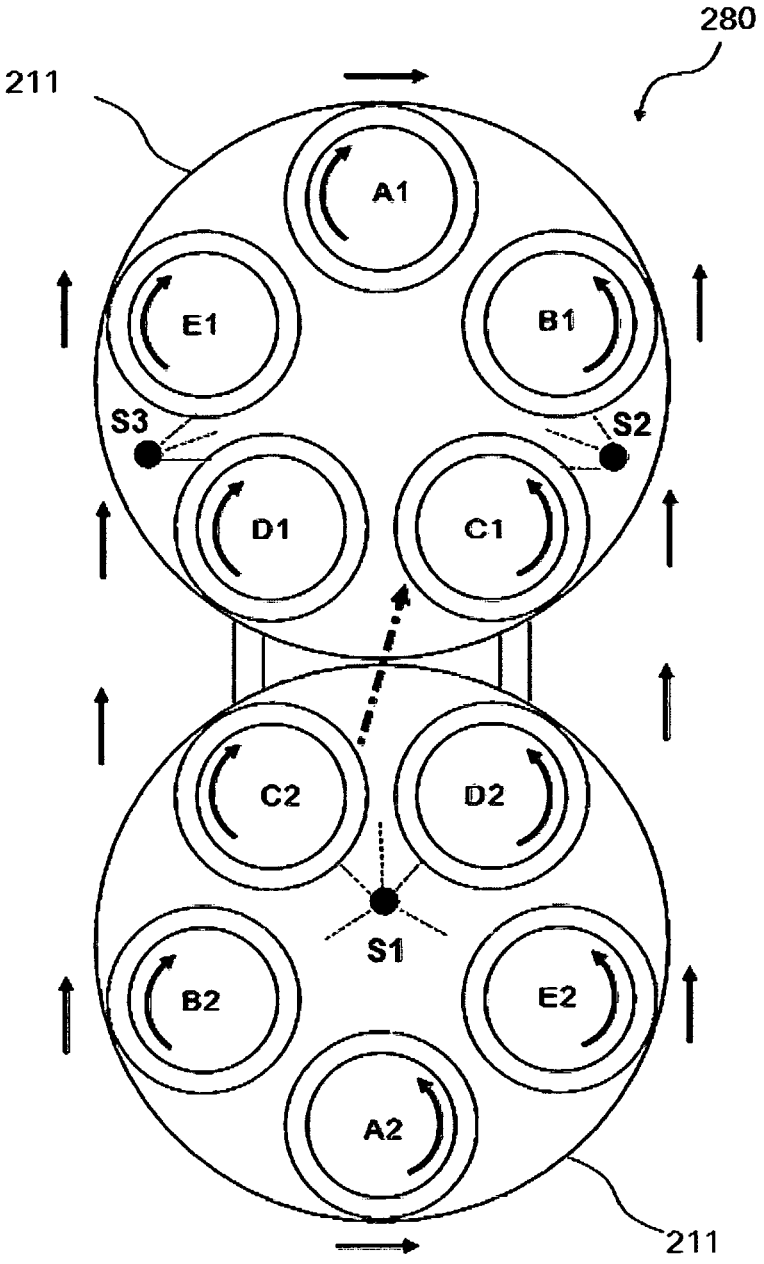
FIG. 29 is an upside-down plan view diagram of hydroplaning drive of coupled polishers illustrating driving kinetics in serial coupling mode.

Modules 191 are serviceable through doors on its sides and top (not shown for clarity) and contain power modules, electric with an onboard power source comprising a battery or power generator for powering polisher discs; for instance, 100 grit fine in the first and 200 grit fine in the second module. Casters 192 are retracted during grinding-polishing and the coupled modules move by hydroplaning, which is explained further on as illustrated in FIG. 29. The worker may command modules 191 via Wi-Fi using mobile electronics, such as a smartphone or a tablet.

Figure 21:
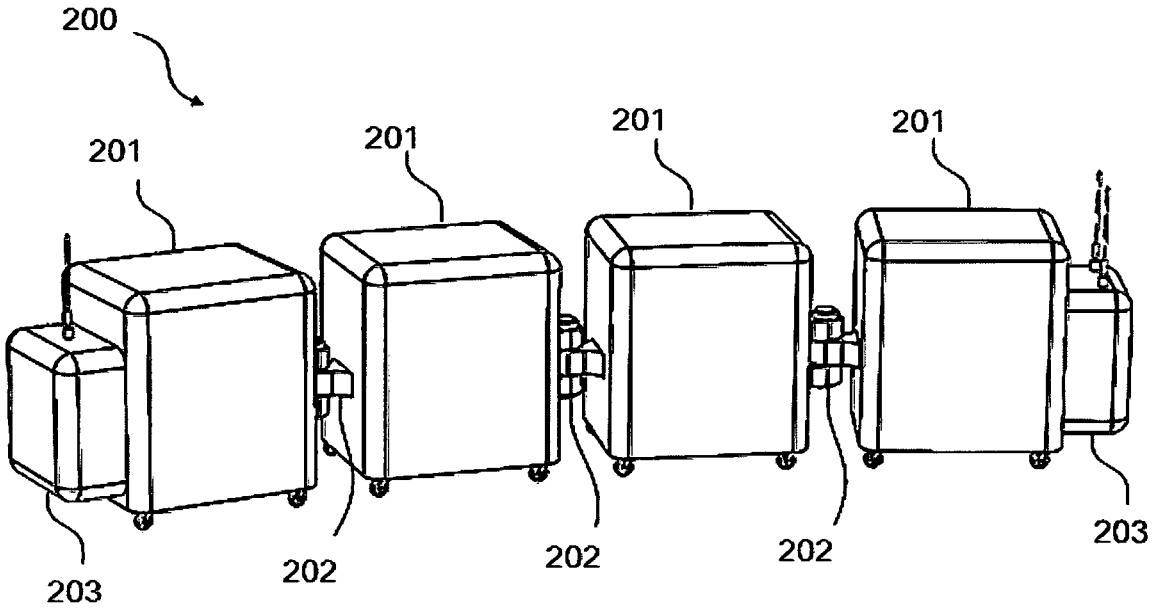
FIG. 21 illustrates in perspective view a polisher robot modules train in turning.

Attention is now turned to FIG. 21, which by assembly 200, illustrates in perspective view a grinder-polisher robot modules train while in turning.

Figure 30:
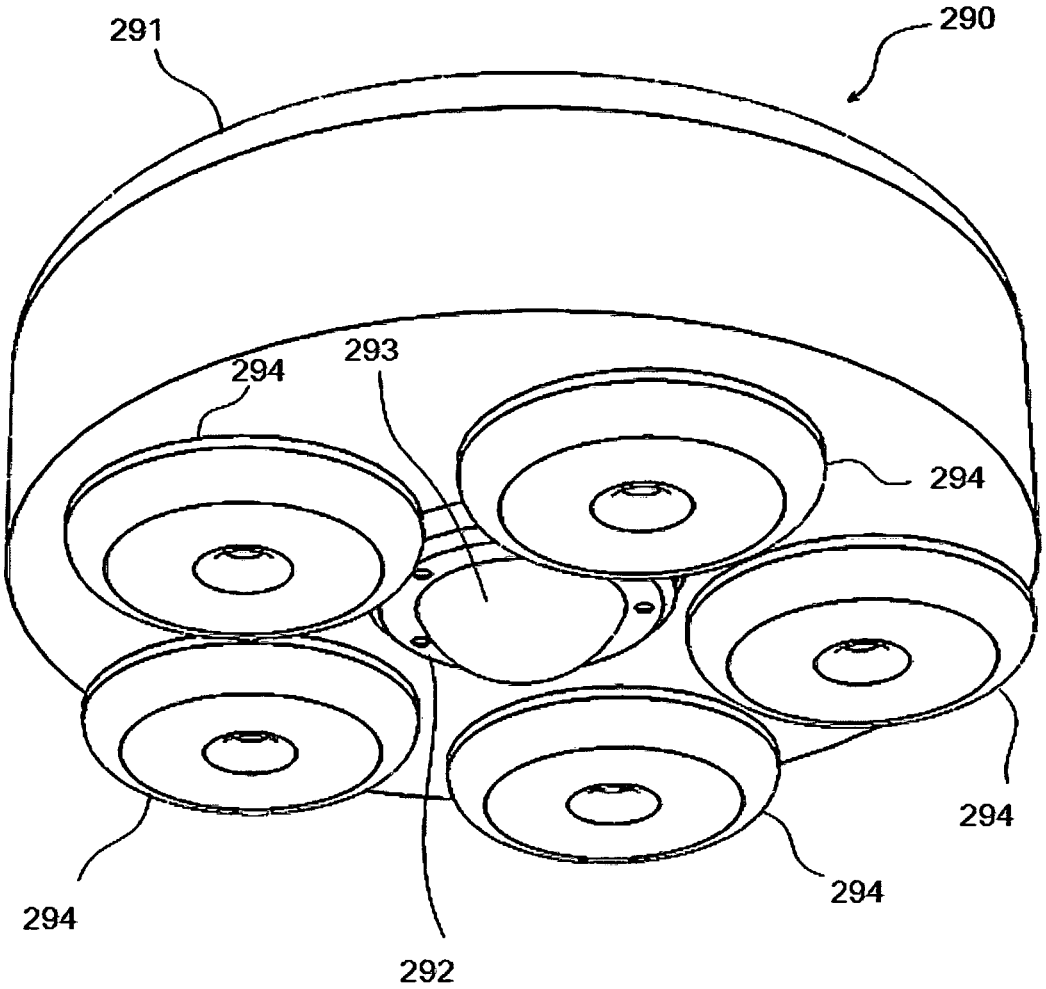
FIG. 30 is an isometric view of an exemplary robot polisher driven by magnetic ball drive.

Modules 201 are coupled via hinged joints 202. The first and the last module has control units 203 with antennas. The first of the train module 201 may have 100 grit discs, the second one 200 grit, the third one 400 grit. The last module 201 may have slurry suck up and/or squeegee wiper built-in. That can be in the last module, but one module and the last one could be a hardening finisher or waxing polisher. The first and second may have water and chemical tanks. The units may share water and chemicals via flexible pipes. The first module 201 may be driven by magnetic ball drive as that is illustrated in FIG. 30 further on. Other coupling, for instant hydraulic cylinder coupling, and train configurations. For instance, two in series and two in parallel may also be constructed as the job requires. One module 201, for instance the first one, may be rideable, like a locomotive. In any case, modular unit grouping is proposed with means of coupling in series and/or parallel. Parallel coupling will be illustrated further on, for instance in FIG. 24.

Figure 22:
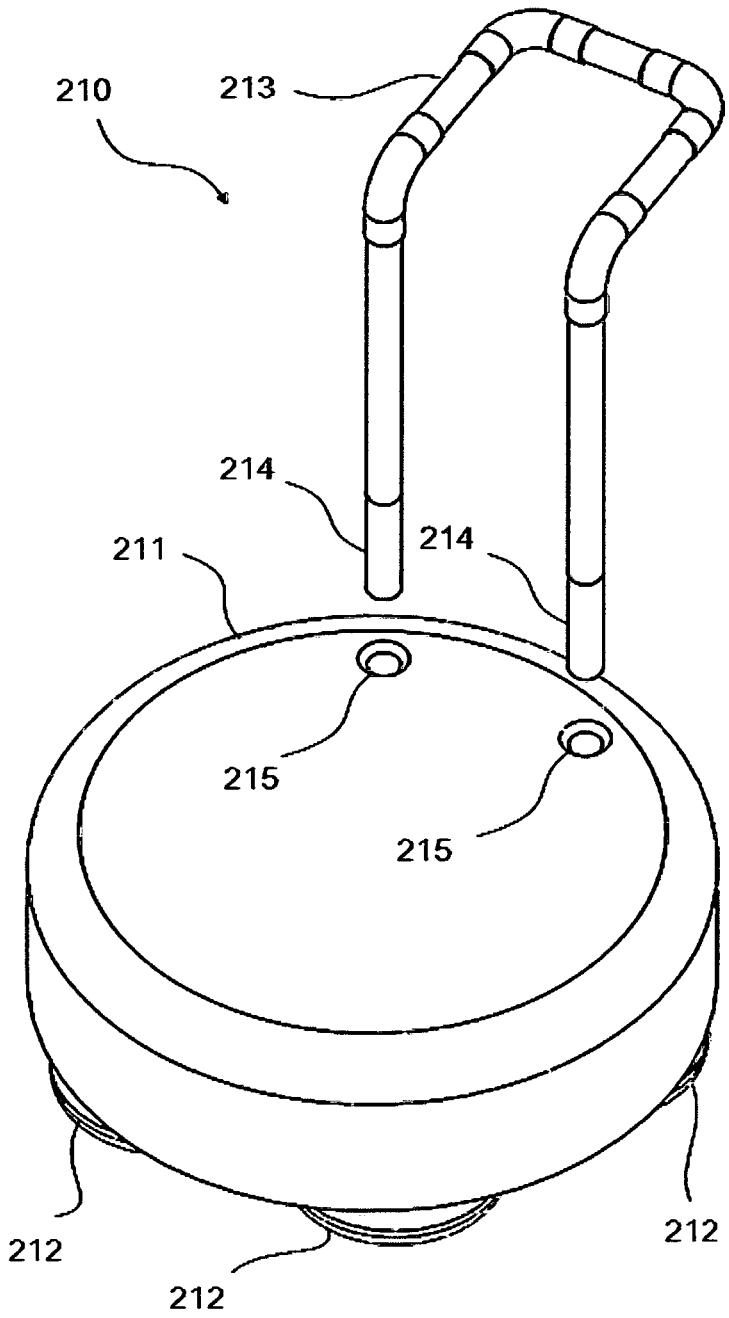
FIG. 22 illustrates in isometric view a grinder-polisher robot with handle assistance.

Attention is now turned to FIG. 22, which by assembly 210, illustrates in isometric view a grinder-polisher robot grinder-polisher robot with handle assistance, whereas handle 213 is disassembled from robot 211, which grinds or polishes with discs 212.

Sockets 215 receive mating portions 214 of handle 213. Robot 211 is manual or autonomous with guidance.

Figure 23:
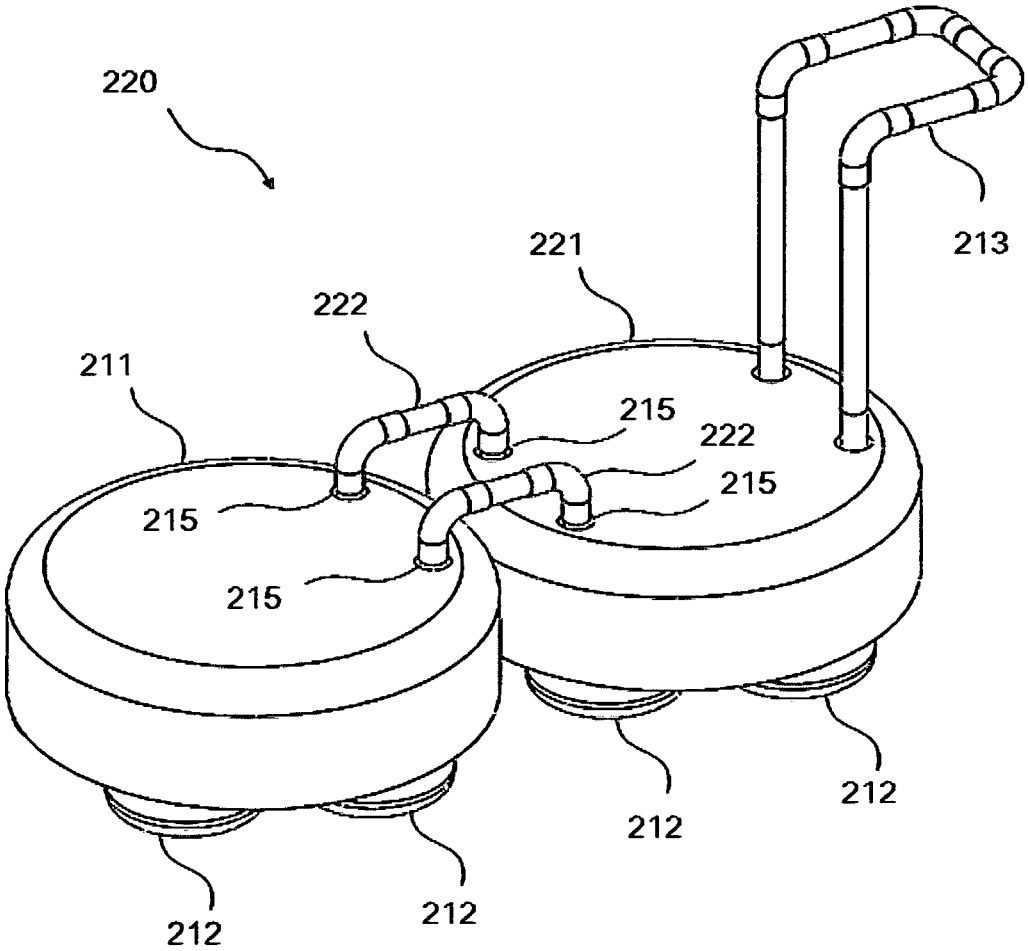
FIG. 23 illustrates in isometric view a coupled grinder-polisher robot with handle assistance in serial coupling.

Attention is now turned to FIG. 23, which by assembly 220, illustrates in isometric view a grinder-polisher robot grinder-polisher robot with handle assistance in serial coupling, whereas handle 213 is assembled into robot 221, which is coupled in series to robot 211, both which grinds or polishes with discs 212.

Figure 24:
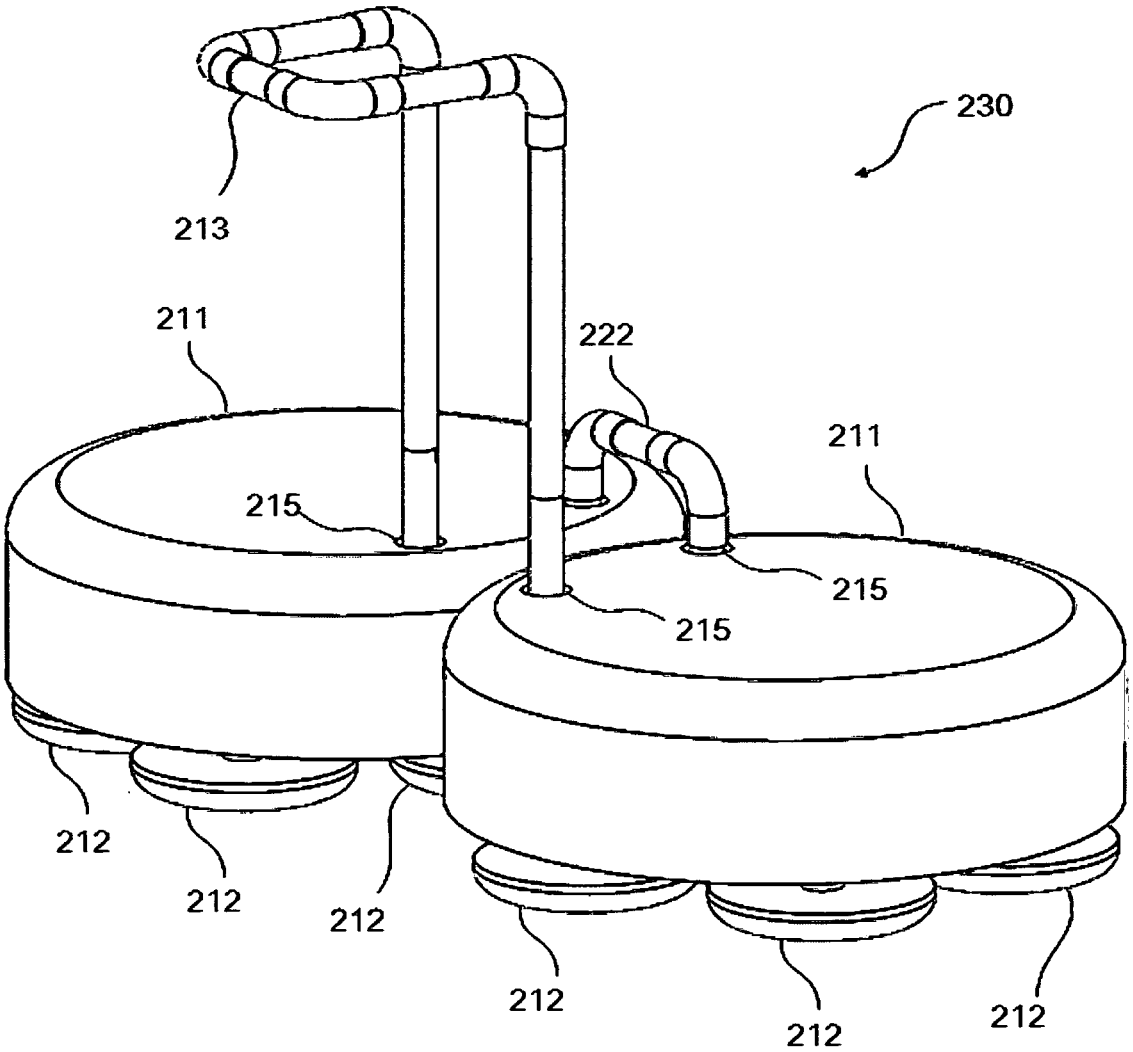
FIG. 24 illustrates in isometric view a coupled grinder-polisher robot with handle assistance in parallel coupling.
Figure 25:
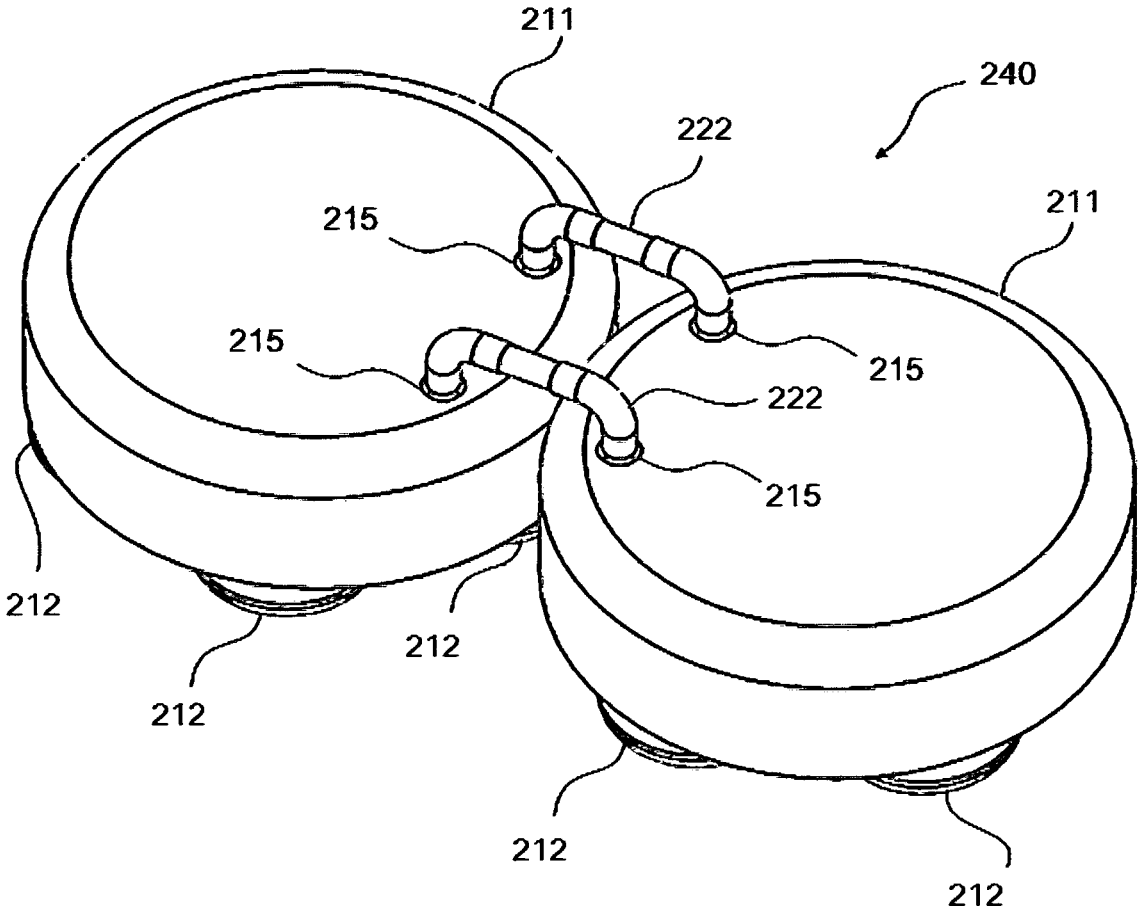
FIG. 25 illustrates in isometric view a coupled grinder-polisher robot without handle assistance in parallel coupling using bar couplers.

Robot 221 is identical to robot 211 but with two more sockets 215. Coupler bars 222 ensures semi-rigid robot module coupling. Robot 211 may grind with coarse grit and robot 221 may grind with fine grit. When used for polishing, module 211 may polish and 221 may wax. The two procedures follow each other, hence the serial coupling designation. FIG. 24 illustrates the same in parallel coupling by assembly 230. Without coupled modules, two workers would go side-by-side completing the same two jobs, since coarse grinding must be followed by fine grinding in consecutive passes as per state-of-the-art procedures. The same holds for polishing. FIG. 25, by assembly 240, illustrates the same but with handle 213 replaced with bar 222, leaving the coupling truly autonomous in both serial and parallel coupling.

While bars 222 are semi-rigid, rigid and flexible robot coupling is also needed. For instance, for rough surface finishing with coarse discs, flexible coupling is needed and low pressure on the discs. For fine finishing, rigid coupling with high pressure is more practical. Both cases are illustrated next.

Figure 26:
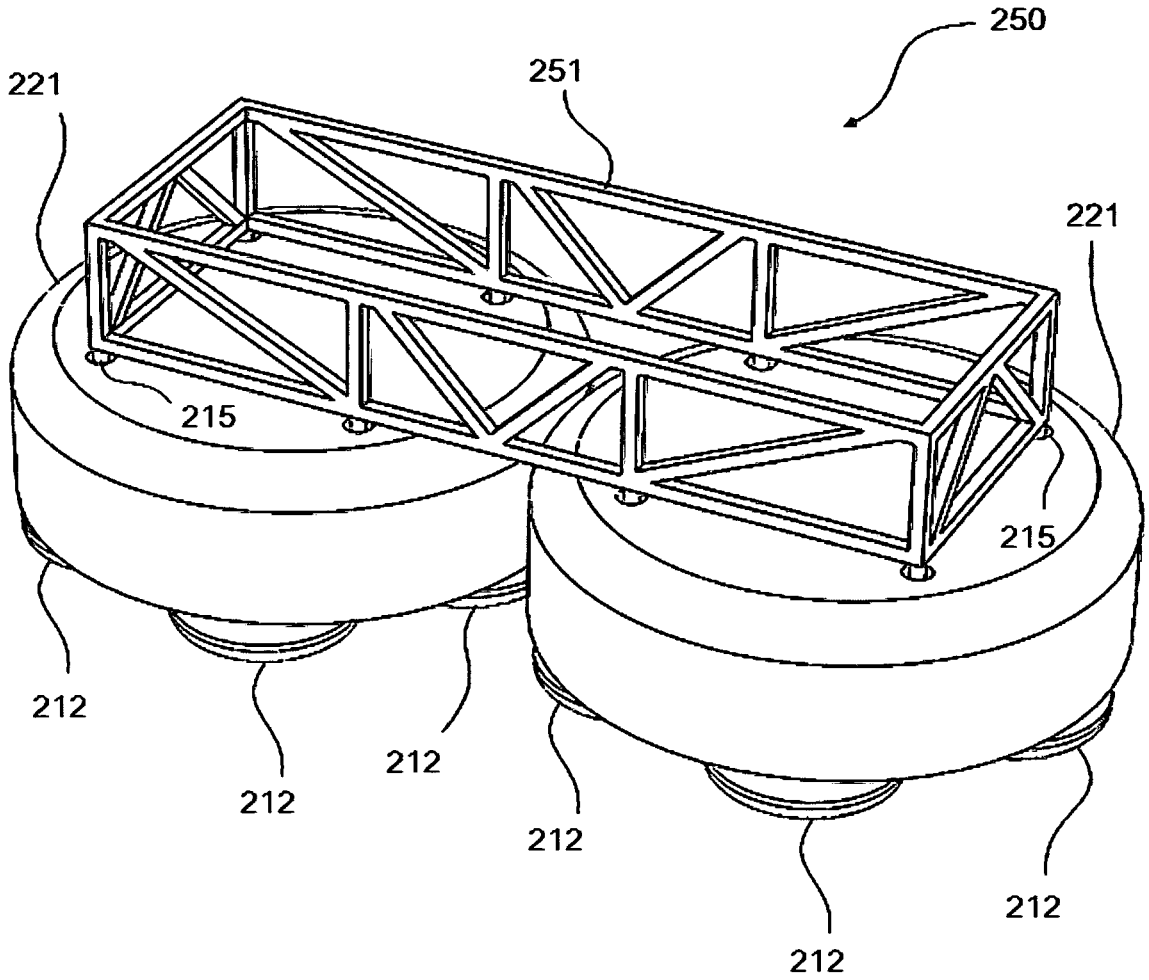
FIG. 26 illustrates in isometric view a coupled grinder-polisher robot without handle assistance in parallel coupling using rigid frame couplers.
Figure 27:
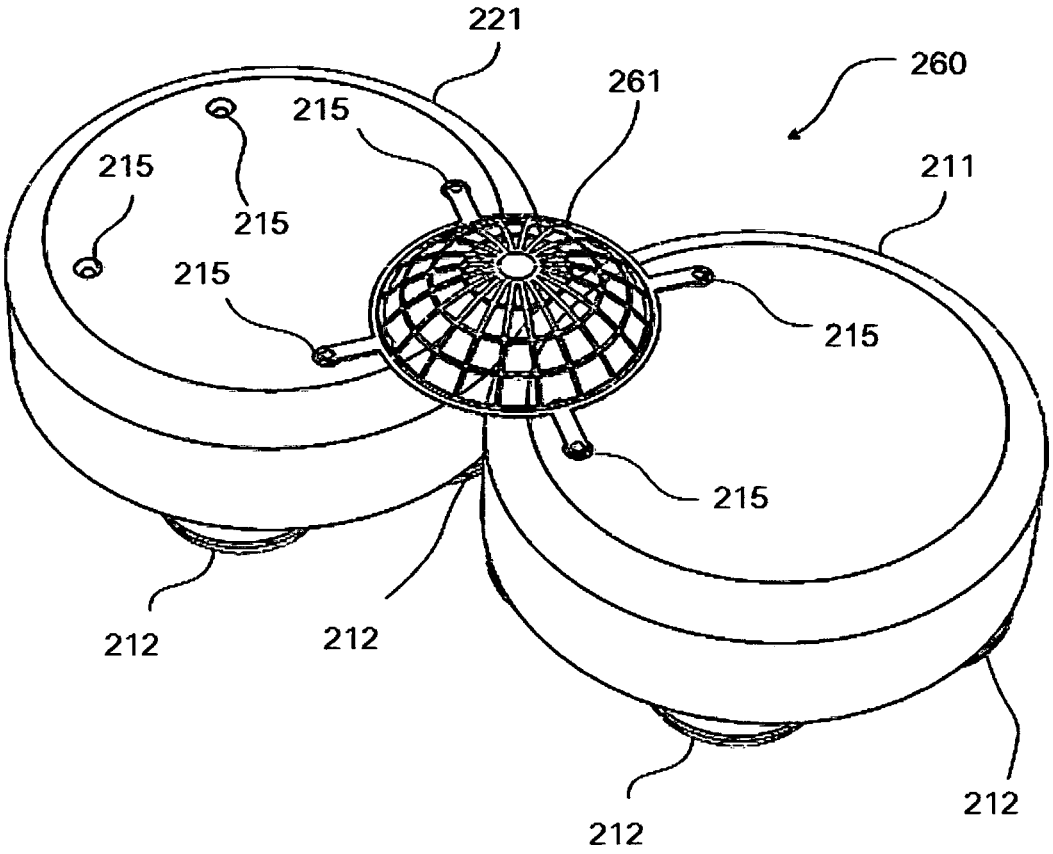
FIG. 27 illustrates in isometric view a coupled grinder-polisher robot without handle assistance in parallel coupling using flexible frame couplers.

In FIG. 26, by assembly 250, two robots 221 are shown coupled by rigid frame 251, while in FIG. 27, by assembly 260, robots 211 and 221 are coupled with flexible coupler cage 261.

Coupled rigid or flexible, robots as per FIGS. 26 and 27, can be considered and operated both as serial or parallel coupled.

Figure 28:
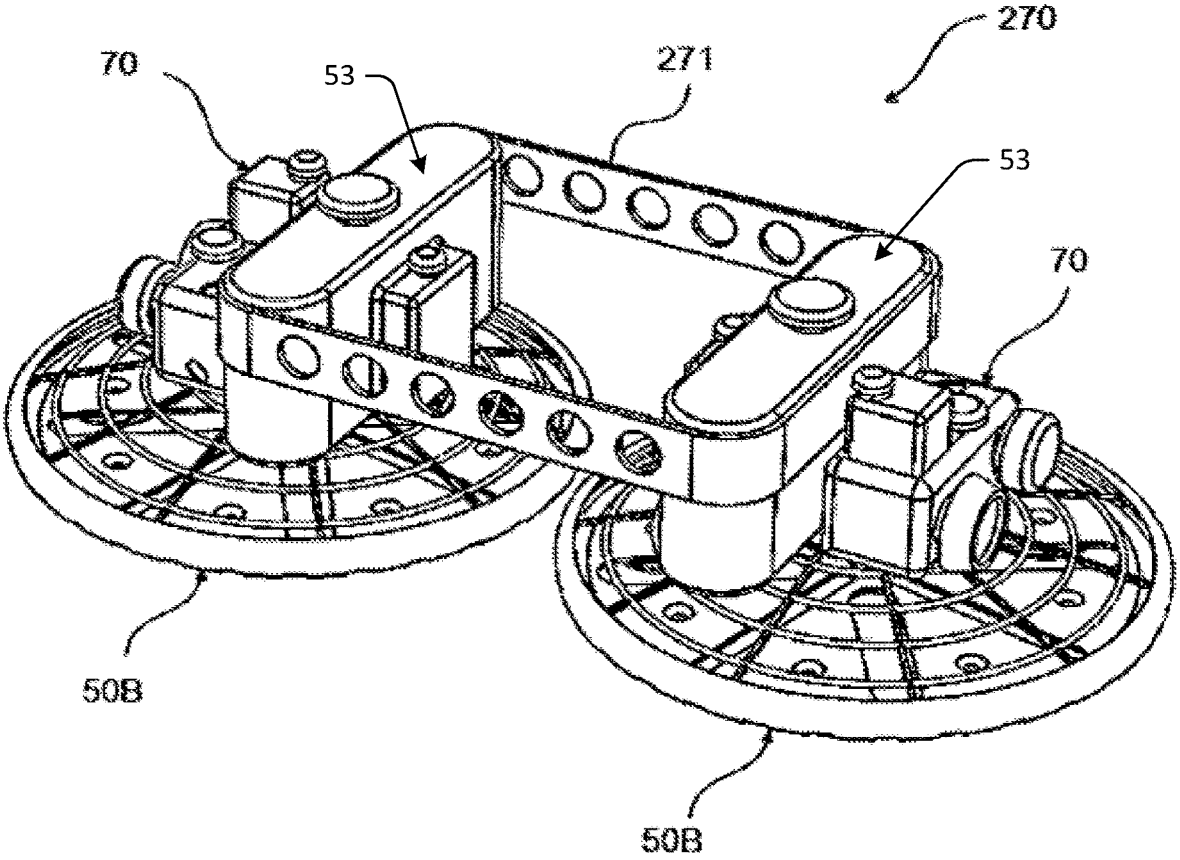
FIG. 28 illustrates in isometric view a coupled trowel conversion grinder-polisher robot without handle assistance in serial-parallel coupling using semi-rigid beam couplers.

Coupling trowel conversion machines equipped with remote control and may be assisted by handle as a walk-behind unit is also proposed and illustrated in FIG. 28 by assembly 270, having two conversion machines 50B coupled with semi-rigid frame 271. Machine 270 is obviously large enough to accommodate a seat for a driver (not shown), which may be located between the tanks 53.

Attention is now turned to FIG. 29, which by assembly 280, illustrates in an upside-down plan (bottom) view diagram of hydroplaning driving of coupled polishers illustrating driving kinetics (gliding) in serial coupling mode.

Front robot 211 is coupled to rear robot 211, each having 5 polisher discs rotating in the direction indicated by the curved arrows and labeled A1, B1, C1, D1 and E1 in the front and A2, B2, C2 D2 and E2 in the rear. The hydroplaning forces are shown by straight arrows next to each disc. These forces arise from friction and viscosity between pairs of counter-rotating discs. The resultant force is shown in the center tilted by 17 degrees as a resultant of all forces (dot-dash arrow) provided that all discs rotate with the same speed (a tan(2/8)=17°). That however is not required. Speeds are controlled individually or by groups and thus any angle can be dialed. 90 degrees, for instance, would convert this parallel coupling hydroplaning drive into a parallel coupled hydroplaning drive. Zero degrees would require slowing down A1 and speeding up A2 discs. Turning thus can be achieved just by altering the speeds of A1 and A2. True parallel coupling could be formed by counter-rotating discs-pairs of B1-C1, E1-D1, D2-E2 and C2-B2 while keeping deviatory disk pair A1-A2 for directional control. When hydroplaning drive is on, the other drive shall be off.

The gliding may also be controlled by spraying water or other suitable liquid to the polisher discs or in between them in a coordinated fashion executed by spray nozzles or water feed holes s1, S2 and S3. Spraying for instance on disks C1 and B1 by nozzle S2 with forces shown on the left side of polisher 280, which would facilitate polisher 280 turning to the right. Notice that left and right interchange in bottom view.

Two drives are disclosed next, which may be used as primary or secondary drives, which assist hydroplaning.

Attention is now turned to FIG. 30, which by assembly 290, illustrates in an isometric view of an exemplary robot polisher or grinder driven by magnetic ball drive.

Polisher robot 291 is moved around by ball 293 which turns in telescopic socket 293 and polishes or grinds with discs 294. Ball 293 may be coated with a layer of elastomeric for better traction and turns in any direction in its spherical socket, hydroplaning on feed water used in polishing or grinding. The ball has a multiplicity of permanent magnets and surrounded by electrical coils which powers and controls the magnets. Retracting in part ball 293 releases pressure on disco 294. Retracting it fully, lifts off that pressure completely, allowing for robot movement by hydroplaning on discs 294, which are preferably driven independently. Disks 294 have holes in the middle through which water with chemicals is fed for polishing or grinding. Curtains with magnetic inserts may enshroud robot 291 (not shown for clarity). Just by looking at assembly 290, one cannot tell, which way it is going before it moves. The next disclosed drive makes that direction clearly visible.

Figure 31:
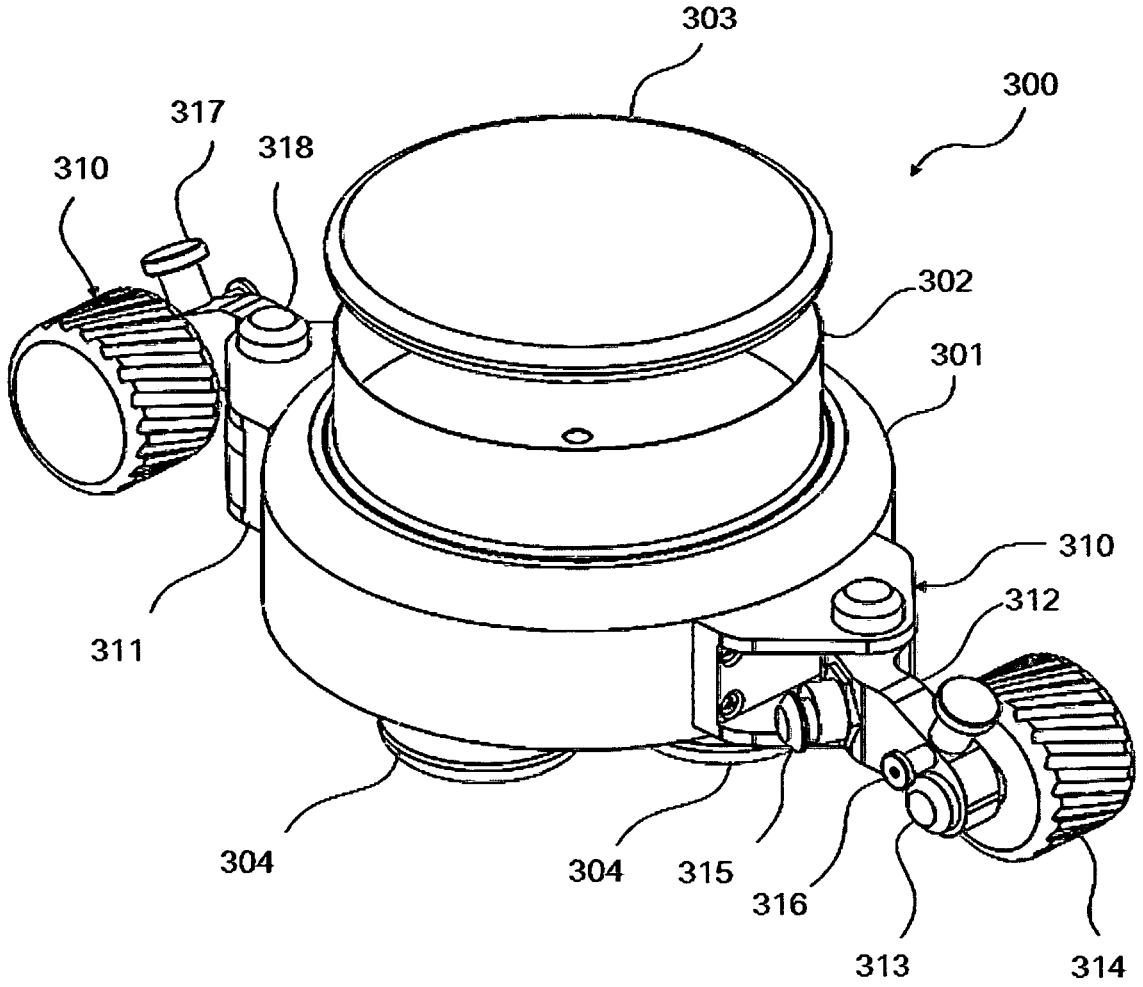
FIG. 31 is an isometric view of an exemplary robot polisher with lid off driven by swivel wheel drives in straight course.

Attention is now turned to FIG. 31, which by assembly 300, illustrates in an isometric view of an exemplary robot polisher with lid off, driven by swivel arm wheel drives, shown to be on a straight course.

Robot 301, polishing or grinding with discs 304, has removable water-chemical storage pot 302, shown with lid 303 off. Wheel drive 310 is rigidly attached to both ends of robot 301.

Drive 310 comprises socket 311, robotic swivel arm 312, wheel axle 313, wheel 314 controls setting adjustment buttons 315, 316 and 317 for X, Y and Z controls and pin 318, which pegs arm 312 into socket 311.

Figure 32:
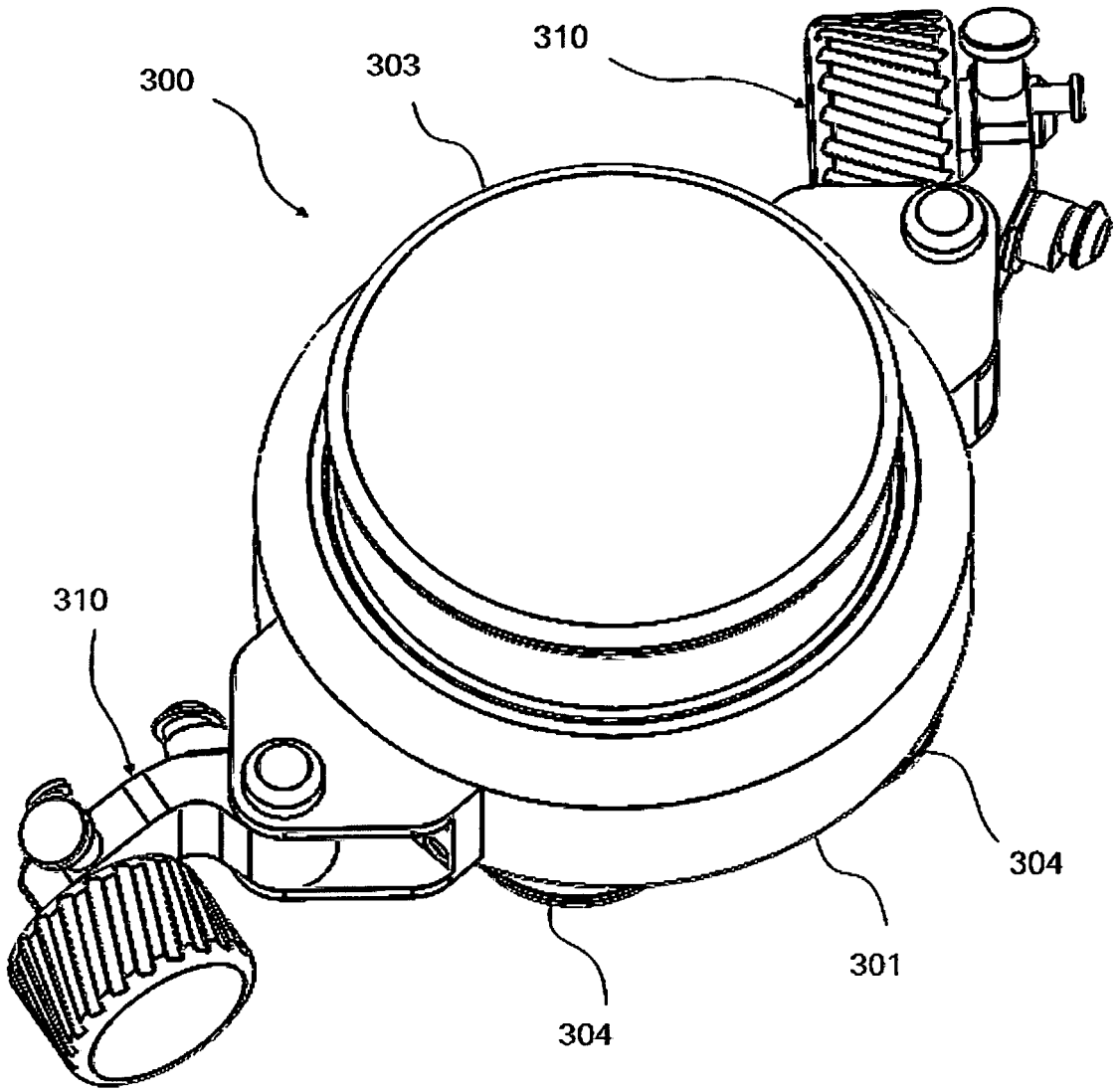
FIG. 32 is the same as FIG. 31 with lid on, in turning course.
Figure 33:
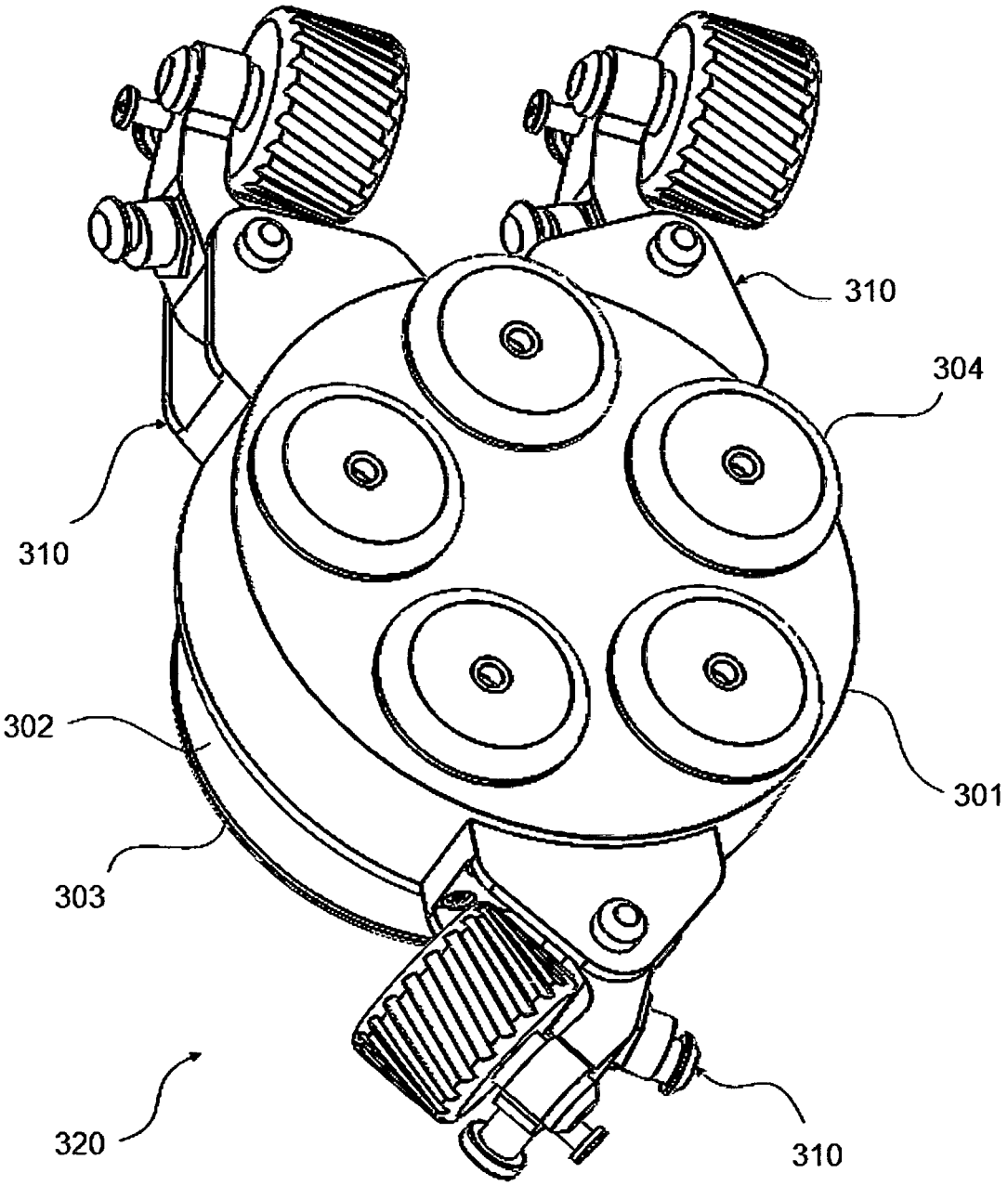
FIG. 33 is the same as FIGS. 31 and 32, with three drives.

Wheels 310 align in front and rear as shown, thus assembly 300 goes on a straight path. Turning in curve is illustrated in FIG. 32, by assembly 300, where the front wheel is turned to the left and thus robot also turns to the left. Lid 303 is shown closed in FIG. 32. FIG. 33 illustrates the robot 300 equipped with three drives 310. Likewise components are labeled likewise. The third drive adds more stability and traction. Obviously, a fourth wheel may be added for further stability and control.

Further accessories, tools, tool attachment devices and machine configurations are disclosed next. These were reduced from practice or development and can be used in conjunction with or instead of the ones disclosed before.

Figure 34:
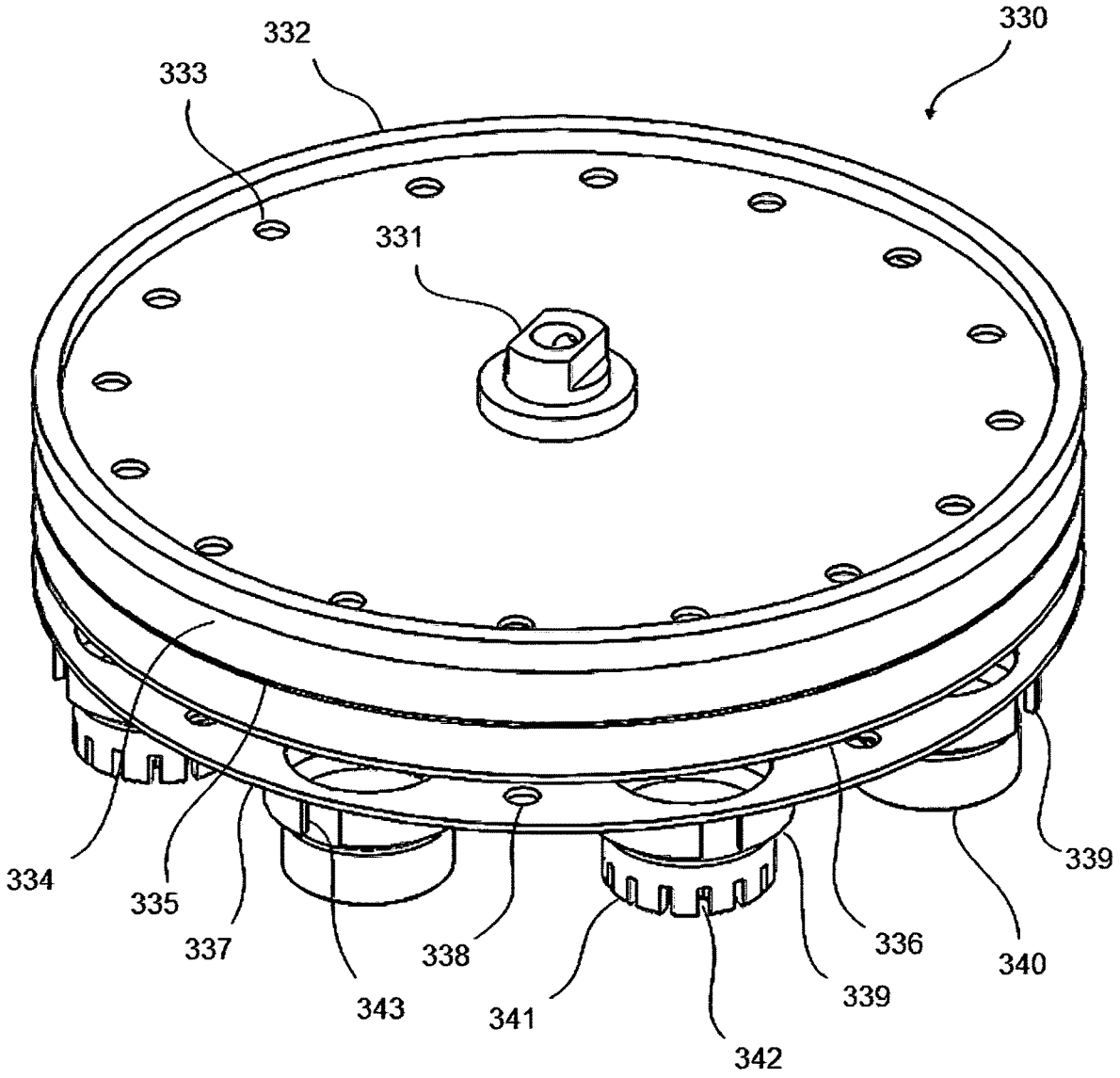
FIG. 34 is an isometric top view of an exemplary grinder polisher head assembly with quick release magnetic mounting disk and socketed polishing discs and grinding pucks in safety retainer.

Attention is now turned to FIG. 34, which illustrates in isometric top view of exemplary grinder polisher head assembly 330 with quick release magnetic mounting disk and socketed polishing discs along with grinding pucks in safety retainer.

Assembly 330 comprises drive socket 331, mounting disk 332, mounting hole 333, board 334, elastomeric plate 335, magnetized plate 336, tool ring 337, mounting hole 338, tool retainer lip 339, fine grinding puck 340, coarse grinding puck 341, puck gap cuts 342, retainer gap cut 343.

Figure 35:
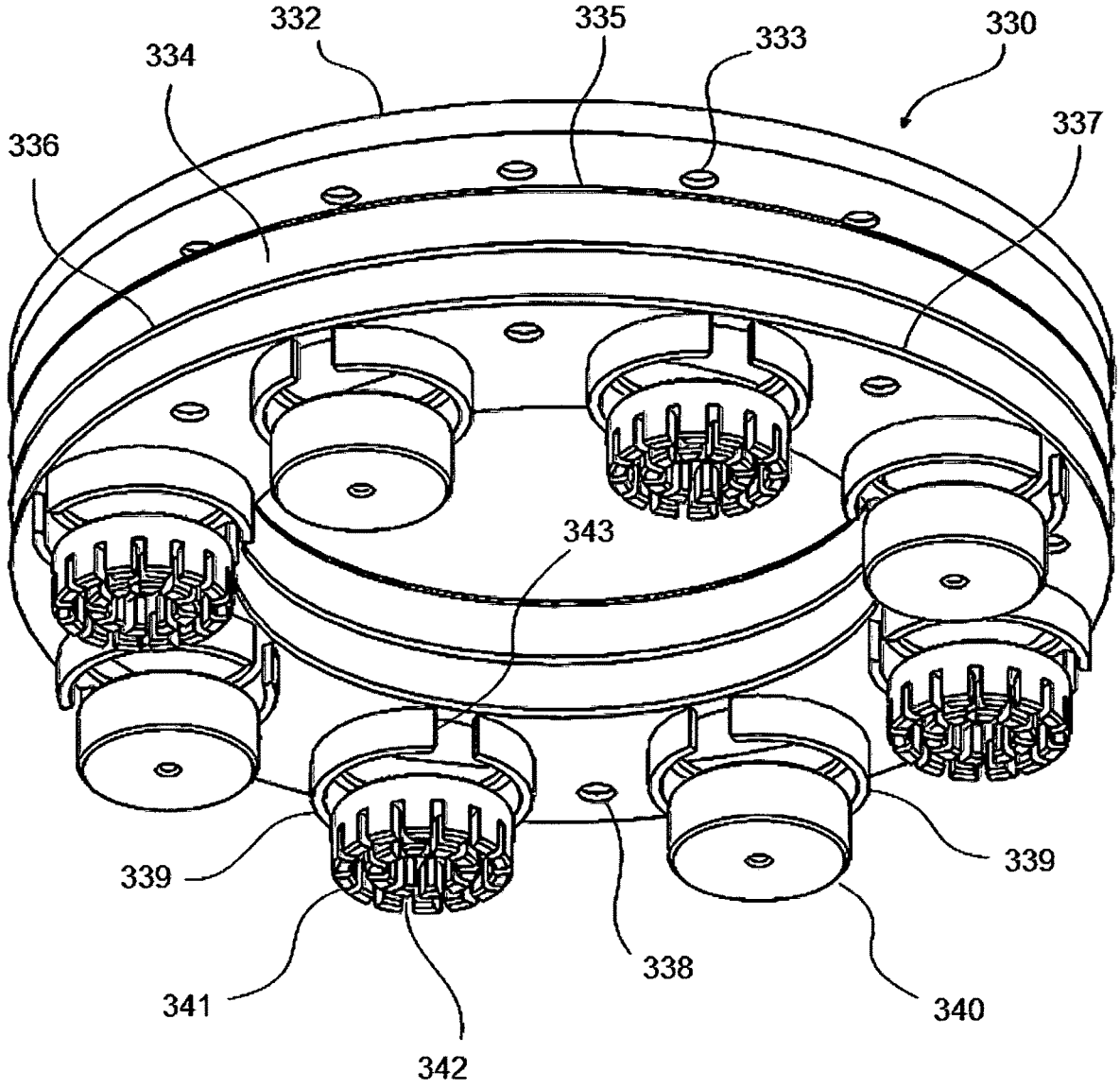
FIG. 35 is the same as FIG. 34 in bottom view.

FIG. 35 illustrate assembly 330 from under also disassembled, where likewise parts and elements are labeled likewise.

Socket 331 is rigidly formed from disk 332. It may accept round, hex, square, flat and other type of shaft ends. Assembly 330, assembled, is driven by engine or motor drive through socket 331. Disk 331 has perimeter lips for rigidity and mounting holes 333. Board 334 is pressed wood of low density with epoxy coating on the exposed perimeter for water sealing. Elastomeric plate 335 is under or above board 334 (preferably above) and is made of rubber or polyurethane. Plate 335 may be dense but soft (Durometer 35-45 Shore A) or thicker foam rubber to better comply with uneven floor surface waves. Plate 336 is magnetized to hold ferromagnetic ring 337, in which case, holes 338 are not utilized. Otherwise, assembly 330 is through bolted between holes 333 and 338. In case of magnetic ring holding, holes 333 are threaded to catch screws from under holding magnetized plate 336. Velcro plate may substitute plate 336. Ring 337 is articulated with protrusions 339 with gaps 343, serving as a grinding/polishing puck retainer for either pucks 340 or 342, which both are Velcro hook-and-loop) mounted to ring 337. Puck 340 is smooth while puck 341 is articulated, having slots 342. Slots 342 and 343 allow the passage of slurry. Articulated pucks are typically used for coarser grinding or polishing than smooth pucks. Gaps 342 and 343 are also allow for spray water or chemical passage from inside of ring 337. Feed water for such watering must pass through socket 331 (not shown).

Figure 36:
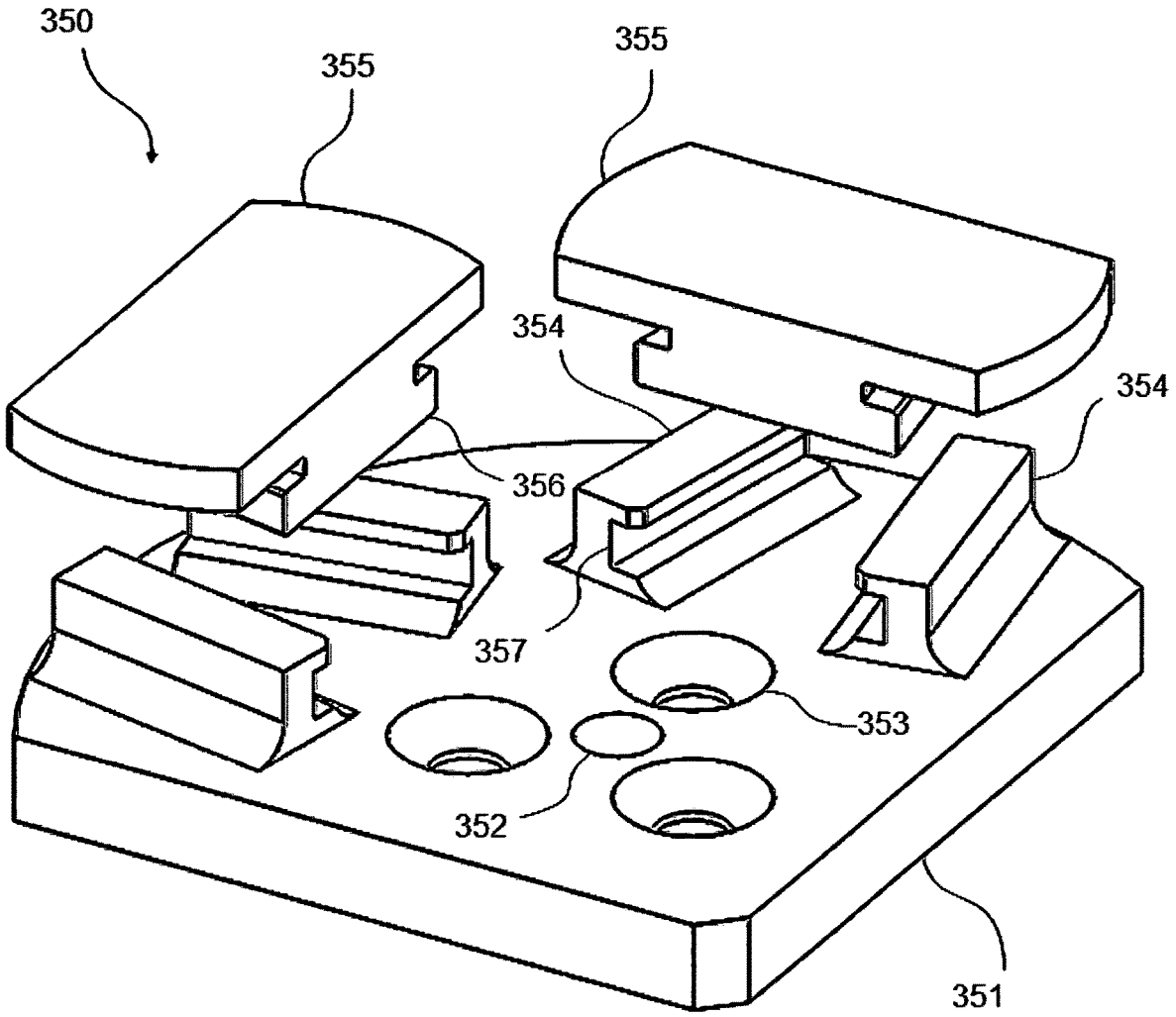
FIG. 36 illustrates in isometric view an exemplary quick release tool holder.

Attention is now turned to FIG. 36, which by assembly 350, illustrates in isometric view an exemplary quick release tool holder with two orthogonal wedge shape retainers.

Assembly 36 comprises base plate 351 with centering hole 352 and countersunk mounting holes 353 and weld-on keyways 354 in wedge shape angular orientation forming two wedges in 90° off, and wedge bottom polishing pad holders 355 to match with said keyways 356 (shown disassembled).

Figure 37:
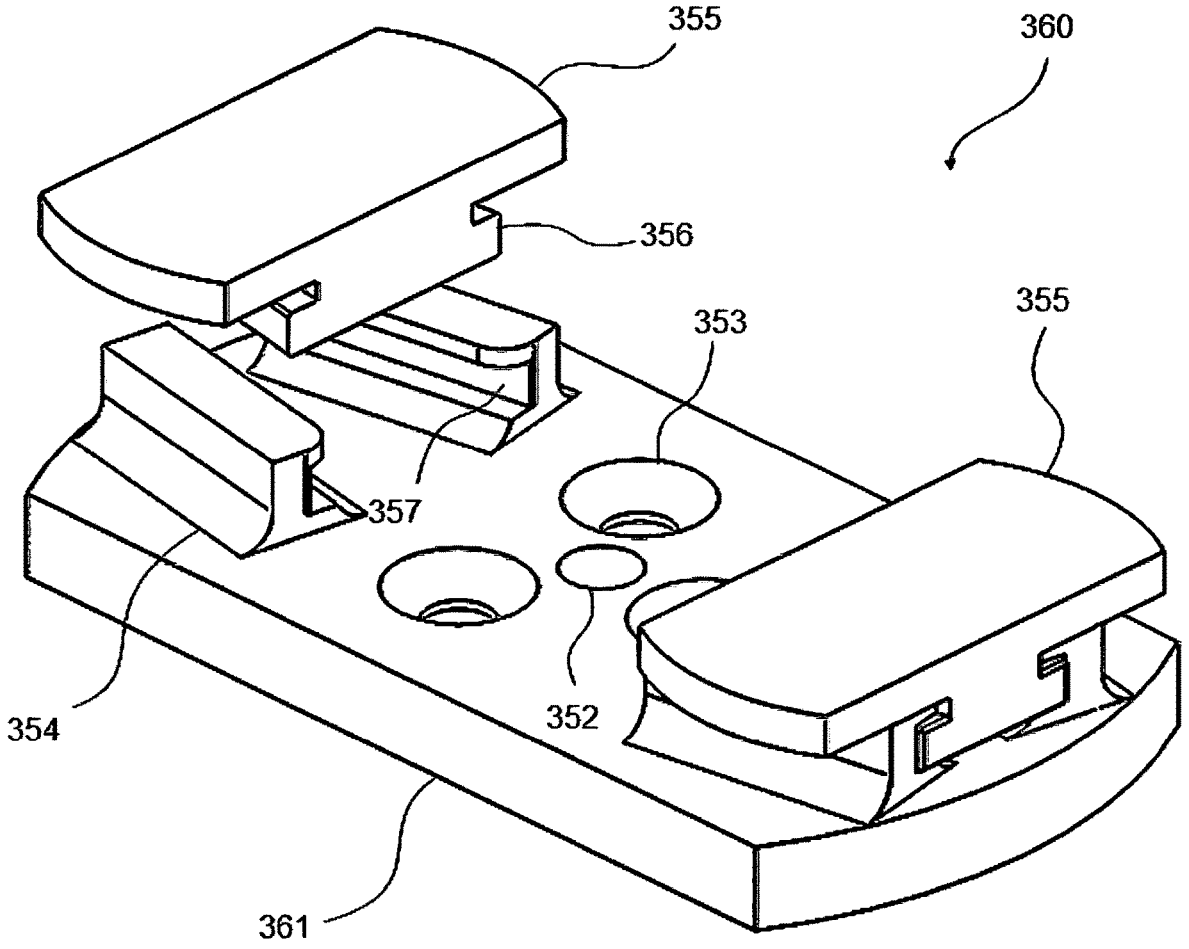
FIG. 37 illustrates another one of the same type as FIG. 36.

During the rotation of plate 351 around hole 352, the centrifugal force presses key 356 into keyway 357, ensuring quick toll change. Plate 351 however may be a machined part comprising keyways 357. Plate 351 can be circular with keyways for four tool holders 355. The simplest balanced configuration is illustrated in FIG. 37, where likewise components are labeled likewise and the two wedges are turned off 180° and one of the tool holders 355 is shown set in.

Figure 38:
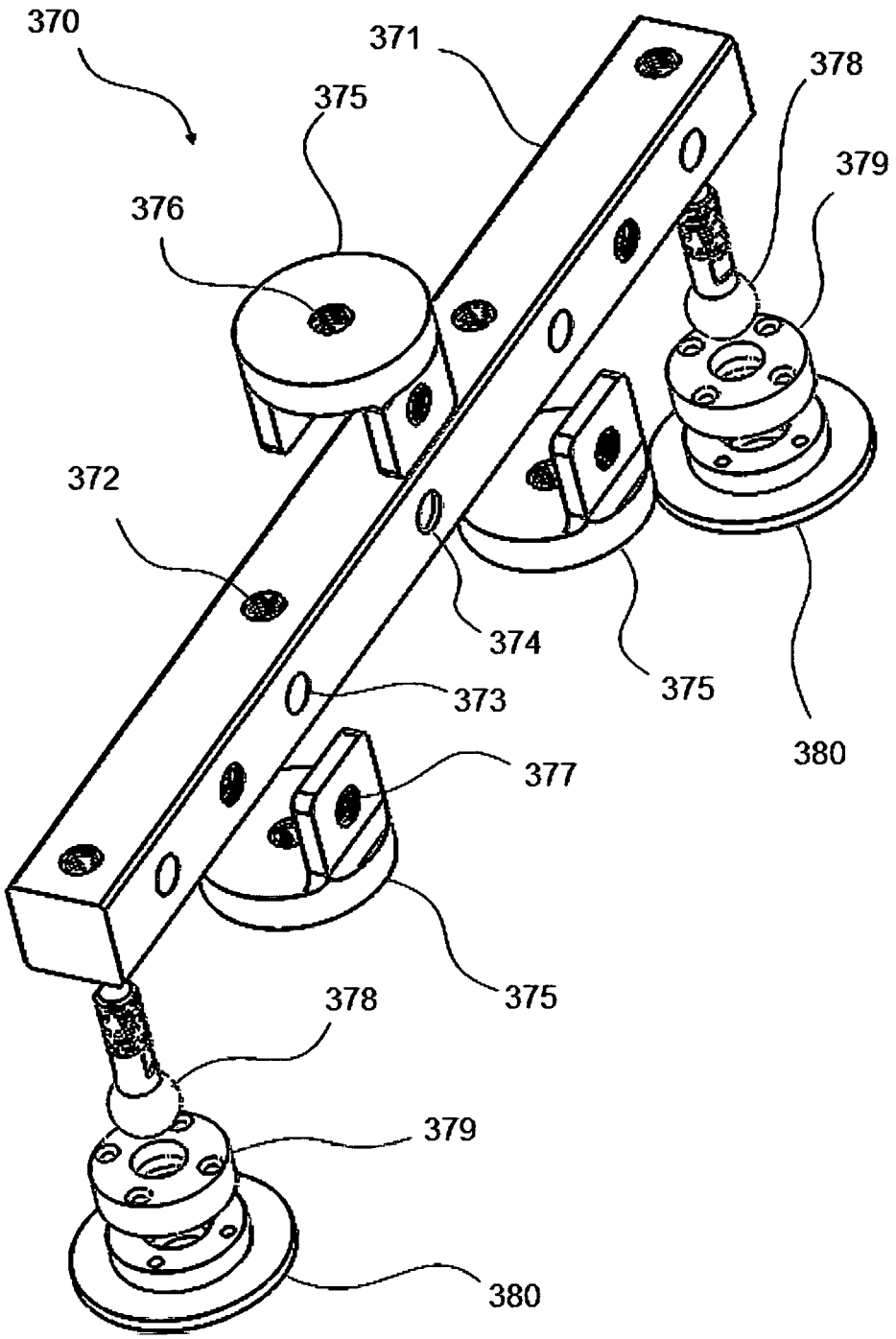
FIG. 38 is an isometric view of an exemplary cross bar tool holder.

Attention is now turned to FIG. 38, which by assembly 370 (shown in disassembly), illustrates in isometric view an exemplary cross bar tool holder, which is preferably used in tandem power trowel conversion machine in coupled opposing rotation to cancel vibration.

Assembly 370 comprises cross bar tool holder 371 with threaded holes 372, through holes 373 and centering counter bores 374, and further comprises detachable mounting sockets 375 with centering threaded hole 376 and side-mounting threaded holes 374, and further comprises ball joint treaded stud 378 with matching top semispherical socket 379

(shown in reverse order) and bottom semi spherically socketed polisher pad holder disk 380.

Socket 375 on the top center is to mount bar 371 to the drive shaft of said machine. The two sockets 375 under the bar 371 is for mounting other polisher disks matching in elevation to disk 380 when assembly 370 is assembled (assembly bolts and locknuts are not shown for clarity).

The articulated ball joints ensure smooth grinding or polishing by accommodating angular rotation of the grinding or polishing discs coping with minute floor surface undulations. Compared to rigid mounting, ball joints and universal joints offer faster surface finishing with less waste of slurry and power. Crossbar 371 may be substituted with multi armed half spider bars, which will be illustrated further on in FIG. 42.

Figure 39:
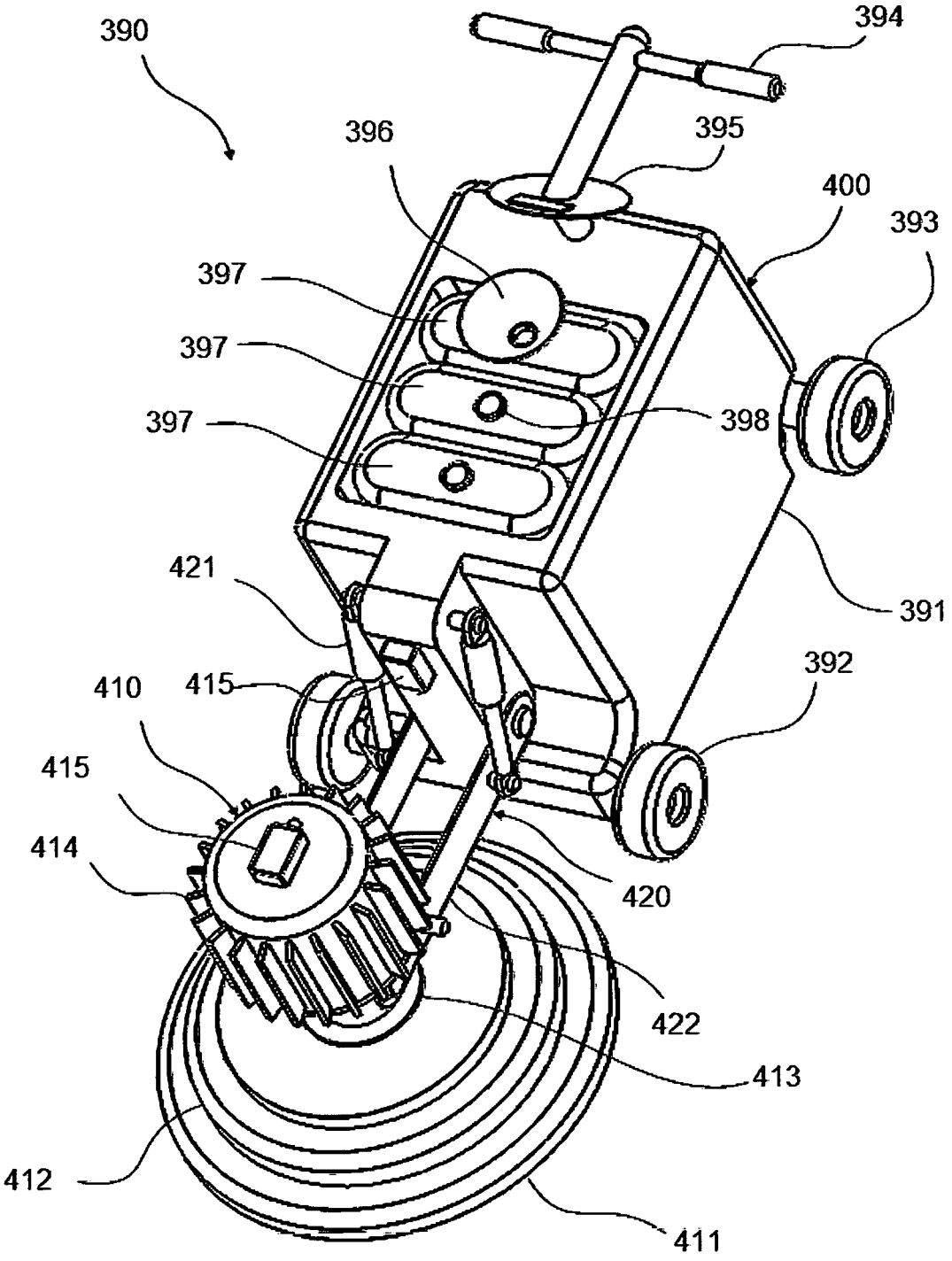
FIG. 39 is an isometric top view of an exemplary grinder-polisher tool with hydraulic/pneumatic head lift and slurry carry.

Attention is now turned to FIG. 39, which by assembly 390, illustrates an isometric top view of an exemplary grinder-polisher tool with hydraulic or pneumatic head lift and slurry carry and optionally slurry suction capacity.

Figure 40:
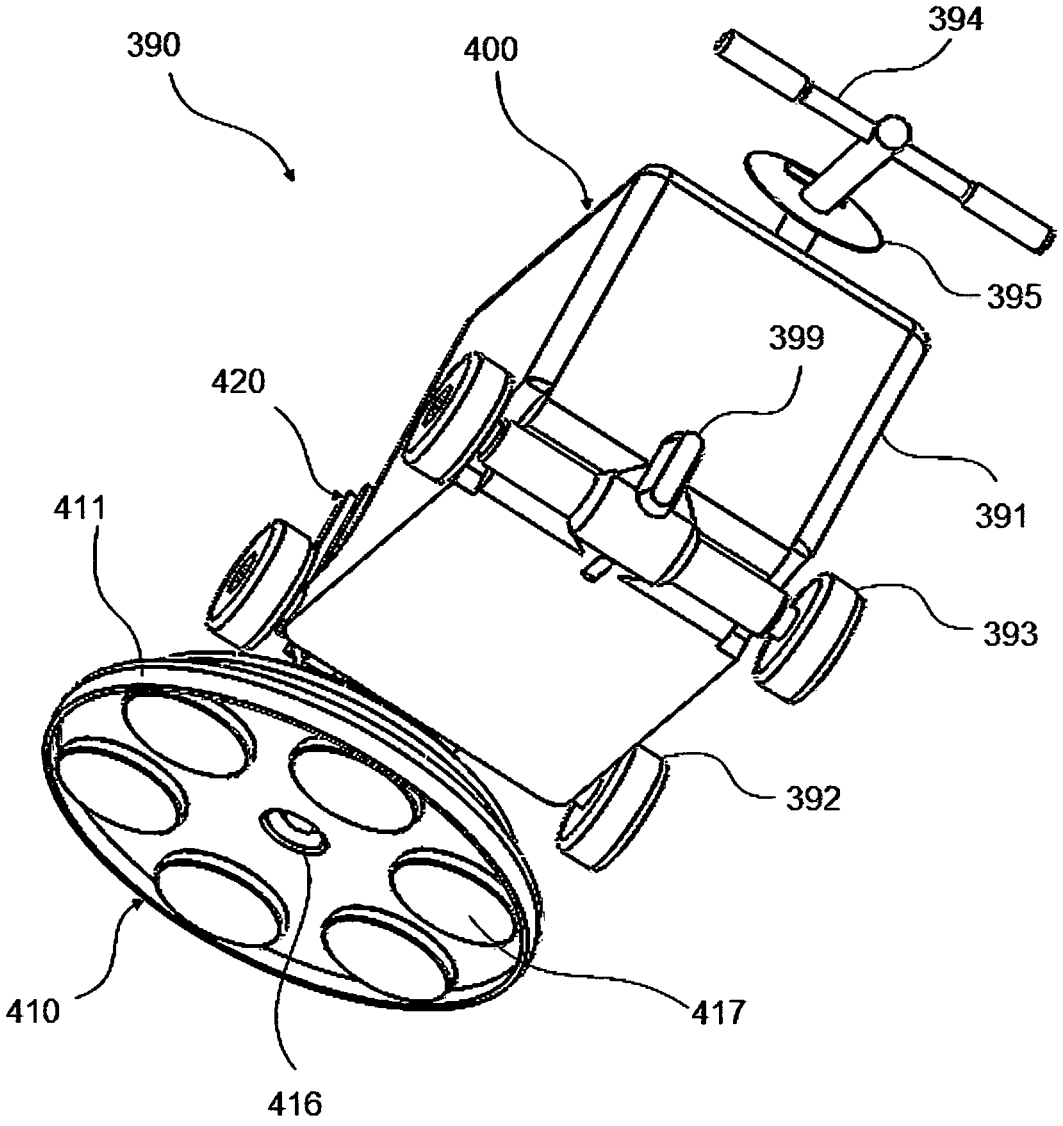
FIG. 40 is an isometric bottom view of the same as FIG. 39.
Figure 41:
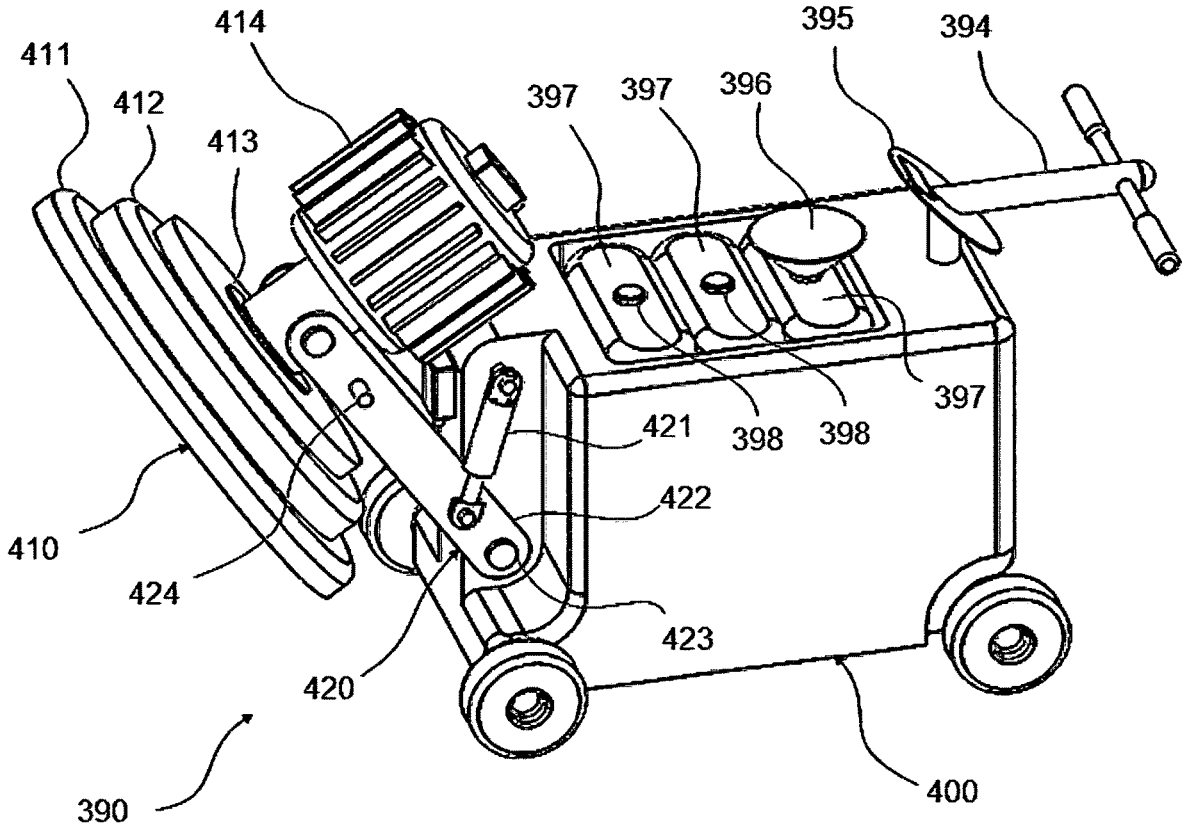
FIG. 41 is an isometric top view of the same as FIG. 40 in tool changing/servicing position with head lifted up.

Assembly 390 comprises cart 391, non-steered front wells 392, steered or swivel rear wheels 393, tool guiding hale bar 394, switchboard and control panel 395, detachable slurry/chemicals/water will-up funnel 396, slurry/chemicals/water tanks 397, tank caps 398; furthermore battery compartment 400, polisher head 410 and hydraulic/pneumatic lifting mechanism 420 subassemblies, with under counter reach shallow lip polisher skirt 411, slurry cover 412, electric motor mount 413, electric motor 414, electrical cord junction box 415; hydraulic ram or pneumatic cylinder 421. Assembly 390, representing floor finishing machine 390, is shown with polisher head down, ready to polish floor. FIG. 40 illustrates machine 390 from under in the same position, revealing steering cover 399, polishing tool mounting well 416 and polishing disks or pads 417, some or all of which may vibrate radially to head 410 or slightly spinning. FIG. 41 illustrates machine 390 in tool changing or servicing position, with jacks 421 pulled in arms 422 lifted up rotating around hinge 423 and emergency handle 424 in case the hydraulics do not operate as intended or just need a push or lift. One of tanks 397 may carry water or water with chemicals, the other one slurry and yet another one waste slurry suctioned back for filtering separating solids from water to reuse water for recycling. More tanks may be carried on inside cart 391. More liquids may be needed to assist scrubbing/grinding/polishing. These liquids may include softener, hardener, densifier, detergent, sealer, acids and emulsions. Skirt 411 may rotate around cover 412 in case an obstacle is hit while polishing. Machine 390 may be configured to drive and work autonomously.

Next, more trowel conversion tools and accessories will be illustrated. These are intended to complete specialized jobs.

Figure 42:
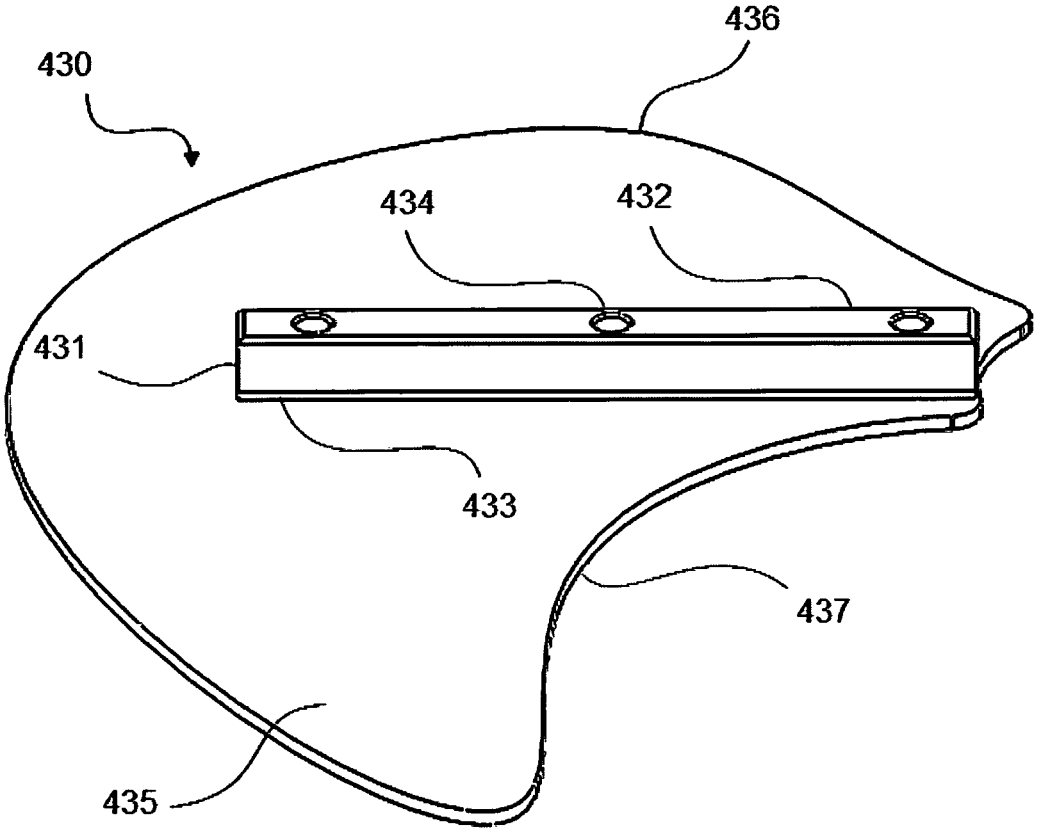
FIG. 42 is an isometric view of an exemplary shark fin trowel blade to be mounted on half bar on spider socket.
Figure 43:
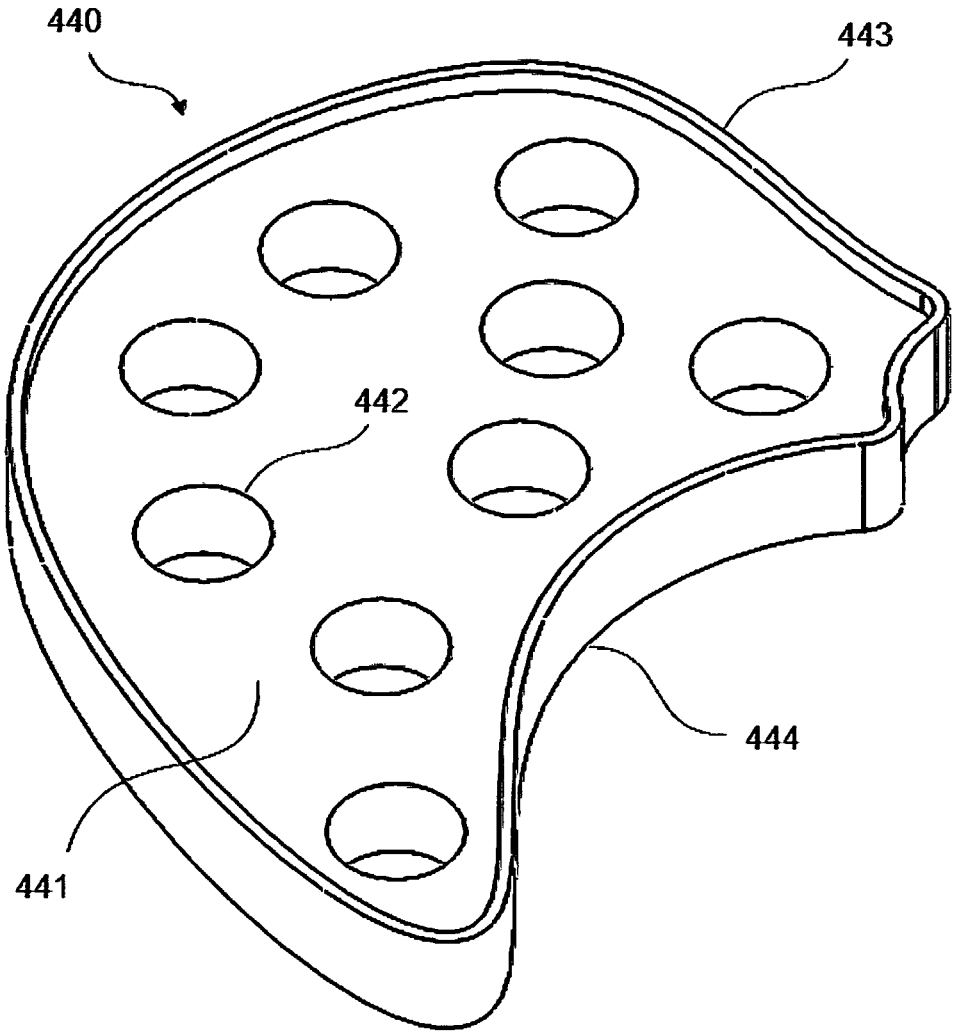
FIG. 43 is an isometric view of an exemplary shark fin shape trowel grinder tool accessory, matching in plan the blade of FIG. 42.
Figure 44:
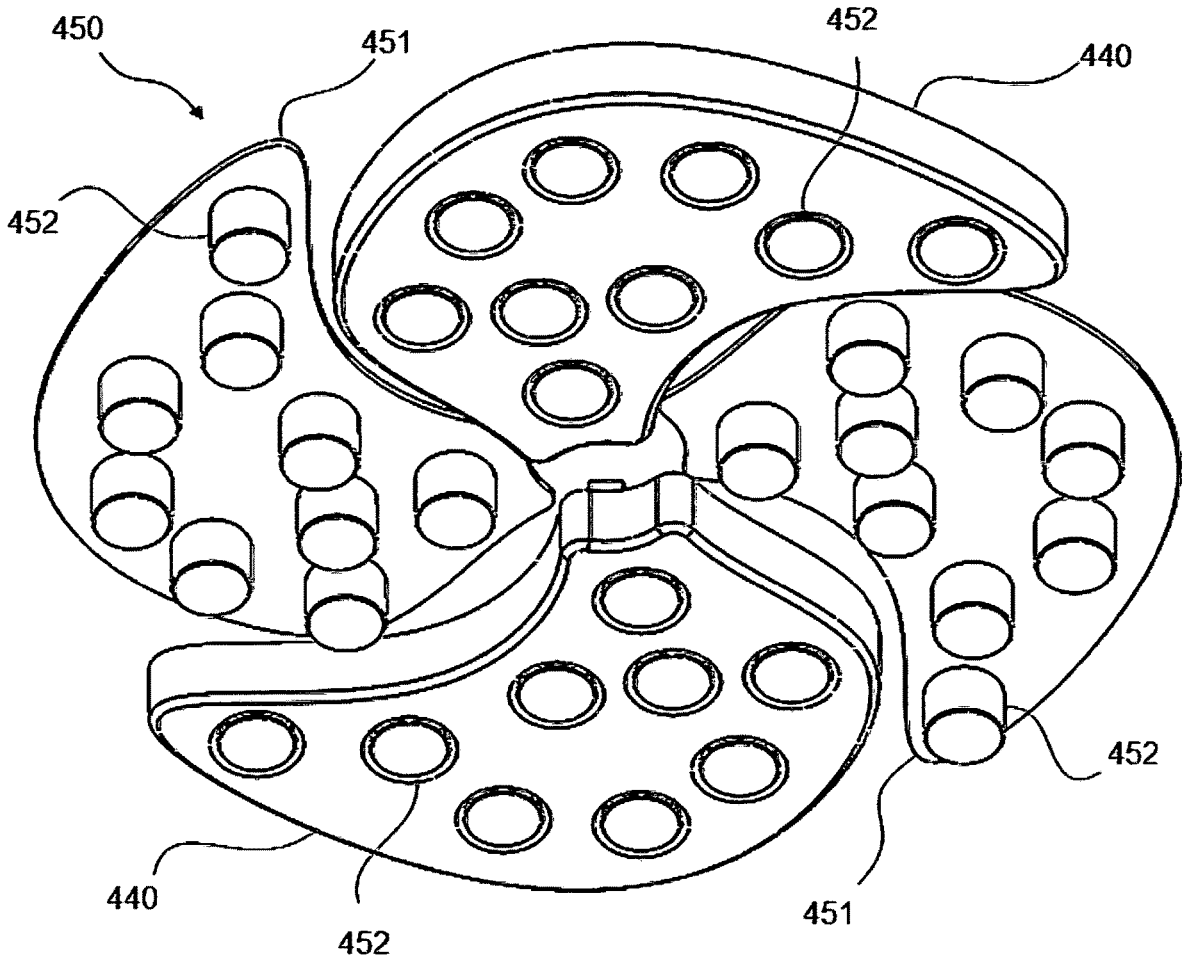
FIG. 44 is an isometric view of an exemplary assembly trowel conversion assembly combining the blade shown in FIG. 42 and accessory shown in FIG. 43.
Figure 45:
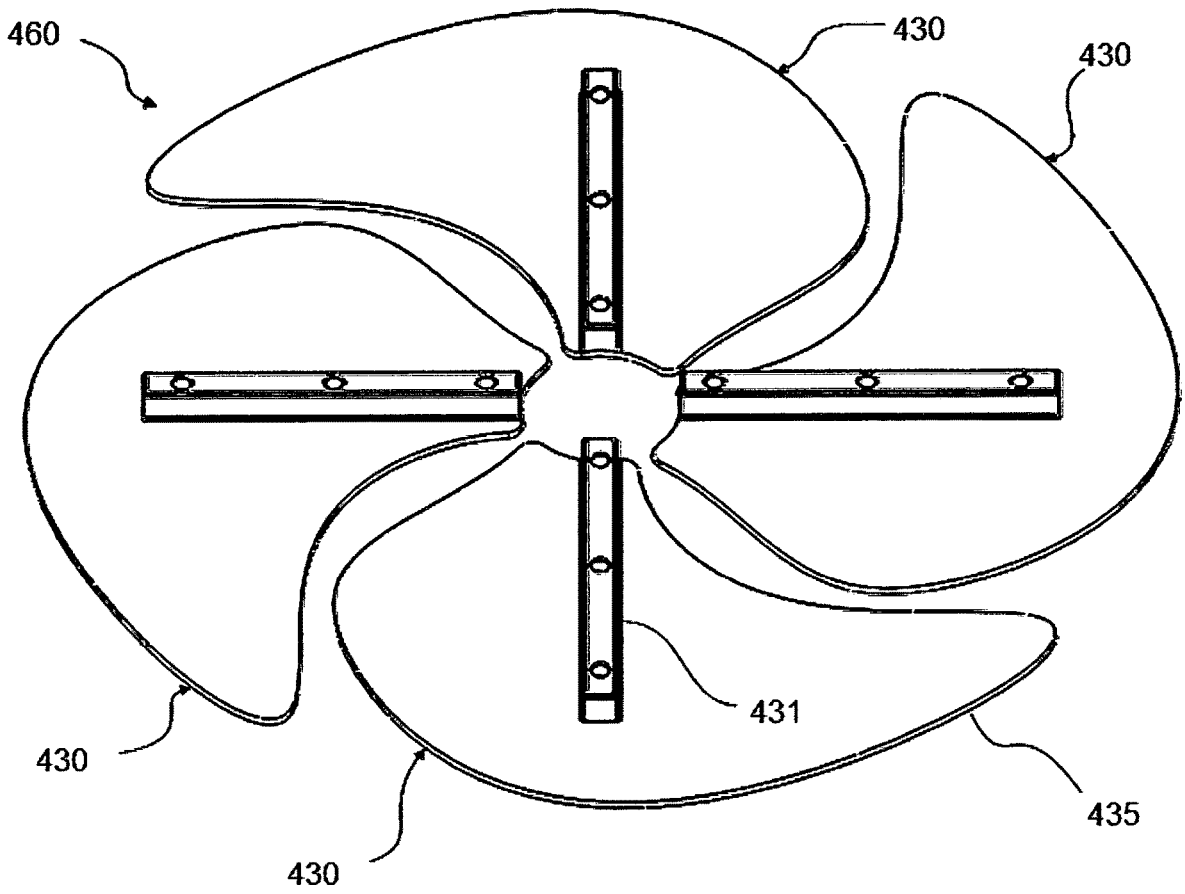
FIG. 45 is an isometric view of an exemplary assembly of trowel blades shown in FIG. 42 ready to trowel wet concrete floor.
Figure 46:
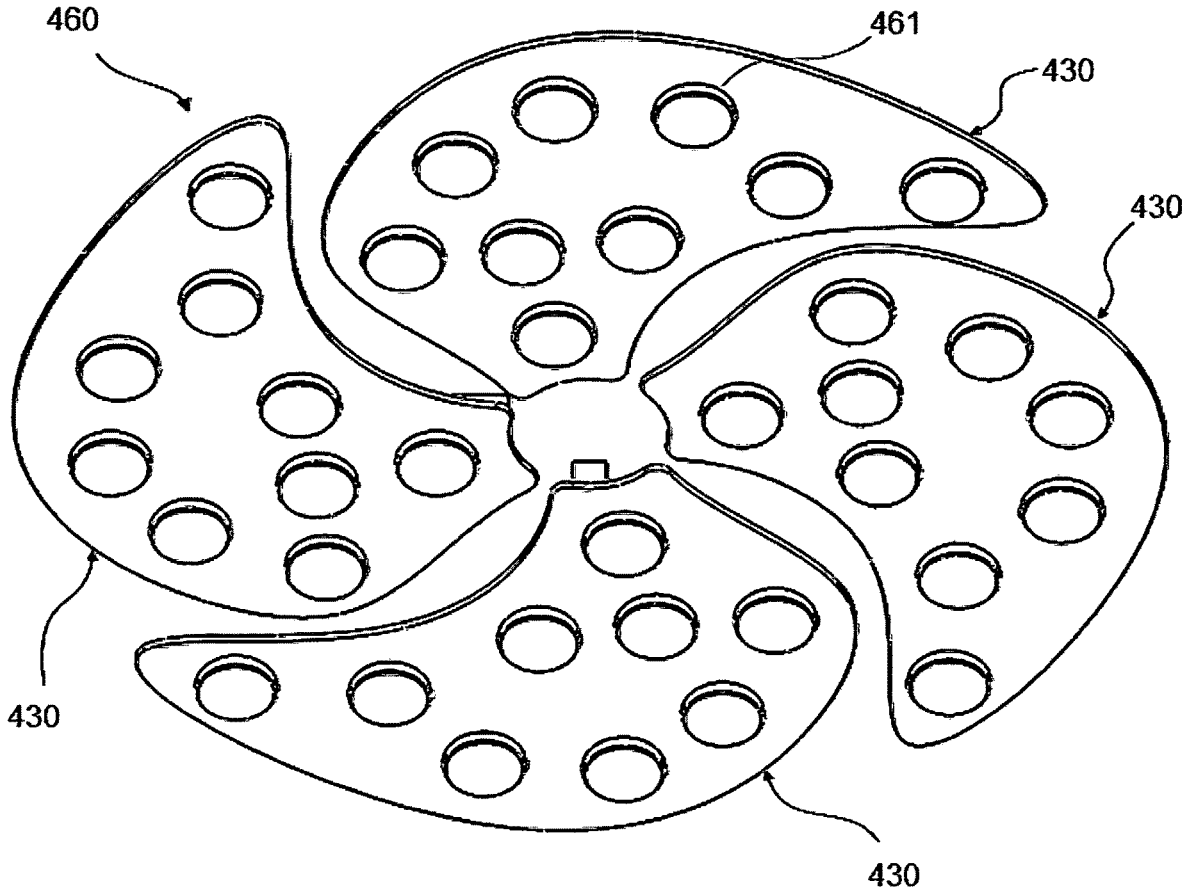
FIG. 46 is an isometric view of an exemplary assembly of trowel blades shown in FIG. 42 with added magnetic grinder pucks, ready to grind hardened concrete floor.

Attention is now turned to FIG. 42, which by assembly 430, illustrates in isometric view exemplary trowel conversion shark fin blade 435 mounted on half bar 431, which have tapped top mounting holes 434 and leading edge 436, followed in rotary mounting by trailing edge 437. The shark fin, also called propeller shape, is best suited for wet troweling. FIG. 43 illustrates a similar shape porous fired clay polishing tool and socket 440 with body 441, leading side 443 and trailing side 441. Socket 440 may be mounted on blade 435. FIG. 44, by assembly 450, illustrates the combination of shark fin blade conversion with Velcro attached polishing or grinding pucks 452. Preferably, socket 440 is of higher grit size then puck 452. Socket 440 may also be soft plastic with diamond or other cutting tool grit inserts or blends. FIG. 45 illustrates shark fin blades 430 in a quadrant array ready to trowel wet concrete or to grind or polish hard floor if grinder or polisher pucks are attached on the blade underside as that is shown in FIG. 46 using pucks 461.

Figure 47:
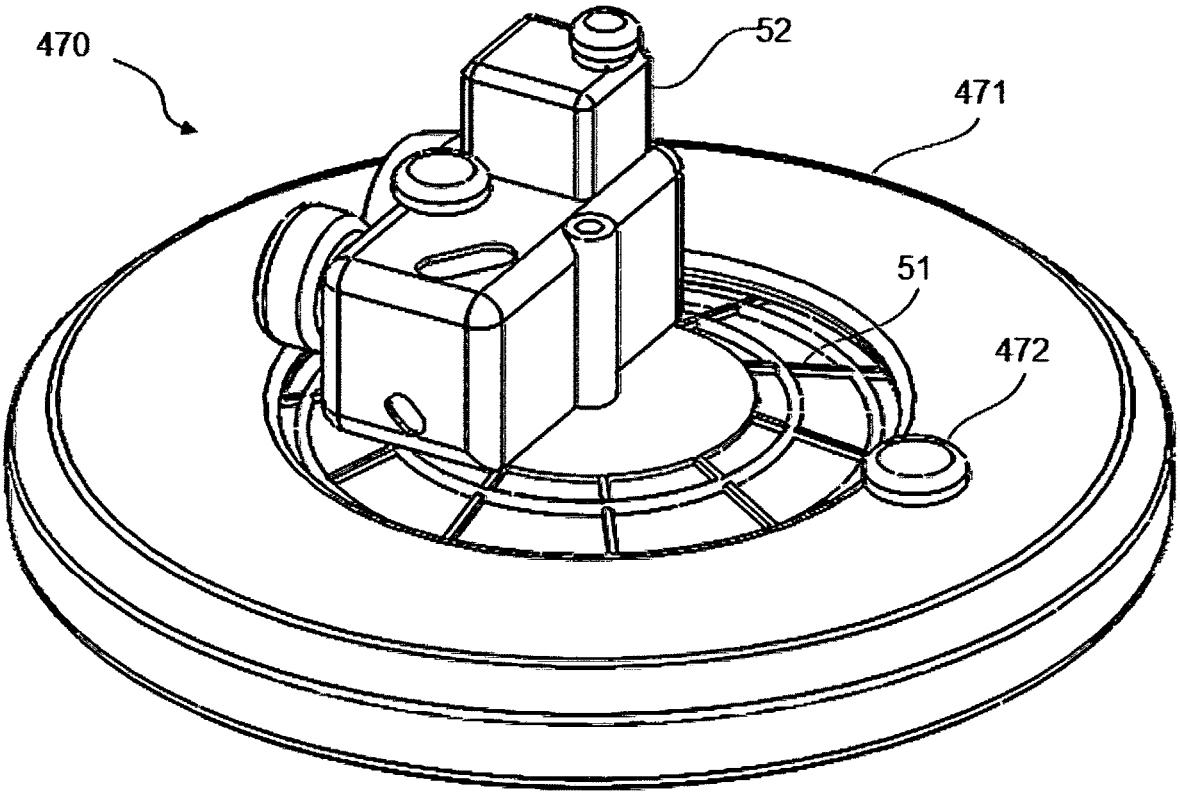
FIG. 47 is an isometric view of an exemplary floor finishing power trowel machine with removable slurry tank ring overlaid on blade protection cage.
Figure 48:
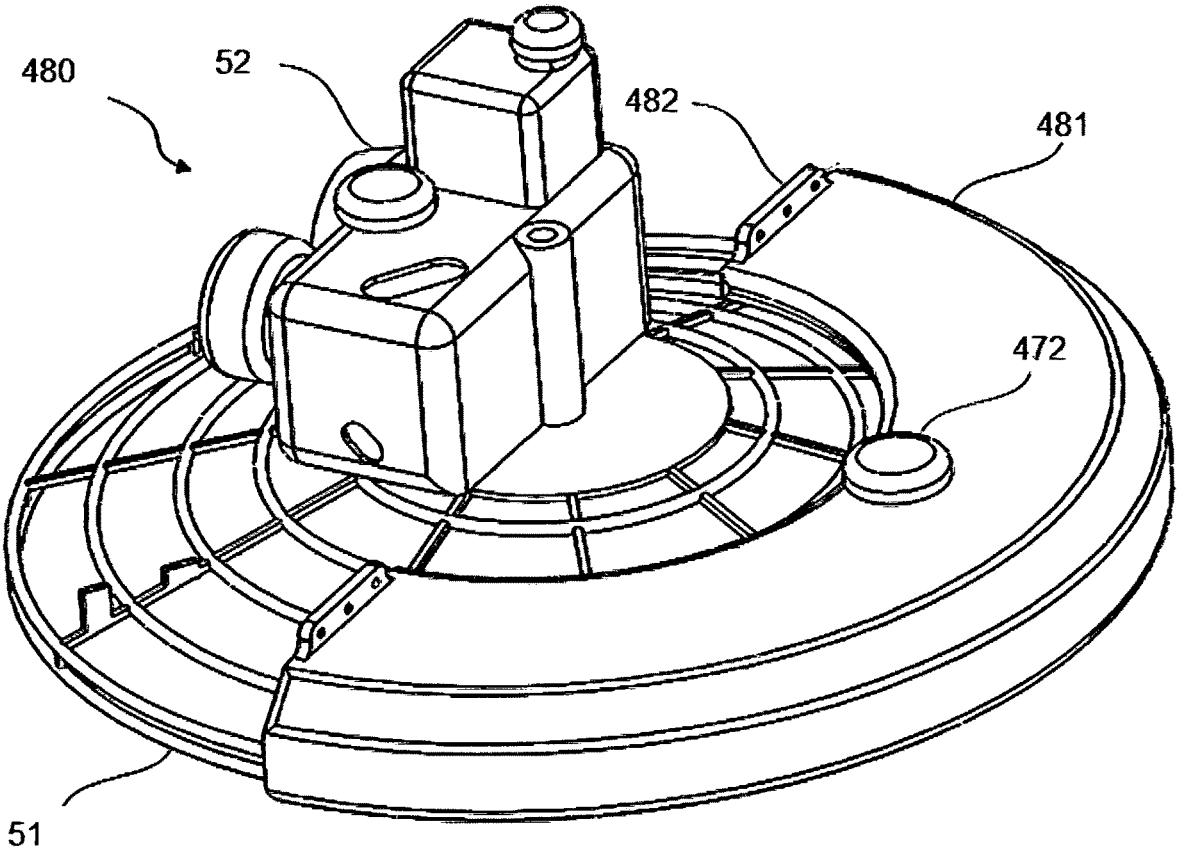
FIG. 48 is the same as FIG. 47 with split tanks for water and chemicals.
Figure 49:
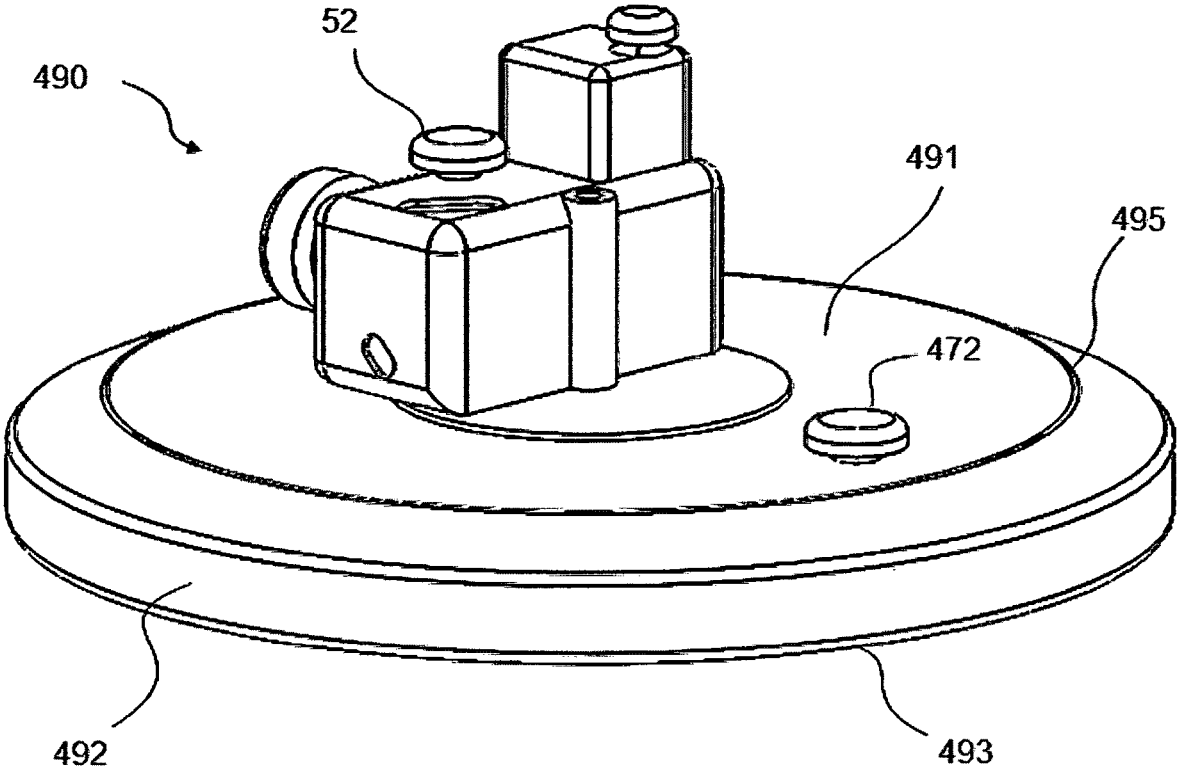
FIG. 49 is an isometric view of an exemplary floor finishing power trowel machine with full size removable slurry tank used as blade protector.

Attention is now turned to FIG. 47, which by assembly 470, illustrates in an isometric view of exemplary floor finishing power trowel machine 470 with removable slurry tank ring 471 overlaid on blade protection cage 51. The machine is driven by a vertical shaft gasoline engine 52. Annular (ring shape) tank 471 is capped by twist-off cap 472. Similarly, FIG. 48, illustrates the same but with tank 481, which is a split version of tank 481, allowing for two liquid application at troweling or grinding or polishing. Similarly, FIG. 49 illustrates the same with full size tank 491, which also serves as cage substitute for blade protection, thus is made of sheet metal. Tank 491 is covered at its outer edge by rigid skirt 492 with squeegee bottom lip 493. Skirt 492 is hanging on tank 491 by gravity. Gap 495 between tank 491 and skirt 492 varies accordingly. The guiding bars with controls are not shown for clarity.

Figure 50:
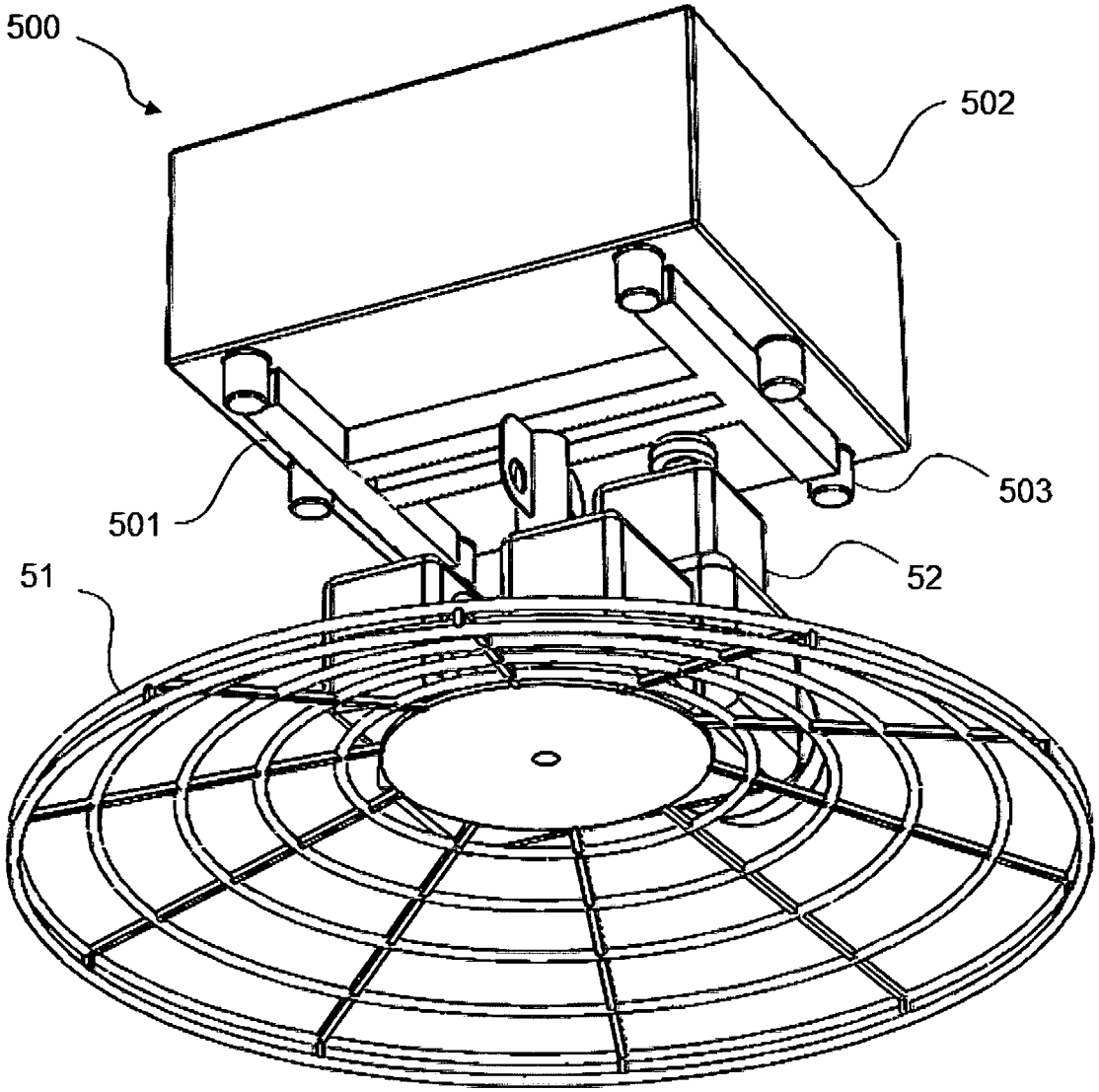
FIG. 50 is an isometric bottom view of an exemplary floor finishing power trowel-grinder machine with top mount retrofit water tank without blades/disk.
Figure 51:
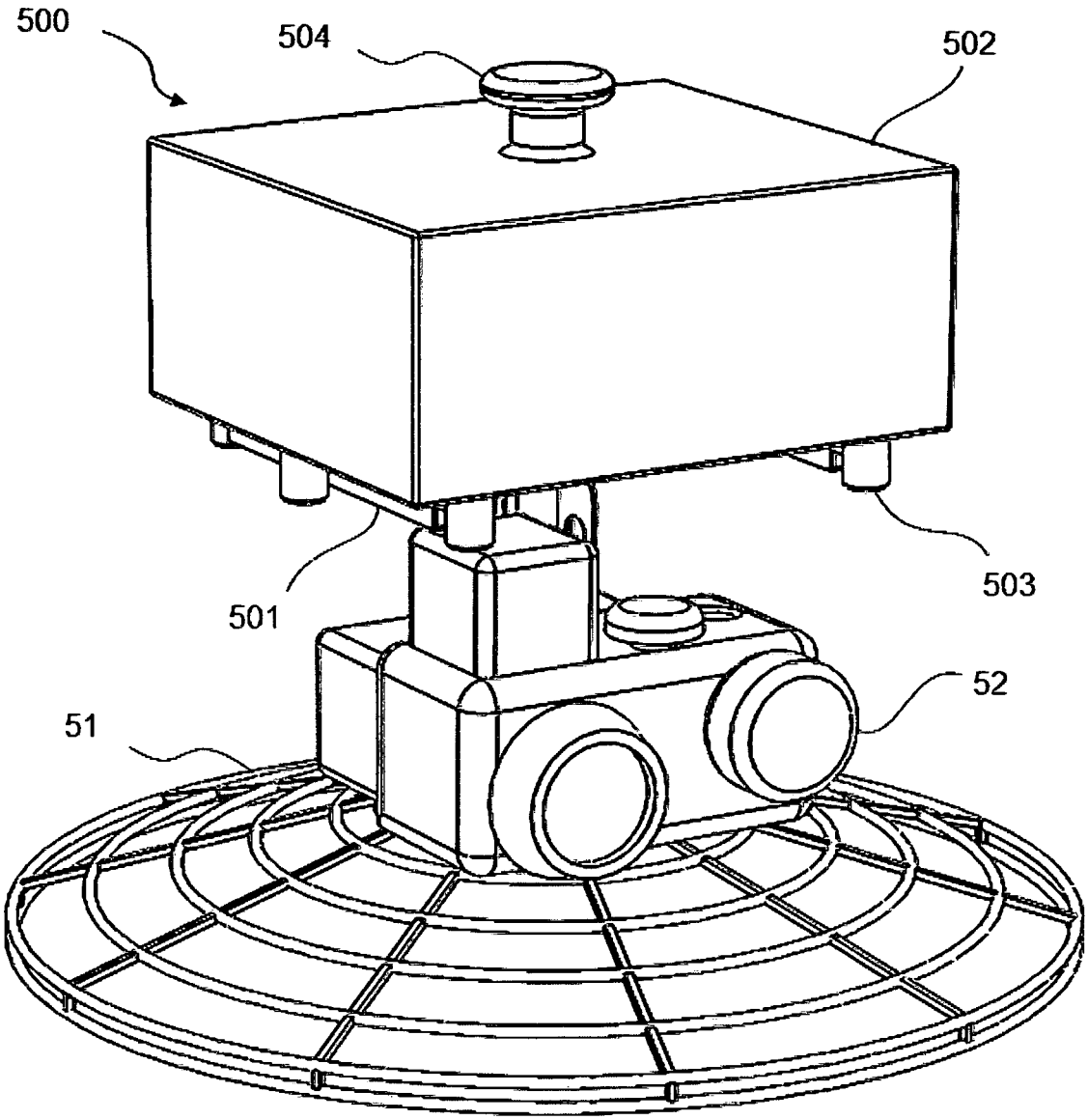
FIG. 51 is the top view of the same as FIG. 50.

Attention is now turned to FIG. 50, which by assembly 500, illustrates in isometric bottom view of an exemplary floor finishing power trowel-grinder machine with top mount retrofit water tank without blades or disk, whereas retrofit water tank 502 is gravity mounted with or without pump on retrofit frame 501 retained each horizontal way by plug protrusions 503. Engine 52 powers the machine having a blade protection cage 51. FIG. 51 illustrates the same in top view. Tank 502 is removable from frame 501 and capped by cap 504. At least one stud 503 may serve as dripping spigot (valve is not shown) or may incorporate a sprayer head. With trowel head setup, tank 502 may contain and supply cutting compound which may drop down periodically shaken off by the vibration of engine 52. Administering said liquids from tank 53 through orifice 54 is similarly done.

Figure 52:
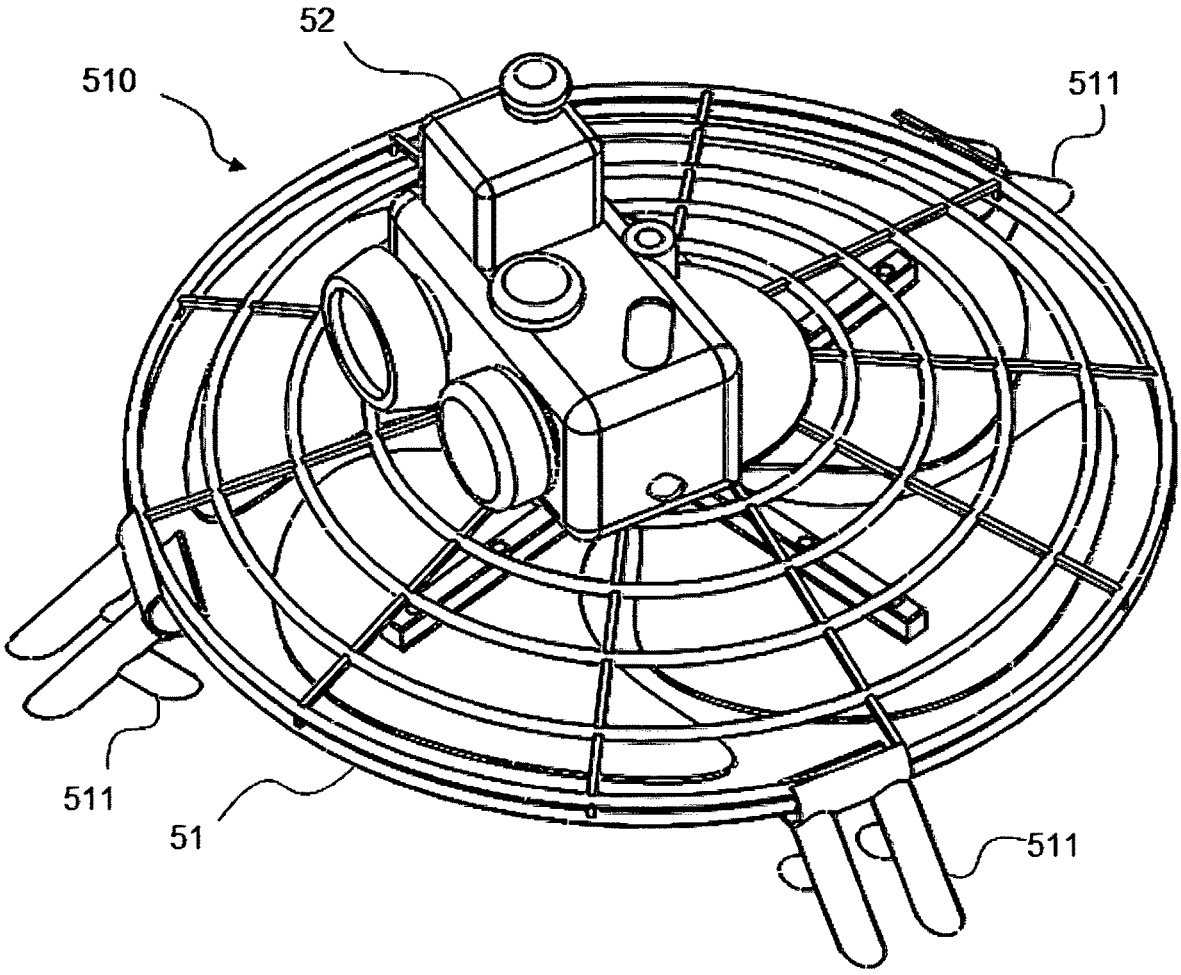
FIG. 52 is an isometric top view of an exemplary floor finishing power trowel-grinder machine with fin blades on standoffs.
Figure 53:
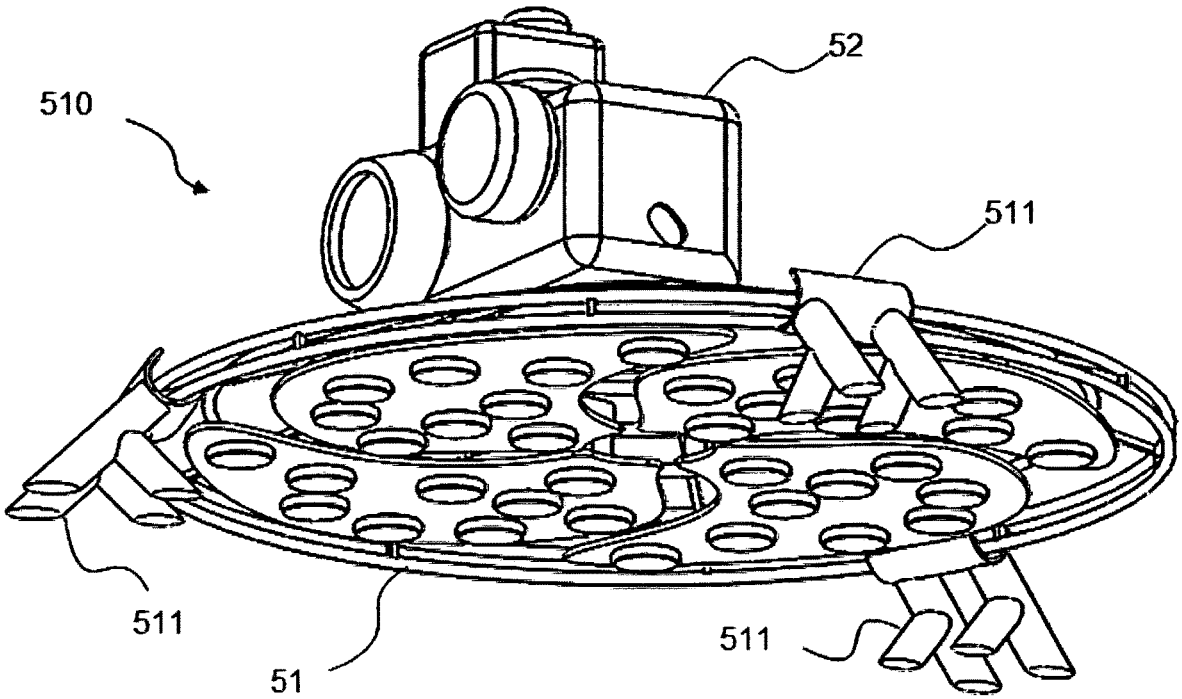
FIG. 53 is the same as FIG. 52 in bottom view with fin blades having magnetic polisher pucks.
Figure 54:
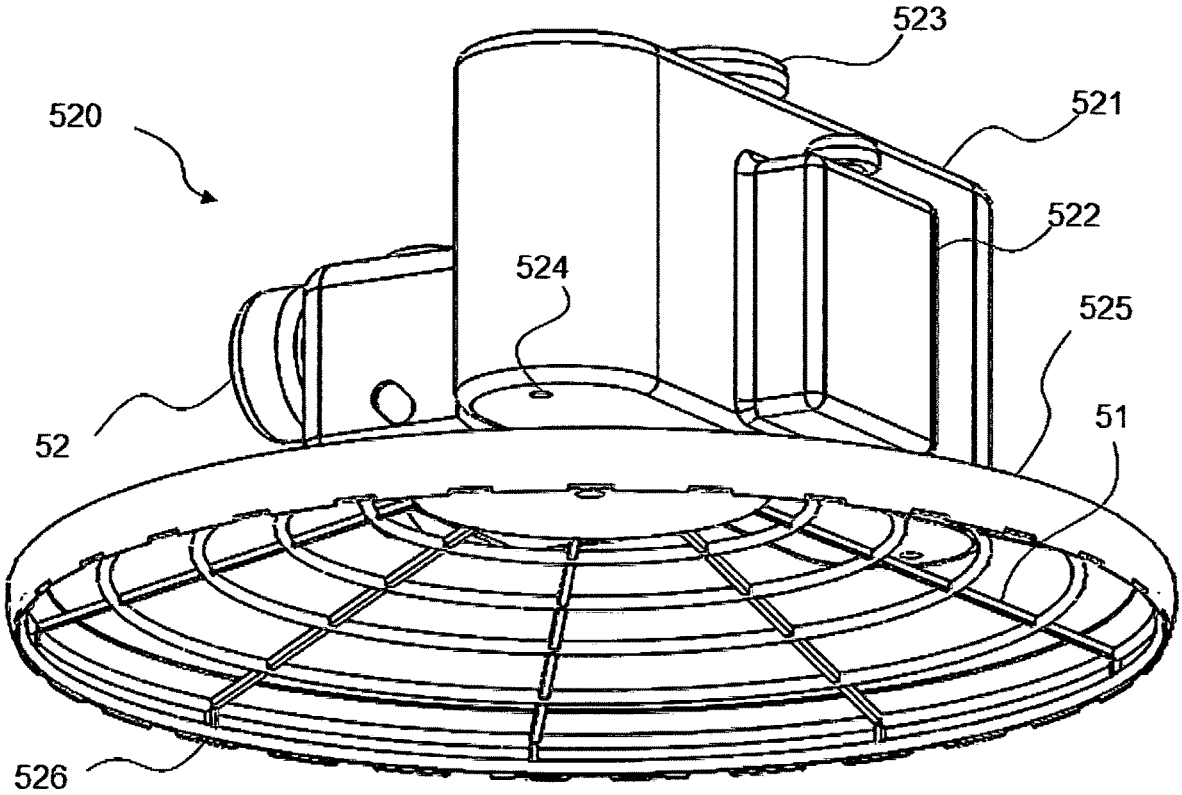
FIG. 54 is an isometric bottom view of another exemplary floor finishing power trowel-grinder machine with top mount retrofit water tank without blades/disk.

Attention is now turned to FIG. 52, which by assembly 510, illustrates an isometric top view of exemplary floor finishing power trowel-grinder machine 510 with fin blades, engine 52, cage 51 and temporary shoring standoffs 511 on which machine 510 is resting by gravity while serviced or stored. FIG. 53 illustrates the same from under with assembly 460 mounted on it. FIG. 54 is illustrating trowel conversion machine 520 with engine 52, cage 51, engine mounted water tank 521, tank mounted chemical tank 522, tank cap 523 and skirt 525 hooked up to cage 51. Skirt 526 has vent slots 526 for slurry passage. Tank 521 has dripping hole 524 (valve or plug is not shown). Tanks 521 and 522 communicate via a small metering orifice (not shown). Alternative to liquid tanks, compartments or boxes may be mounted to hold tools and polishing or grinding pucks or pads may be mounted on engine 52 or cage 51.

Tank 502 may contain water or diluted hardener or softener chemicals or a skin chemical for micro- or nano-polishing. With larger dripping orifice in stud 503, it can supply nano-silica concrete softener, hardener with acid softener or hardened densifier with lithium or sodium silicate or some combination of these.

To ensure out of plane flexibility of polishing discs long-slotted holes may be used as that will be illustrated next and further on. That allows for large scale polishing blocks compounded from porous material which allows water seeping through under gravity. An exemplary material is the burned out clay or sponge brick or pressed felt impregnated or compounded with polishing grits. FIGS. 55-60 illustrates such embodiments of the invention.

Figure 55:
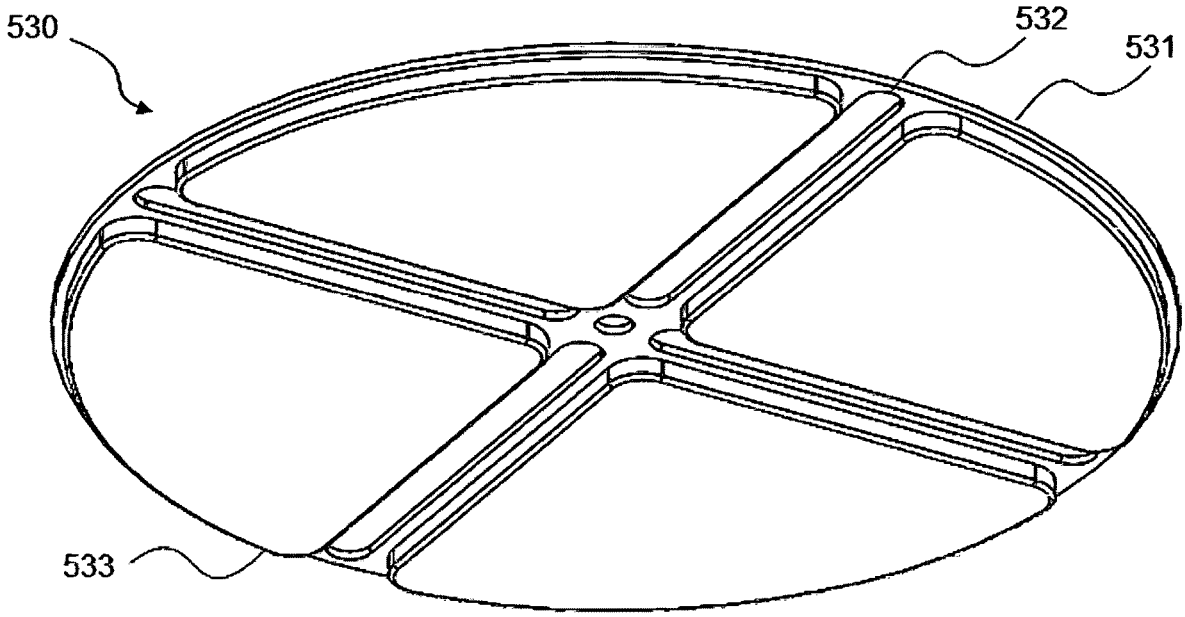
FIG. 55 is an isometric bottom view of another exemplary polisher disc with slots and large polisher pads.
Figure 56:
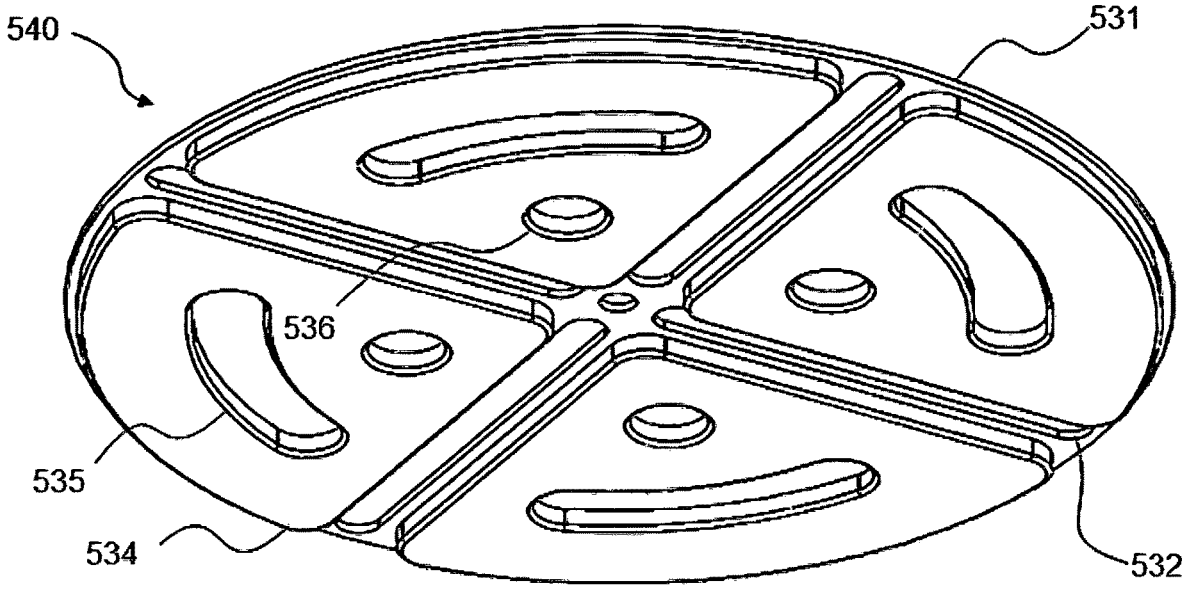
FIG. 56 is the same as FIG. 55 with articulated polisher pads.
Figure 57:
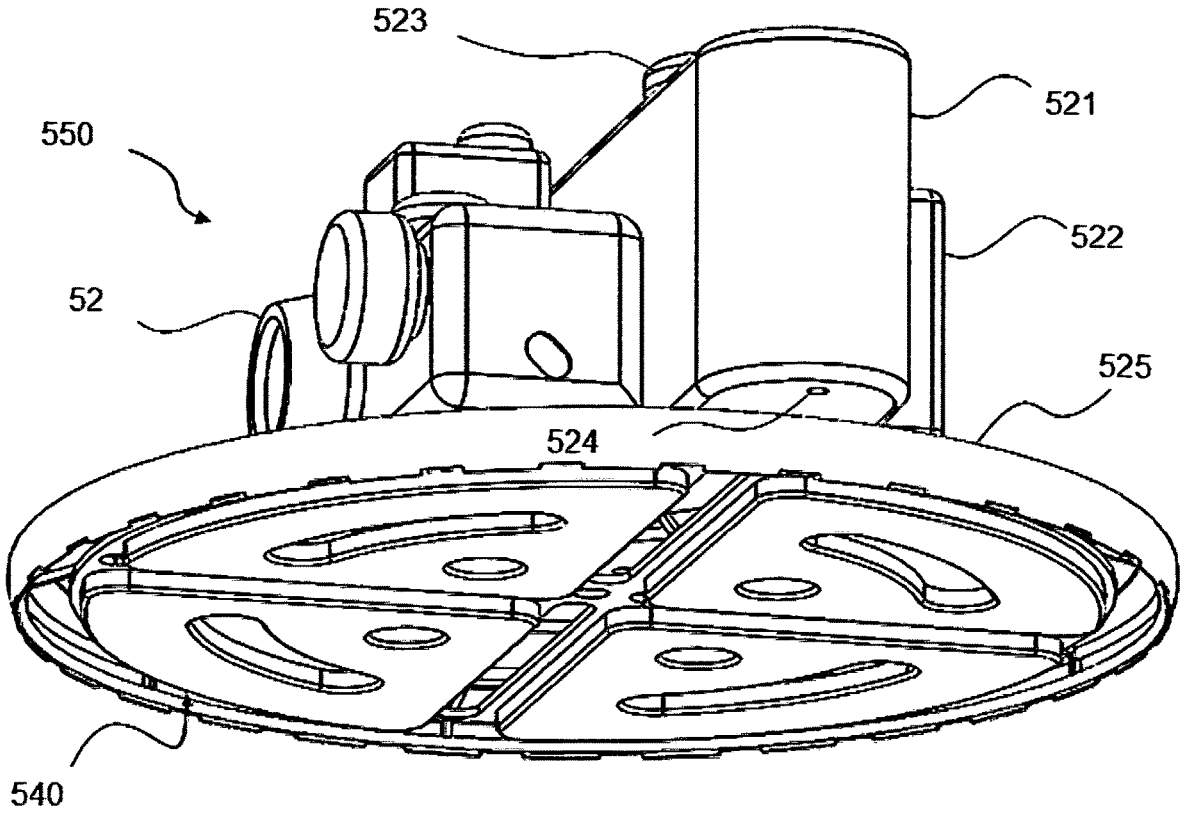
FIG. 57 is the same as FIG. 56 mounted on a power trowel-grinder conversion machine.
Figure 58:
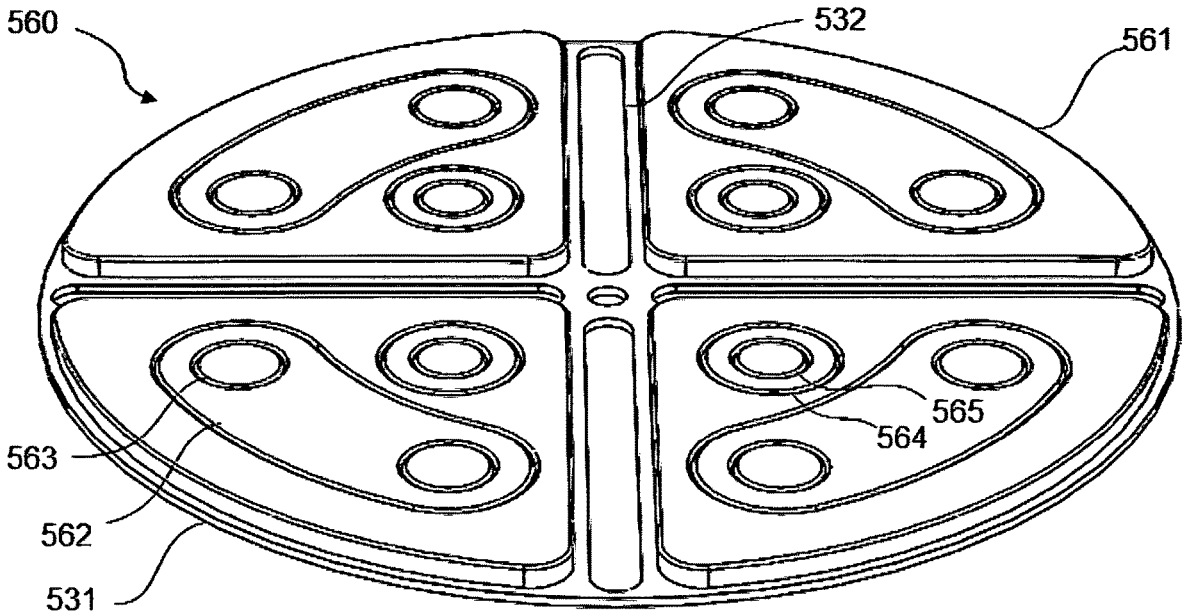
FIG. 58 is an isometric bottom view of another exemplary polisher disc with slots and large articulated polisher pads with nested articulated polisher pads of different grit sizes.
Figure 59:
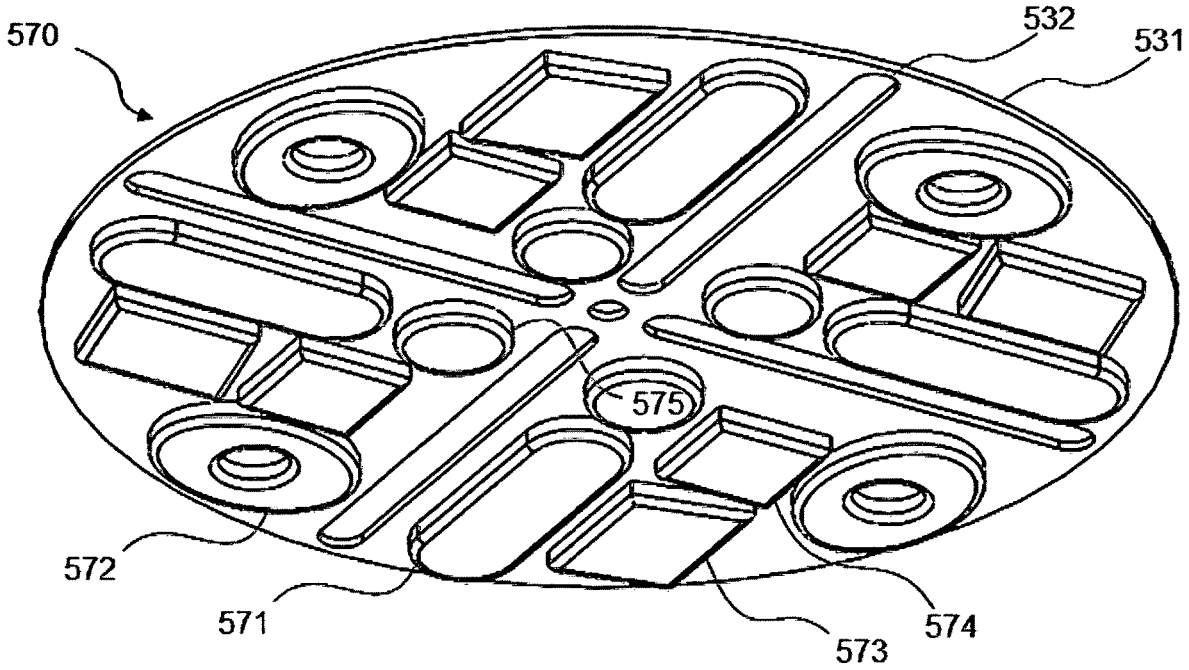
FIG. 59 is an isometric bottom view of another exemplary polisher disc with slots and assorted polisher/grinder pads.
Figure 60:
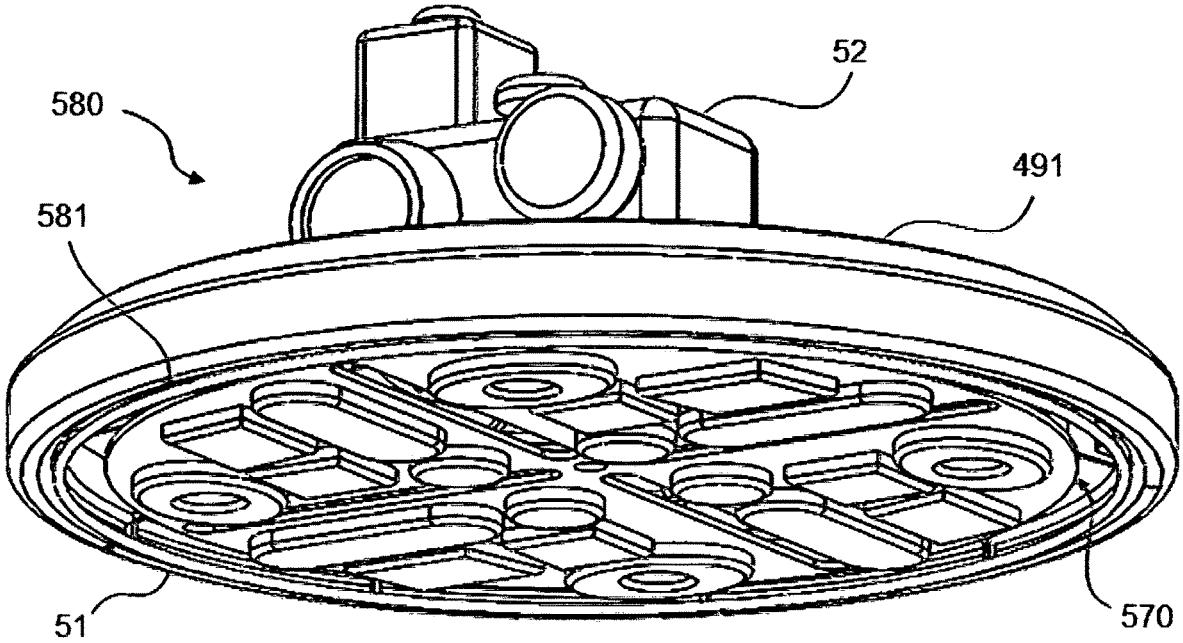
FIG. 60 is the same as FIG. 59, inserted into a conversion power trowel with lift-off squeegee water tank guard.

Attention is now turned to FIG. 55, which by assembly 530, illustrates an isometric bottom view of exemplary polisher disc 531 with long slots 532 and large compliant polisher pads 533. FIG. 56 illustrates the same with articulated polisher pads 534 having circular slot cutouts 535 and circular cutouts 536. The cutouts accumulate slurry waste in the pockets extending allowable polishing time before lift-off. FIG. 57 illustrates the use of disc 540 in conversion machine 520. (Likewise elements labeled likewise.) FIG. 58, by assembly 560, illustrates polishing disk 560, which is similar to disk 540 but with larger cutouts, in which smaller pads are nested. In particular, in pads 561, kidney pads 562 are nested, in which circular pocks 563 are nested. In pads 561 ring pads 564 and small pucks 565 are also nested. These pads may have different grit sizes, but similar or identical flexibilities or degradation rates via wear while polishing. FIG. 59 illustrates disk 531 with slots 532 and assorted polishing blocks, including racetrack shape 571, hollow elliptical shape 572, diamond shape 573, square shape 574 and circular shape 573. These different shape blocks may have different grit sizes. FIG. 60 illustrates the use of assembly 570 in power trowel conversion machine 580 having adjustable cage cover slurry skirt 491 with squeegee or hair-fibrous material rim 581.

Finally, exemplary polishing pad nesting will be illustrated in FIG. 61 by half nested assembly 590 having half-moon polishing block 591 and half circle block 592, separated by slurry gap 593. Also, illustrated in FIG. 62, by assembly 600, ring shape polishing block 601, with nested circular puck 602 separated by slurry gap 603. And finally, illustrated in FIG. 63 by assembly 610, hex ring polishing block 611 with nested hex block 612 separated by uneven slurry gap 613.

Blocks 592, 602 and 612 are retrievable to fly above the floor by 0.5-1.5". Lift-off polisher heads may be mixed with stay-down heads in other multi head grinder-polisher head configurations disclosed above.

The present invention is described above with reference to a preferred embodiment. However, those skilled in the art will recognize that changes and modifications may be made in the described embodiment without departing from the nature and scope of the present invention. For instance, trowel-to-polisher head conversion is intuitive, and thus hereby instructive, in reverse, that is in polisher-to-trowel conversion configuration. Adding a roller leg to facilitate rolling the machine to stash away, if it does not have one already, is also considered instructive. Finally, adding a swivel arm attachment, as well as polisher head drivers to a trowel blade for a more functional polisher conversion is also considered within the scope and specifications of this invention. Also within the scope, in any combination, battery powered electrical walk-behind, sit-on and remote-controlled trowel machine conversions and standalone polishing or grinding robots. Finally, reeling cables and hoses, including slurry lines, from the wall or the ceiling are obvious modifications in any combination and thus considered within the scope of the invention.

Various further changes and modifications to the embodiment herein chosen for purposes of illustration will readily occur to those skilled in the art. To the extent that such modifications and variations du not depart from the spirit of the invention, they are intended to be included within the scope thereof. For instance, said steel wool puck may be made of plastic, at least in part, and may be attached to blades, rather than a disc and said machine may be propelled by wheels driven by electric motors as well. Slurry suction heads, hoses and canisters may also be added to any polisher-grinder robots constructed as per the specifications of the invention, without deviating from its scope. Adding slurry coloring to indicate the completeness of the job by slurry color change and making parts in contact with slurry of stainless steel or composite plastic is also considered an obvious modification.

Having fully described the invention in such clear and concise terms as to enable those skilled in the art to understand and practice the same, the invention claimed is:

1. A robotic machine for hard floor smoothing comprising:

a first autonomous grinder-polisher module comprising a first self-contained body, a first source of rotational energy disposed within the first self-contained body, a first plurality of rotational grinding discs driven by the first source of rotational energy, and a first onboard power source disposed within the first self-contained body and coupled to the first source of rotational energy;

a second autonomous grinder-polisher module comprising a second self-contained body, a second source of rotational energy disposed within the second self-contained body, a second plurality of rotational grinding discs driven by the second source of rotational energy; and a second onboard power source disposed within the second self-contained body and coupled to the second source of rotational energy;

a releasable coupling structure connecting the first autonomous grinder-polisher module and the second autonomous grinder-polisher module, the releasable coupling structure being separable such that the first and second autonomous grinder-polisher modules are each operable as a standalone grinder-polisher unit when decoupled;

wherein each of the first and second plurality of rotational grinding discs includes at least two discs configured to operate in counter rotational directions to generate hydroplaning forces; and wherein the robotic machine is configured to operate the first and second plurality of rotational grinding discs independently to control directional movement of the coupled modules and glide on a floor by hydroplaning alone and remove floor material to smooth the floor.

2. The robotic machine as in claim 1, wherein the first plurality of rotational grinding discs are dedicated to concrete grinding.

3. The robotic machine as in claim 1, wherein the first plurality of rotational grinding discs includes a first grinding disc having a first grit, and a second grinding disc having a second grit, the first grit being coarser than the second grit.

4. The robotic machine as in claim 1, further comprising a handle extending upwardly from one of the autonomous grinder-polisher modules.

5. The robotic machine as in claim 1, further comprising at least one magnetic ball drive.

6. The robotic machine as in claim 1, further comprising two or more swivel wheel drives.

7. The robotic machine as in claim 1, further comprising a liquid feed conduit extending through the first plurality of rotational grinding discs.

8. The robotic machine as in claim 1, further comprising a tank, the tank containing one or more of hardener, softener, detergent, micro-polisher skin fluid, nano-polisher skin fluid, nano-silica concrete softener or hardened densifier with lithium or sodium silicate.

9. The robotic machine as in claim 1, further comprising a driving system including one or more of GPS, laser, LIDAR, sonar or ultra-sonic guide of beams or pulses.

10. The robotic machine as in claim 1, wherein the first plurality of rotational grinding discs are driven by one or more of spur gears, planetary gears, belts, chains, hydraulic or electric drives.

11. The robotic machine as in claim 1, further comprising a skirt in contact with floor, wherein the skirt is configured to inhibit liquid splashing from the machine.

12. The robotic machine as in claim 1, wherein the source of rotational energy is an engine.

13. The robotic machine as in claim 1, wherein the source of rotational energy is a motor.

14. The robotic machine as in claim 1, wherein the source of rotational energy comprises a plurality of electric motors, and each of the plurality of rotary rotational grinding discs is directly coupled to one of the plurality of electric motors.

15. The robotic machine as in claim 3, wherein the first source of rotational energy comprises a first electric motor and the second source of rotational energy comprises a second electric motor.

16. The robotic machine as in claim 15, wherein the first onboard power source comprises a first battery, and the second onboard power source comprises a second battery.

17. The robotic machine of claim 1, wherein the coupling structure comprises semi-rigid bar couplers that permit limited relative movement between adjacent modules during turning operations.

18. The robotic machine of claim 1, wherein the first and second autonomous grinder-polisher modules are arranged in parallel configuration and coupled via a rigid frame that maintains the modules in fixed lateral spacing.

19. The robotic machine of claim 1, wherein the first and second autonomous grinder-polisher modules are arranged in parallel configuration and coupled via a flexible cage coupler that permits relative angular displacement while maintaining module connection.

20. The robotic machine of claim 1, further comprising a handle assembly attachable to one of the first and second autonomous grinder-polisher module, the handle assembly comprising sockets for receiving mating portions of a detachable handle for manual guidance assistance.

21. The robotic machine of claim 1, further comprising a third autonomous grinder-polisher module coupled to the first and second autonomous grinder-polisher modules in a serial coupling, the third autonomous grinder-polisher module including a third plurality of rotational grinding discs and a slurry suction system, wherein the first plurality of rotational grinding discs has a first grit, the second plurality of rotational grinding discs ha a second grit finer than the first grit, and the third plurality of rotational grinding discs has a third grit finer than the second grit.

* * * * *